US010569574B2

(12) United States Patent
Hatle et al.

(10) Patent No.: US 10,569,574 B2
(45) Date of Patent: Feb. 25, 2020

(54) METHOD AND SYSTEM FOR ENHANCING THROUGHPUT OF THERMAL PRINTER CUTTER

(71) Applicant: Datamax-O'Neil Corporation, Altamonte Springs, FL (US)

(72) Inventors: Richard Hatle, Casselberry, FL (US); Thomas Celinder, Singapore (SG)

(73) Assignee: Datamax-O'Neil Corporation, Altamonte Springs, FL (US)

( * ) Notice: Subject to any disclaimer, the term of this patent is extended or adjusted under 35 U.S.C. 154(b) by 27 days.

(21) Appl. No.: 16/040,804

(22) Filed: Jul. 20, 2018

(65) Prior Publication Data

US 2020/0023657 A1 Jan. 23, 2020

(51) Int. Cl.
*B41J 11/66* (2006.01)
*B41J 2/335* (2006.01)

(52) U.S. Cl.
CPC ..... *B41J 11/663* (2013.01); *B41J 2/335* (2013.01)

(58) Field of Classification Search
CPC ..... B41J 11/663; B41J 2/335; B41J 3/4075; B41J 11/66; G03D 15/046
See application file for complete search history.

(56) References Cited

U.S. PATENT DOCUMENTS

| | | | |
|---|---|---|---|
| 4,221,144 | A | 9/1980 | Diesch et al. |
| 5,447,383 | A | 9/1995 | Hirono et al. |
| 5,741,082 | A | 4/1998 | Toya |
| 2013/0050384 | A1 | 2/2013 | Sugimoto |

OTHER PUBLICATIONS

Bolder et al "Enhancing Flatbed Printer Accuracy and Throughput: Optimal Rational Feedforward Controller Tuning Via Iterative Learning Control", IEEE Transactions on Industrial Electronics, vol. 64, No. 5, May 2017, pp. 4207-4216. (Year: 2017).*

* cited by examiner

*Primary Examiner* — Huan H Tran
(74) *Attorney, Agent, or Firm* — Alston & Bird LLP

(57) ABSTRACT

Provided herein is system and method for enhancing throughput of a thermal printer cutter. The system operates in a first printing mode in an instance in which a designated safe zone is detected. A second print media portion is traversed in downstream direction for printing after printing of a first print media until a designated safe zone is detected under a print head. The printing is suspended at a first point on the second print media portion. A first movement of the print media is caused in one of the downstream or upstream direction until a first cut point of the first print media portion is detected under cutter blade for cutting operation. A second movement of the print media is caused in one of the downstream or upstream direction until a third point is detected under print head. The printing resumes from the first point on the second print media portion.

20 Claims, 29 Drawing Sheets

METHOD AND SYSTEM FOR ENHANCING THROUGHPUT OF THERMAL PRINTER CUTTER

TECHNOLOGICAL FIELD

Exemplary embodiments of the present disclosure relate generally to printers and, more particularly, to methods, systems, and apparatuses that enhance the throughput of a thermal printer cutter.

BACKGROUND

Printing systems, such as copiers, printers, facsimile devices or other systems, may be capable of reproducing content, visual images, graphics, texts, etc. on a page or a media. Some examples of the printing systems may include, but not limited to, thermal printers, inkjet printers, laser printers, and/or the like.

A typical thermal printer includes a thermal print head that has one or more heating elements. These heating elements may be individually or collectively energized to perform the printing operation. Examples of the thermal printers may include thermal transfer printers and direct thermal printers. Typically, in thermal transfer printer, content is printed on the media by heating a coating of a ribbon so that the coating is transferred to the media. It contrasts with the direct thermal printing where no ribbon is present in the process.

In label thermal printers, a cut point on a print media, such as a label, needs to be presented under a cutter blade for cutting the label. Thereafter, to prepare for printing next label, the print media retracts back to the beginning of the next label and the same process is repeated thereon. However, based on such technique, the presentation of the label cut points and the retraction time of the media may add up to about one extra second between the labels. Thus, the printing speed slows down thereby degrading the throughput of the label thermal printer cutter.

Applicant has identified a number of deficiencies and problems associated with conventional methods for enhancing the throughput of a thermal printer cutter. Through applied effort, ingenuity, and innovation, many of these identified problems have been solved by developing solutions that are included in embodiments of the present disclosure, many examples of which are described in detail herein.

SUMMARY

Various embodiments illustrated herein disclose a method for enhancing throughput of a thermal printer cutter. The method may include receiving, by a processor, a print job for a plurality of print media portions including at least a first print media portion and a second print media portion. The method may further include operating, by a calibration unit, the thermal printer in a calibration mode. In an example embodiment, operating the thermal printer in the calibration mode may include analysis, by the calibration unit, an image of the received print job to be printed in a print area of each of the plurality of print media portions. Operating the thermal printer in the calibration mode may further include determining a reference mark and identifying a search area having a first length in the print area of each of the plurality of print media portions based on the determined reference mark and a set of parameters. The reference mark may be a mark in the second print media portion when a first cut point corresponding to the first print media portion is under a cutter blade of a cutter assembly in the thermal printer. Operating the thermal printer in the calibration mode may further include designating, by the calibration unit, a safe zone having a second length within the identified search area within a defined proximity to the reference mark within the search area based on one or more predefined criteria.

In an example embodiment, operating the thermal printer in the calibration mode may include operating, by a print operation unit, the thermal printer in a first printing mode in an instance in which a designated safe zone is detected. Operating the thermal printer in the first printing mode may include causing, by the print operation unit, a traversal of the first print media portion in a downstream direction with respect to a print head in the thermal printer to perform a print operation. Operating the thermal printer in the first printing mode may further include causing, by the print operation unit, a traversal of the second print media portion in the downstream direction with respect to the print head to perform the print operation, while the printed first print media portion traverses in the downstream direction with respect to the cutter blade positioned next to the print head within a defined distance in the thermal printer, until the designated safe zone on the second print media portion is detected under the print head. Operating the thermal printer in the first printing mode further may include suspending, by the print operation unit, the printing operation at a first point on the second print media portion until the traversal of the second print media portion halts at a second point in the downstream direction, and causing, by the print operation unit, a first movement of the print media in one of the downstream direction or an upstream direction, based on a position of the designated safe zone with respect to a reference mark, until the first cut point of the first print media portion is detected under the cutter blade. Operating the thermal printer in the first printing mode may further include causing, by the print operation unit, a cutting operation on the first cut point of the first print media portion using the cutter blade, and causing, by the print operation unit, a second movement of the print media in one of the downstream direction or the upstream direction, based on the position of the designated safe zone with respect to the reference mark, until a third point is detected under the print head. The print operation unit may then resume the printing operation from the third point on the second print media portion.

In an alternate embodiment, the method may include operating, by the print operation unit, the thermal printer in the second printing mode in an instance in which the designated safe zone is not detected. Operating the thermal printer in the second printing mode may include causing, by the print operation unit, a traversal of the first print media portion in the downstream direction with respect to the print head in the thermal printer to perform the print operation. Operating the thermal printer in the second printing mode further may include causing, by the print operation unit, a traversal of the second print media portion in the downstream direction with respect to the print head to perform the print operation, while the printed first print media portion traverses in the downstream direction with respect to the cutter blade positioned next to the print head within a defined distance in the thermal printer. Operating the thermal printer in the second printing mode may include detecting and/or determining that, by the print operation unit, the reference mark on the second print media portion during the printing operation being performed at the second print media, and suspending, by the print operation unit, the printing operation at a first point identified before the detected reference mark on the second print media portion. Operating the thermal printer in the second printing mode may further include causing, by the print operation unit, a ramping down operation so that the print media traverses a ramp-down distance after the first point in the downstream direction till the print media is stationary and the detected reference mark is under the cutter blade, and causing, by the print operation unit, a cutting operation on the first cut point of the first print media portion using the cutter blade. Operating the thermal printer in the second printing mode may further include causing, by the print operation unit, a movement of the print media in the upstream direction, until a second point before the suspension point is located under the print head, and causing, by the print operation unit, a ramping up operation so that the print media traverses a ramp-up distance after the second point in the downstream direction till the print media attains a constant speed by and/or at the suspension point. The method may then resume the printing operation from the suspension point on the second print media portion.

In some embodiments, the first print media portion may be separated from the second print media portion by a first cut point defined at a predetermined distance from a second cut point along length of the print media, wherein the first cut point may correspond to the first print media portion and the second cut point may correspond to the second print media portion. In some embodiments, the set of parameters may include at least a start parameter and a stop parameter, wherein the start parameter and the stop parameter are based on at least one of (a) a printing speed of the thermal printer, (b) a length of each of the plurality of print media portions (e.g., a distance between the first cut point and the second cut point), (c) a distance between a trailing edge of the first print media portion and a leading edge of the second print media portion, or (d) print margins of each of the plurality of print media portions. In various embodiments, the one or more predefined criteria correspond to one of an automatic selection or manual selection of an area within the identified search area, wherein the automatic selection or the manual selection of the area is based on a maximum empty space, one or more non-critical objects, or minimum count of one or more critical objects. The manual selection of the area may be further based on a set of object preferences provided by an operator of the thermal printer and/or an administrator corresponding to a print job (both of which will be referred to as an operator herein), wherein the set of object preferences are associated with the one or more non-critical objects and/or the one or more critical objects. In an example embodiment, the downstream direction may correspond to a forward direction along a web direction of the print media, and the upstream direction may correspond to a backward direction opposite to the web direction of the print media.

In an example embodiment, the method may further include causing, by the print operation unit, a ramping down of a stepper motor in the thermal printer from a constant speed at the suspension point and attaining a zero speed at a first point in the designated safe zone, wherein the suspension point corresponds to a point of deceleration of the stepper motor from the constant speed, wherein a distance traversed by the print media (e.g., web of print media) during the ramping down of the stepper motor corresponds to a ramp-down distance. In an example embodiment, method may further include causing, by the print operation unit, a ramping up of the stepper motor in the thermal printer accelerating from a zero speed at a second point in the designated safe zone and attaining the constant speed at the suspension point in the designated safe zone, wherein the suspension point corresponds to a point when the stepper motor attains the constant speed, wherein a distance traversed by the print media (e.g., web of print media) during the ramping up of the stepper motor corresponds to a ramp-up distance, wherein the second point is located towards the upstream direction before the first point at a distance that corresponds to summation of ramp-down distance and ramp-up distance from the second point.

In various embodiments, the designated safe zone may be without an object or may include one or more non-critical objects. Further, the designated safe zone may be within a predefined distance from the reference mark. In an instance when the designated safe zone is without an object or includes one or more non-critical objects, the second length of the designated reference zone is at least equal to a combination of a ramp-up distance and a ramp-down distance traversed by the print media. In an example embodiment, the designated safe zone may include one or more objects selected by an operator.

The above summary is provided merely for purposes of providing an overview of one or more exemplary embodiments described herein to provide a basic understanding of some aspects of the disclosure. Accordingly, it will be appreciated that the above-described embodiments are merely examples and should not be construed to narrow the scope or spirit of the disclosure in any way. It will be appreciated that the scope of the disclosure encompasses many potential embodiments in addition to those here summarized, some of which are further explained within the following detailed description and its accompanying drawings.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which:

FIG. 7E', in conjunction with FIGS. 7A-7C, illustrates a timing diagram depicting an example printing operation in the first printing mode in an instance when the safe zone either empty or includes non-critical objects, according to one or more embodiments of the present disclosure described herein;

DETAILED DESCRIPTION

Figure 1A:
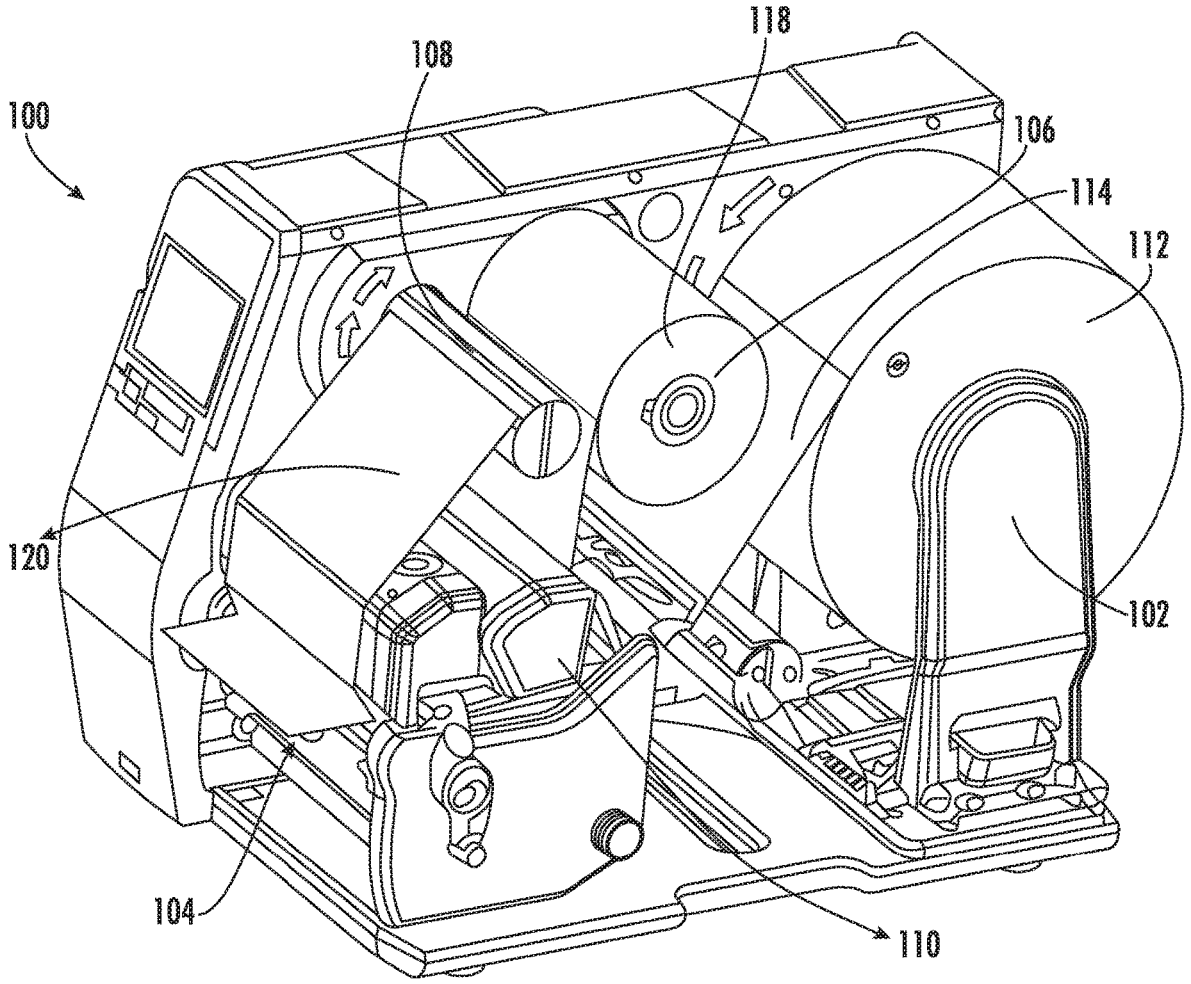
FIGS. 1A-1E illustrate perspective views of a printer, according to one or more embodiments described herein.
Figure 1B:
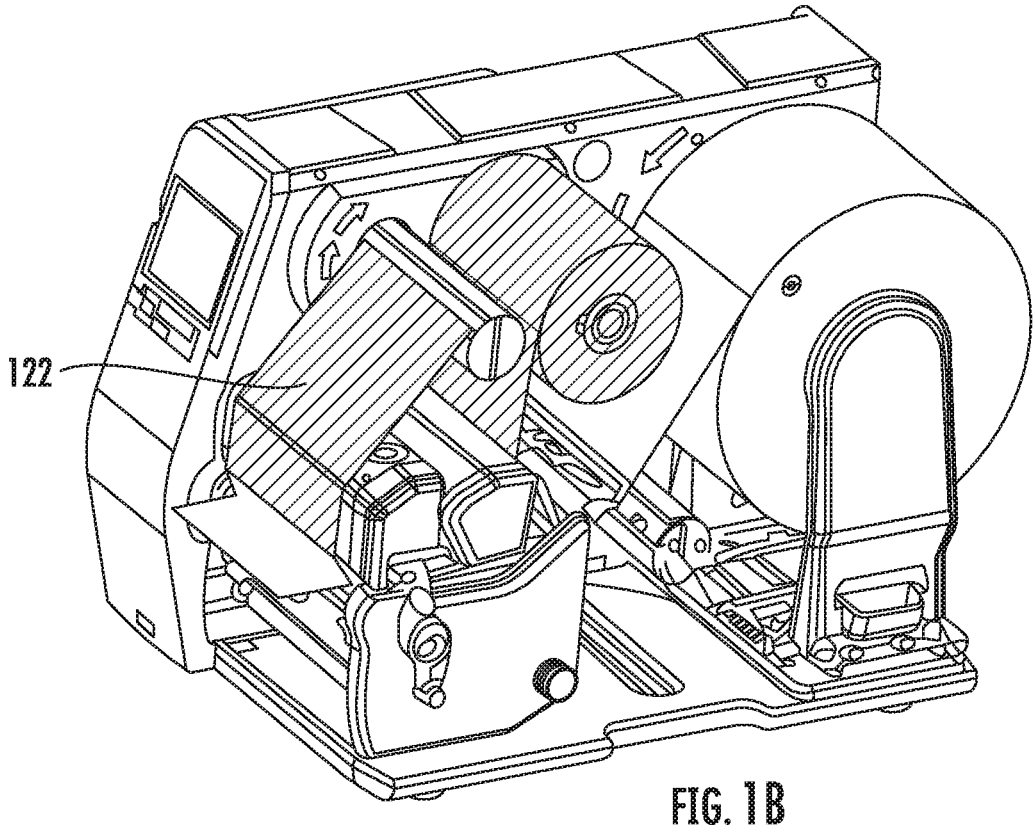
Figure 1C:
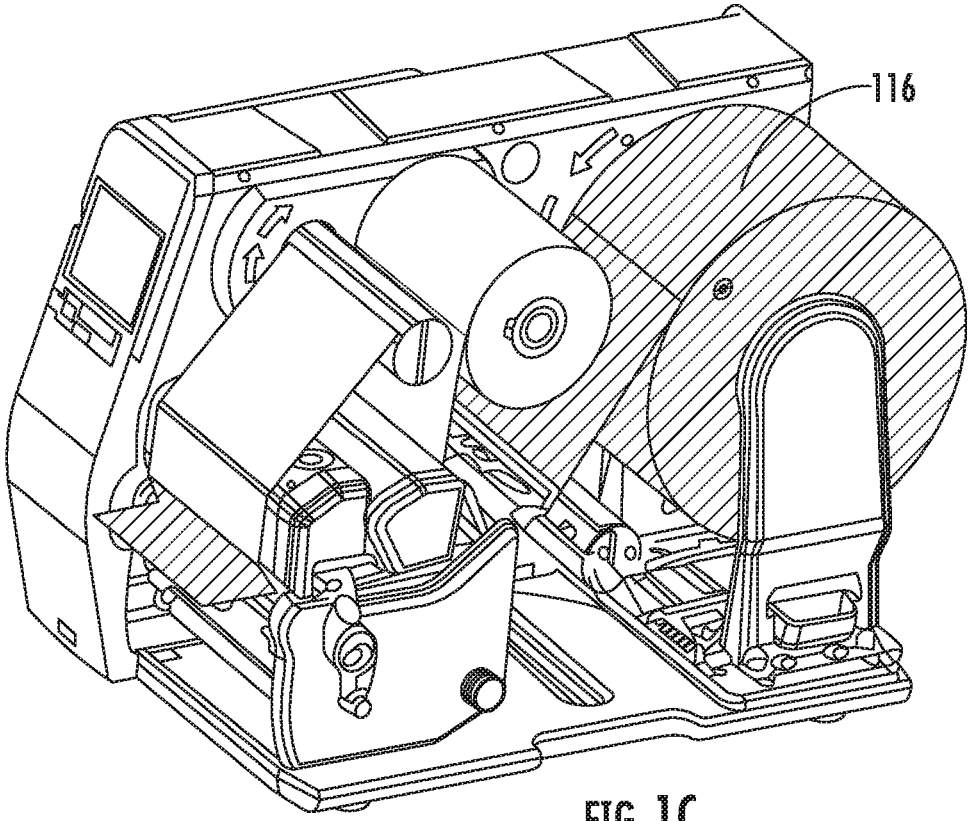

Some embodiments of the present disclosure will now be described more fully hereinafter referring to the accompanying drawings, in which some, but not all embodiments of the disclosure are shown. Indeed, these disclosures may be embodied in many different forms and should not be construed as limited to the embodiments set forth herein; rather, these embodiments are provided so that this disclosure will satisfy applicable legal requirements. Like numbers refer to like elements throughout. Terminology used in this patent is not meant to be limiting insofar as devices described herein, or portions thereof, may be attached or utilized in other orientations.

The term "comprising" means including but not limited to, and should be interpreted in the manner it is typically used in the patent context. Use of broader terms such as comprises, includes, and having should be understood to provide support for narrower terms such as consisting of, consisting essentially of, and comprised substantially of, and/or the like.

The phrases "in one embodiment," "according to one embodiment," and the like generally mean that the particular feature, structure, or characteristic following the phrase may be included in at least one embodiment of the present disclosure, and may be included in more than one embodiment of the present disclosure (importantly, such phrases do not necessarily refer to the same embodiment).

The word "exemplary" is used herein to mean "serving as an example, instance, or illustration." Any implementation described herein as "exemplary" is not necessarily to be construed as preferred or advantageous over other implementations.

If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

As used herein, the terms "approximately," "substantially," and similar terms refers to tolerances within the corresponding manufacturing and/or engineering standards.

The word "print media" is used herein to mean a printable medium, such as a page or paper, on which content, such as graphics, text, and/or visual images, may be printable. In some embodiments, the media may correspond to a thermal media on which the content is printed on by application of heat on the media itself or the media may correspond to a liner media, a liner-less media, and/or the like. The media may correspond to a continuous media that may be loaded in the printer in form of a roll or a stack or may correspond to media that may be divided into one or more portions through perforations defined along a width of the media. Alternatively or additionally, the media may be divided into the one or more portions through one or more marks (e.g., limiting marks) that are defined at a predetermined distance from each other, along the length of the media. In an example embodiment, the limiting marks are physically present (e.g., optically and/or haptically identifiable) on the print media. In an example embodiment, the limiting marks are not physically present on the print media. In some example embodiments, a contiguous stretch of the media, between two consecutive marks or two consecutive perforations, corresponds to a portion of the media.

Generally, in label thermal printers, a cut point of a print media portion, such as a label or ticket, of a print media needs to be presented under the cutter blade for cutting the print media portion. Thereafter, to prepare for printing next print media portion, the print media retracts back to the beginning of the next print media portion and the same process is repeated thereon. However, based on such technique, the presentation of the print media portion cut points and the retraction time of the print media may add up to about one extra second between the printing of the print media portions. Thus, the printing speed slows down thereby degrading the throughput on the label thermal printer.

To overcome the above problems, the invention proposes a method and system to improve the printer/cutter throughput by eliminating the excess time spent due to the retraction motion of the print media, and at the same time preserving the print quality of the print job. The proposed method facilitates printing a first print media portion and start printing a second print media portion (following the first print media portion) until the first print media portion cut point reaches the cutter blade. At this first print media portion cut point, the printing of the second print media portion is stopped and the first print media portion is cut. Thereafter, printing of the rest of the second print media portion is continued. This process continues for all the remaining print media portions.

However, due to the proposed method, the print quality at an area of the second print media portion may be affected when the printing stops and restarts in the middle of the second print media portion. The print quality of the second print media portion may get affected at the end of ramping speed down (during stopping) and the beginning of ramping speed up (during starting). Thus, an example embodiment introduces a safe zone on the second print media portion where the printer may suspend printing and resume thereafter. The designation of the safe zone may be either be automatically identified by a printer processor based on minimally occupied spaces or manually selected based on various parameters and operator preferences. The designated safe zone needs to be within a short distance from a reference mark and be at least the size of ramp-up and ramp-down distance, specifically when the safe zone does not include any critical objects or does not include any objects at all. The suspension and resumption of the printing operation in the designated safe zone introduces minimal printing defects, and the minimal retraction saves on extra time taken by the printer for adjustment of the print media portions, resultantly improves the print quality while at the same time enhances the throughput of the thermal printer cutter.

Figure 1D:
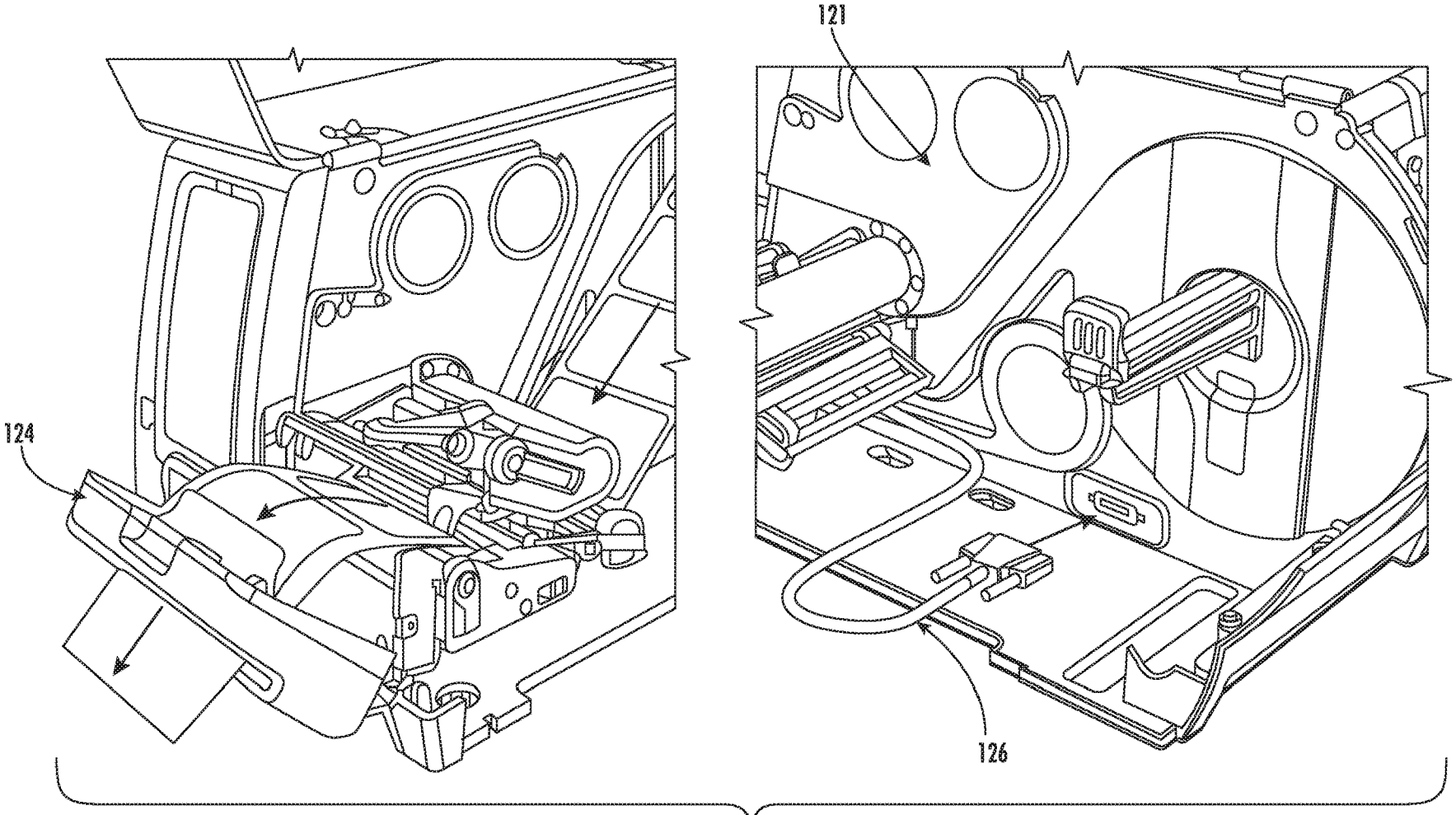

FIGS. 1A-1E illustrate perspective views of a printer 100, according to one or more embodiments described herein. The printer 100 may include a media hub 102, a printer media output 104, a ribbon drive assembly 106, a ribbon take-up hub 108, and a print head 110. The printer 100 may further include a media roll 112, a print media 114, a media path 116, ribbon roll 118, a ribbon 120, and a ribbon path 122. Further, as shown in FIG. 1D, the printer 100 may further include a cutter assembly 124 with a cable assembly 126. In an example embodiment, the cutter assembly 124 is hard-wired into the printer 100 and/or to the control system 208. As shown in FIG. 1F, the cutter assembly 124 may further include a cutter blade 128, a cutter cover door 150, a cover screw 152, and a vertical cutter tray 154 (or a horizontal cutter tray 156).

In an example embodiment, the media hub 102 is configured to receive a media roll 112. In an example embodiment, the media roll 112 may correspond to a roll of a print media 114 that may be a continuous media or may, in some example embodiments, include one or more portions that are defined (in the print media 114) by means of perforations, cut points, or one or more marks. In an example embodiment, the media hub 102 is coupled to a first electrical drive (not shown) that actuates the media hub 102. On actuation, the media hub 102 causes the media roll 112 to rotate, which further causes the media roll 112 to supply the print media 114 to the print head 110 along the media path 116 (shaded in FIG. 1B). In an example embodiment, along the media path 116, the print media 114 traverses from the media roll 112 through the print head 110 to the printer media output 104.

In an example embodiment, the printer media output 104 corresponds to a slot or other opening through which the printed media is outputted from the print head 110. The width of the printer media output 104 is in accordance with a width of the print media 114. In some examples, the width of the printer media output 104 may correspond to a maximum width of the print media 114 supported by the printer 100. The printer media output 104 may be interfaced with the cutter assembly 124, which may be either a factory fitted or a field installable accessory.

The ribbon drive assembly 106 may receive the ribbon roll 118 that corresponds to a roll of the ribbon 120. In an example embodiment, the ribbon 120 may correspond to an ink media that is utilized to dispose ink onto the print media 114 to print content on the print media 114. In an example embodiment, the ribbon drive assembly 106 may be coupled to a second electrical drive that may be configured to actuate the ribbon drive assembly 106. On actuation of the ribbon drive assembly 106, the ribbon drive assembly 106 rotates, which in turn causes the ribbon roll to rotate that causes the ribbon roll 118 to supply the ribbon 120 along the ribbon path 122 (shaded in FIG. 1C). Along the ribbon path 122, the ribbon 120 traverses from the ribbon roll 118 to the print head 110 and further to the ribbon take-up hub 108.

In an example embodiment, the ribbon take-up hub 108 may correspond to an assembly that may receive used ribbon (i.e., a section of the ribbon 120 from which the ink has been is disposed on the print media 114). The ribbon take-up hub 108 may also be coupled to a third electrical drive that may be configured to actuate the ribbon take-up hub 108.

On actuation, the ribbon take-up hub 108 pulls the ribbon 120 from the ribbon roll 118. In an example embodiment, the second electrical drive and the third electrical drive may operate in synchronization such that an amount of the ribbon 120 released by the ribbon roll 118 (due to actuation of the second electrical drive) is equal to the amount of the ribbon 120 received by the ribbon take-up hub 108.

The print head 110 may correspond to a component that is configured to print the content on the print media 114. In an example embodiment, the print head 110 may include a plurality of heating elements (not shown), arranged in burn lines, that are energized and pressed against the ribbon 120 to perform a print operation. In operation, the print head 110 applies heat on a portion of the ribbon 120 and, concurrently, presses the ribbon 120 against the print media 114 to transfer the ink on the print media 114. In an example scenario where the print media 114 corresponds to a thermal paper, the print head 110 may be directly press against the thermal paper to perform the print operation, as described in FIGS. 3A-3C.

During the print operation, one or more heating elements of the plurality of heating elements are energized to perform the print operation. The one or more heating elements may be selected based on the data in a print job. For example, if a letter "A" is to be printed, the one or more heating elements that are energized are positioned on the print head 110 in such a manner that when the print head 110 is pressed against the ribbon 120 and the print media 114, letter "A" gets printed on the print media 114. To press the ribbon 120 against the print media 114, the print head 110 translates in a vertically downward direction (or downward direction) to push the ribbon 120 against the print media 114.

In an example embodiment, after the print operation, the print media 114 and the ribbon 120 traverse along the media path 116 and the ribbon path 122, respectively, such that the printed media 114 is outputted from the printer media output 104 and the used ribbon traverses to the ribbon take-up hub 108.

In some embodiments, the printed media 114 that is outputted from the printer media output 104, passes through the cutter assembly 124 connected to a connection port at a media compartment 121 of the printer via the cable assembly 126. The cutter assembly 124 may be used to cut print media portions, such as label or tag, of the print media 114, at a desired or predefined length. The presence of the cutter assembly 124 may be detected by the printer 100 upon power up. In case the printer 100 is not properly connected with the cutter assembly 124, the built-in error-handler of the printer 100 may handle the standard error and generate a display message along with the error code, for example "37 Cutter Device Not Found". The operator of the printer 100 may take necessary action accordingly.

In an example embodiment, the cutter assembly 124 may also include the vertical cutter tray 154 or the horizontal cutter tray 156. The vertical cutter tray 154 may be designed to stack around 20 tickets vertically in a sequence. The vertical cutter tray 154 may be utilized in various application areas, such as airline ticketing booth. The horizontal cutter tray 156 may be used to hold cut tickets in a horizontal position. The horizontal cutter tray 156 may be utilized in various application areas, such as movie ticket booth.

Figure 1E:
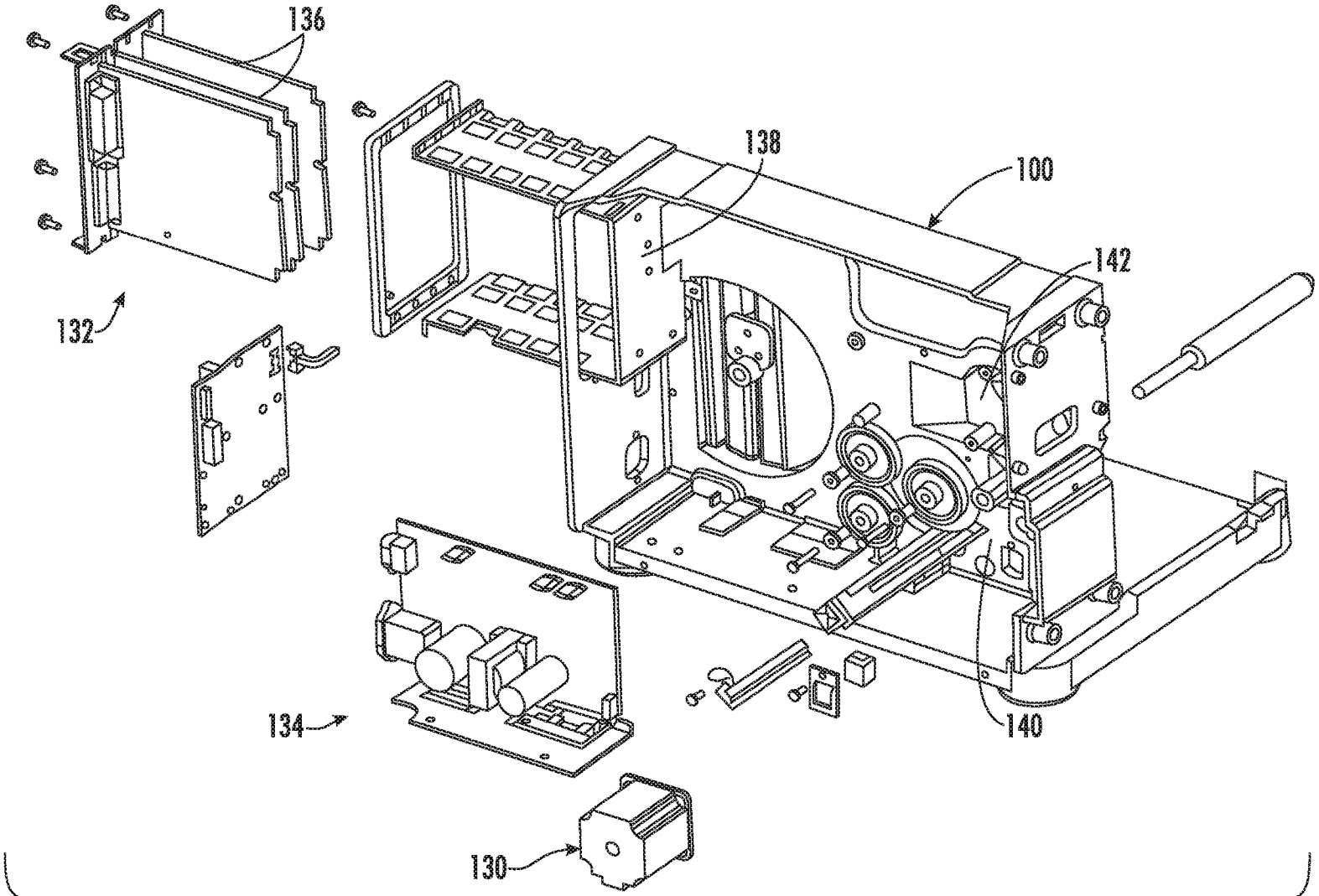
Figure 1F:
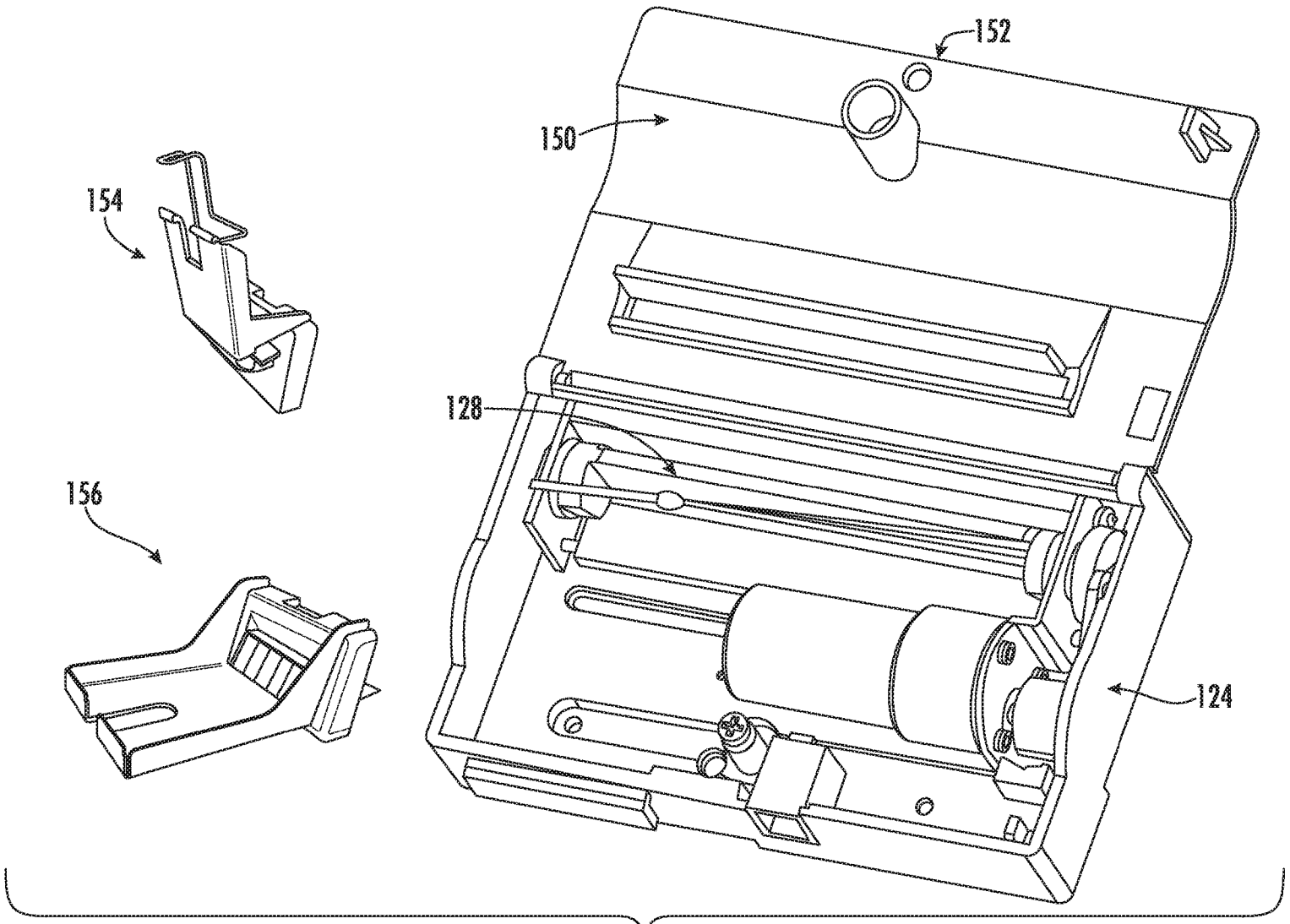
FIG. 1F illustrates a view of a cutter assembly of a thermal printer, according to one or more embodiments described herein.

Referring to FIG. 1E, there are shown various electrical and drive components that may be secured to the opposite side of the central support member (chassis) of the printer 100. The electrical and drive components may include a stepper motor 130 of a stepper motor assembly, an electronic circuitry 132, and an electric drive assembly 134 that are secured to the central support member on a side opposite to the printing components. The electronic circuitry 132 may include one or more circuit boards 136, which may be installed in the printer 100 by sliding the circuit boards 136 through an opening 138, formed in the casing of the printer 100. The circuit boards 136 may be chosen to suit a specific printing operation to be performed. For example, the electronic circuitry 132 may be changed for different communications interfaces. Alternatively, software can be downloaded via a mechanism, such as COM port or CUPS printer driver, to control a specific printing application. There is further shown a first mounting location 140 and a second mounting location 142 that may be configured to receive the stepper motor assembly.

The stepper motor 130 in the stepper motor assembly may be configured to actuate the electrical drives, such as the first, second, and/or third electrical drives of various other assemblies as discussed above, and also the media drive 312 (FIG. 3C), thereby controlling the traversal of the print media 114 in the downstream or upstream direction. For example, in an example embodiment, the actuation of the stepper motor 130, further actuates the first electrical drive that causes the media hub 102 to rotate, which in turn causes the media roll 112 to supply the print media 114 along the media path 116 (shaded in FIG. 1C). Additionally, the actuation of the stepper motor 130, further actuates ribbon drive assembly 106, which upon rotation, causes the ribbon roll to rotate that causes the ribbon roll 118 to supply the ribbon 120 along the ribbon path 122 (shaded in FIG. 1B). The actuation of the stepper motor 130, further actuates the third electrical drive that may be configured to actuate the ribbon take-up hub 108. Further, the actuation of the stepper motor 130, further actuates the media drive 312 that may be configured to control the traversal of the print media 114.

In an example embodiment, the printer 100 may be configured to operate in one or more modes. The one or more modes may include, but are not limited to, a calibration mode and a printing mode. In an example embodiment, in the calibration mode, the printer 100 is configured to calibrate itself, as is further described in conjunction with flowchart 600A of FIG. 6A. In an example embodiment, in the printing mode, the printer 100 is configured to perform the print operation in a first printing mode, as is further described in conjunction with flowcharts 700A and 700G of FIGS. 7A and 7G, or in a second printing mode, as is further described in conjunction with flowcharts 800A and 800B of FIGS. 8A and 8B.

Figure 2:
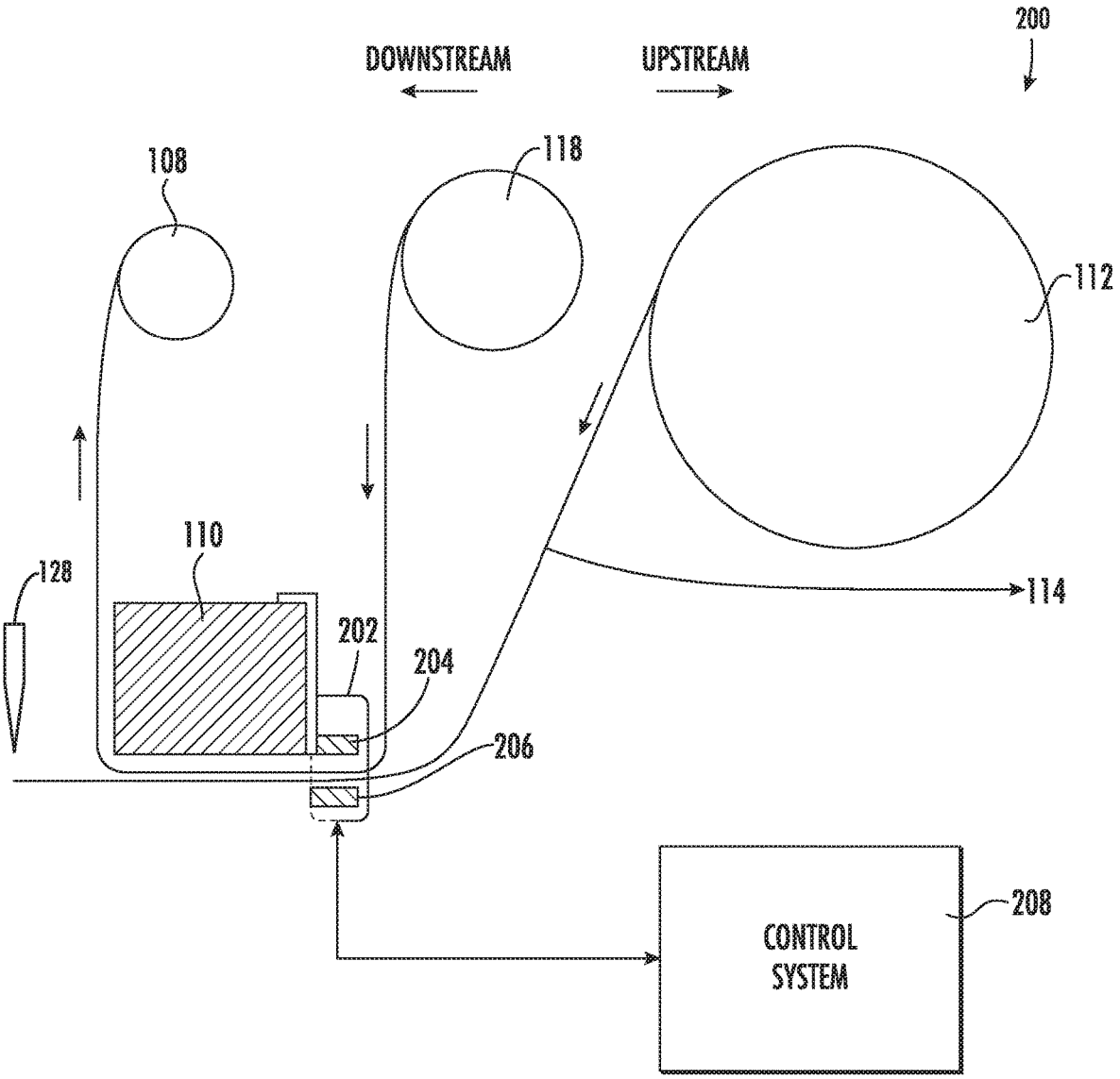
FIG. 2 illustrates a schematic of the printer, according to one or more embodiments described herein.

FIG. 2 illustrates a schematic of the printer 100, according to one or more embodiments described herein. The schematic of the printer 100 illustrates that the printer 100 further includes a media sensor 202 and a control system 208. The schematic of the printer 100 further depicts the media path 116, and the ribbon path 122. Furthermore, the schematic of the printer 100 depicts that the print head 110 is positioned downstream of the media roll 112 along the media path 116, and downstream of the ribbon roll 118 along the ribbon path 122. Further, the cutter blade 128 in the cutter assembly 124 is positioned downstream of the print head 110 along the media path 116 at a predefined distance from the print head 110. In various example embodiments, the predefined distance may vary from "0.5 inches" to "1.5 inches" that depends on the type of thermal printer in use.

In an example embodiment, the print head 110 is positioned on top of both the ribbon path 122 and the media path 116. Further, the ribbon path 122 is proximate to the print head 110 in comparison to the media path 116. Therefore, the ribbon 120 is proximate to the print head 110, in comparison to the print media 114, and is therefore, positioned above the print media 114. During the print operation, the print head 110 moves in a vertically downward direction to press the ribbon 120 against the print media 114 to perform the print operation. The cutter blade 128 is positioned at a predefined distance from the print head 110.

The media sensor 202 may correspond to a sensor that is configured to detect a presence of the print media 114 on the media path 116. In some example embodiments, the media sensor 202 may be configured to detect the presence of the print media 114 by determining transmissivity and/or reflectivity of the print media 114. In an example embodiment, the transmissivity of the print media 114 may correspond to a measure of an intensity of a light signal that print media 114 allows to pass through it. In an example embodiment, the reflectivity of the print media 114 may corresponds to a measure of an intensity of light signal that gets reflected from a surface of the print media 114.

In an example embodiment, the media sensor 202 includes a light transmitter 204 and a light receiver 206. The light transmitter 204 that may correspond to a light source, such as a Light Emitting Diode (LED), a LASER, and/or the like. The light transmitter 204 may be configured to direct the light signal on the media path 116.

The light receiver 206 that may correspond to at least one of a photodetector, a photodiode, or a photo resistor. The light receiver 206 may generate an input signal based on an intensity of the light signal received by the light receiver 206. In an example embodiment, the input signal may correspond to a voltage signal, where the one or more characteristics of the voltage signal, such as the amplitude of the voltage signal and/or frequency of the voltage signal, is directly proportional to the intensity of the portion of the light signal received by the media sensor 202.

In operation, the light transmitter 204 of the media sensor 202, may be configured to direct the light signal on the media path 116. If the print media 114 is present on the media path 116, a portion of light signal may get reflected from the surface of the print media 114. The light receiver 206 may receive the portion of the light signal and based on the intensity of the portion of the light signal, the light receiver generates the input signal. As the intensity of the portion of the light signal reflected from the surface of the print media 114 is dependent on the reflectivity of the print media 114, the input signal generated by the media sensor 202 (based on the intensity of the portion of the light signal) is indicative of a measure of the reflectivity of the print media 114.

Similarly, additionally or alternatively, the media sensor 202 may be configured to determine the transmissivity of the print media 114. To determine the transmissivity of the print media 114, the light receiver 206 may receive the portion of the light signal that passes through the print media 114. To receive the portion of the light signal that passes through the print media 114, the light receiver 206 is spaced apart from the light transmitter 204 in such a manner that the print media 114 passes through a space between the light receiver 206 and the light transmitter 204. When the light transmitter 204 directs the light signal on the print media 114, the portion of the light signal passes through the print media 114, which is then received by the light receiver 206. The light receiver 206, thereafter, may generate the input signal in accordance with the intensity of the portion of light signal received. As the intensity of the portion of the light signal that passes through the print media 114 is dependent on the transmissivity of the print media 114, the input signal generated by the media sensor 202 (based on the intensity of the portion of the light signal) is indicative of a measure of the transmissivity of the print media 114. For the purpose of ongoing description, the input signal has been considered to be indicative of the measure of the transmissivity/reflectivity of the print media 114. The media sensor 202 may be further configured to transmit the generated input signal to the control system 208.

A person having ordinary skills in the art would appreciate that the media sensor 202 generates the input signal in accordance with a predetermined sampling rate associated with the media sensor 202. In an example embodiment, the sampling rate may correspond to a frequency at which the media sensor 202 determines the transmissivity/reflectivity of the print media 114 and accordingly transmits the input signal.

In some embodiments, the media sensor 202 may be utilized to detect the one or more portions of the print media 114. As discussed supra, the print media 114 may include the one or more portions that are separated either by perforations or by the one or more marks (e.g., limiting marks). Therefore, when such marks/perforations on the print media 114 passes over the media sensor 202 during traversal of the print media 114, the media sensor 202 may detect a sudden increase/decrease in the measure of transmissivity/reflectivity of print media 114. Such sudden increase/decrease in the measure of the transmissivity/reflectivity of print media 114, gets reflected in the input signal generated by the media sensor 202. For example, the input signal generated by the media sensor 202 may include spikes or valleys indicating a sudden increase or decrease in the measure of the transmissivity/reflectivity of print media 114. Such spikes and valleys may be utilized to identify the one or more portions of the print media 114. As should be understood, a variety of media sensors 202 may be used in various embodiments to determine the presence and/or position of the print media (e.g., the position of a safe zone, cutting point, limiting mark, reference mark, and/or the like with respect to the print head 110 or cutter assembly 124).

In an example embodiment, once a print media portion of the print media 114 is printed by the print head 110, the print media portion traverses downstream along the print media 114 towards the cutter assembly 124. In an example embodiment, the cutter assembly 124 may be an end operator installable for the printer 100 and used to cut print media portions at a desired length(s).

The printer 100 further includes a control system 208 that includes suitable logic and circuitry to control the operation of the printer 100. For example, the control system 208 may be configured to control the operation of one or more components of the printer 100, in order to control the operation of the printer 100. For example, the control system 208 may be configured to control the heating/energization of the plurality of heating elements in the print head 110 and movement of the print media 114 to execute the print job. Further, the control system 208 may be configured to communicate with the media sensor 202. For example, the control system 208 may be configured to receive the input signal from the media sensor 202. The structure of the control system 208 has been further described in conjunction with FIG. 4.

In some embodiments, the printer 100 is operated in a calibration mode. In the calibration mode, the control system 208 in the printer 100 may be configured to analyze an image of a received print job to be printed in a print area of each of the plurality of print media portions of the print media 114. Thereafter, the control system 208 may be configured to determine a reference mark and identify a search area having a first length in the print area of each of the plurality of print media portions based on the determined reference mark, and a set of parameters. The reference mark may be a mark in a current print media portion when a cut point corresponding to a previous print media portion is under the cutter blade 128 of the cutter assembly 124 in the printer 100. Finally, the control system 208 may be configured to designate a safe zone having a second length within the identified search area and within a defined proximity to the reference mark within the search area based on one or more predefined criteria. Various instances of the set of parameters and the one or more predefined criteria are described in detail in FIG. 6A.

Once calibrated, the control system 208 may be configured to receive a print job for a plurality of print media portions. The control system 208 may be configured to operate the printer 100 in a first printing mode in an instance in which the designated safe zone is detected or in a second printing mode in an instance in which the designated safe zone is not detected.

In an example embodiment, in which the printer 100 operates in the first printing mode, the control system 208 may be configured to cause a traversal of a print media portion in a downstream direction with respect to the print head 110 in the printer 100 to perform the print operation. The control system 208 may be configured to cause a traversal of the current print media portion in the downstream direction with respect to the print head 110 to perform the print operation, while the previous printed print media portion traverses in the downstream direction with respect to the cutter blade 128, until the designated safe zone on the current print media portion is detected and/or determined to be located under the print head 110. Once the designated safe zone on the current print media portion is detected and/or determined to be located under the print head 110, the control system 208 may be configured to suspend the printing operation at a suspension point on the current print media portion and traverses further until the traversal of the second print media portion halts at a second point in the downstream direction.

The control system 208 may be further configured to cause a first movement of the print media 114 in one of the downstream direction or an upstream direction, based on a position of the designated safe zone with respect to the reference mark, until the cut point of the previous print media portion is detected and/or determined to be located under the cutter blade 128. The cutting operation is performed on the cut point of the previous print media portion using the cutter blade 128. The control system 208 may be configured to cause a second movement of the print media 114 in one of the downstream direction or the upstream direction, based on the position of the designated safe zone with respect to the reference mark, until the second point in the current print media portion is detected under the print head 110. The control system 208 may be configured to resume the printing operation from the second point on the current print media portion. Other embodiments are described in detail in FIGS. 7A, 7G, and 8A and 8B.

With regard to FIGS. 1A-1E, the printer 100 is depicted as a thermal transfer printer. However, in some embodiments, the scope of the disclosure is not limited to the printer 100 being a thermal transfer printer. In alternate embodiments, the printer 100 may correspond to a direct thermal printer, as is further described in conjunction with FIGS. 3A-3C.

Figure 3A:
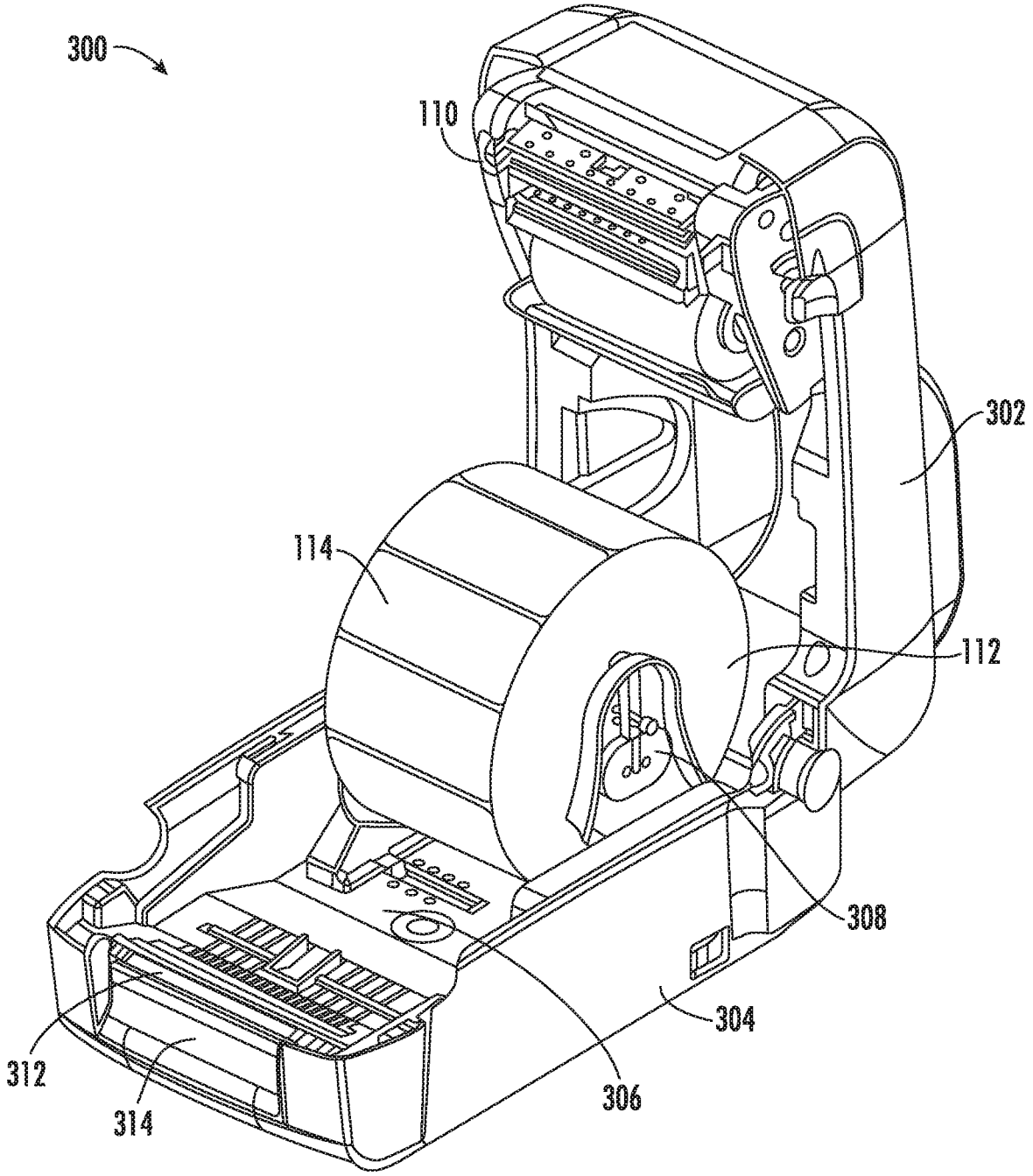
FIGS. 3A and 3B illustrate a perspective view an example direct thermal printer, respectively, according to one or more embodiments described herein.
Figure 3B:
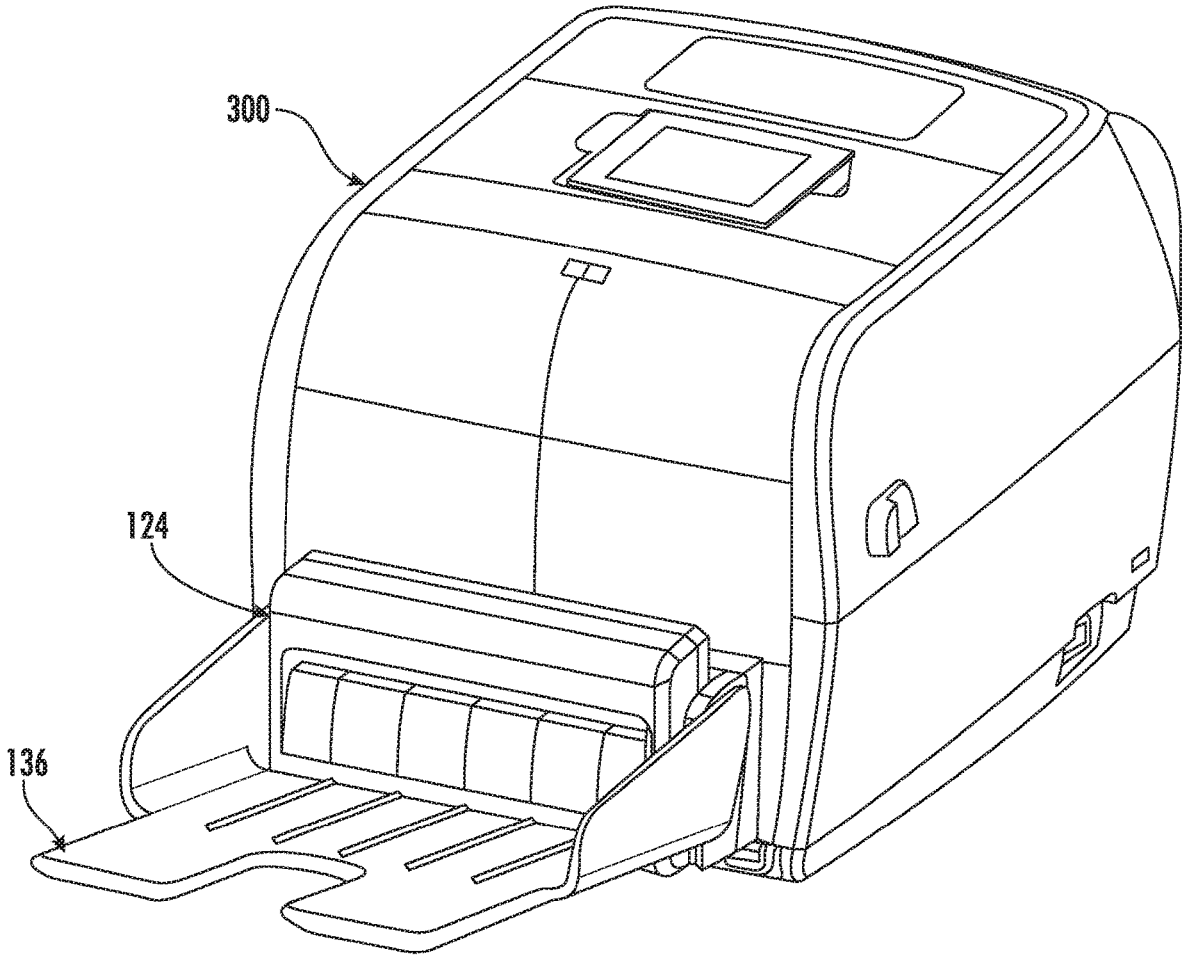
Figure 3C:
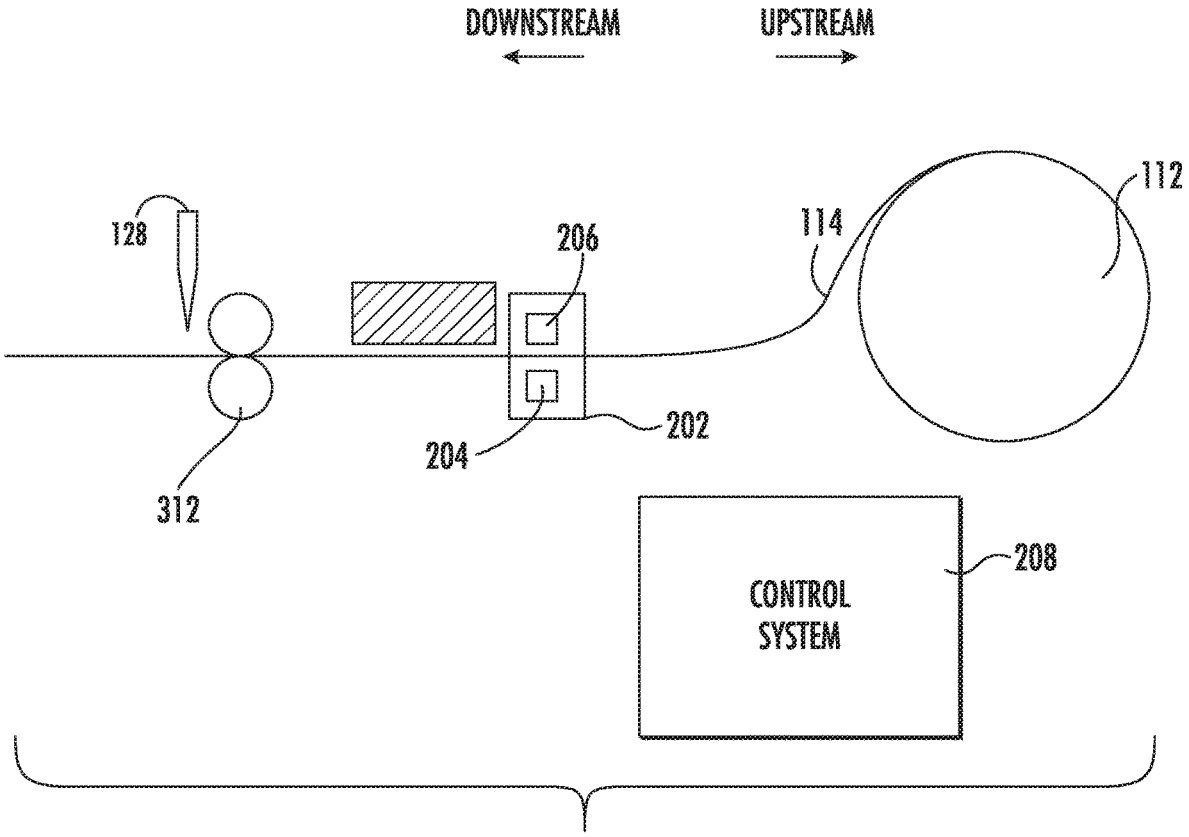
FIG. 3C illustrates a schematic of the direct thermal printer, according to one or more embodiments described herein.

FIGS. 3A-3C illustrate perspective views and a schematic of an example direct thermal printer 300, respectively, according to one or more embodiments described herein. Referring to FIG. 3A, the direct thermal printer 300 may include a housing that further includes a top cover 302 and a main body 304. The top cover 302 is pivotally coupled to the main body 304. Further, the top cover 302 receives the print head 110. The main body 304 of the direct thermal printer 300 has a print bed 306 from which a pair of media support members 308 extends in an upward direction. The pair of media support members 308 is configured to receive the media roll 112. In an example embodiment, the print media 114 in the media roll 112 corresponds to a thermal print media. The direct thermal printer 300 further includes the cutter assembly 124 and the horizontal cutter tray 156, as shown in FIG. 3B.

In an example embodiment, the main body 304 is further configured to receive a media drive 312 that is configured to cause the print media 114 to traverse from the media roll 112 to a printer media output 314. When the direct thermal printer 300 executes a print job, the print head 110 may be directly press against the print media 114 to print content on the print media 114. Since the print media 114 is a thermal media, therefore, on application of heat (through the plurality of heating elements on the print head 110 is pressed against the print media 114) the content gets printed on the print media 114.

In an example embodiment, once a print media portion of the print media 114 is printed by the print head 110, the print media portion traverses downstream along the print media 114 towards the cutter assembly 124. In an example embodiment, the cutter assembly 124 may be an end operator installable for the printer 100 and used to cut print media portions at a desired length(s). The cutter assembly 124 may be equipped with a label taken sensor (not shown). The label taken sensor may be used to detect the print media 114 of each media roll 112 and/or ribbon roll 118 and ensures the media portions of the print media 114 will be at the correct position for printing operation.

Figure 6A:
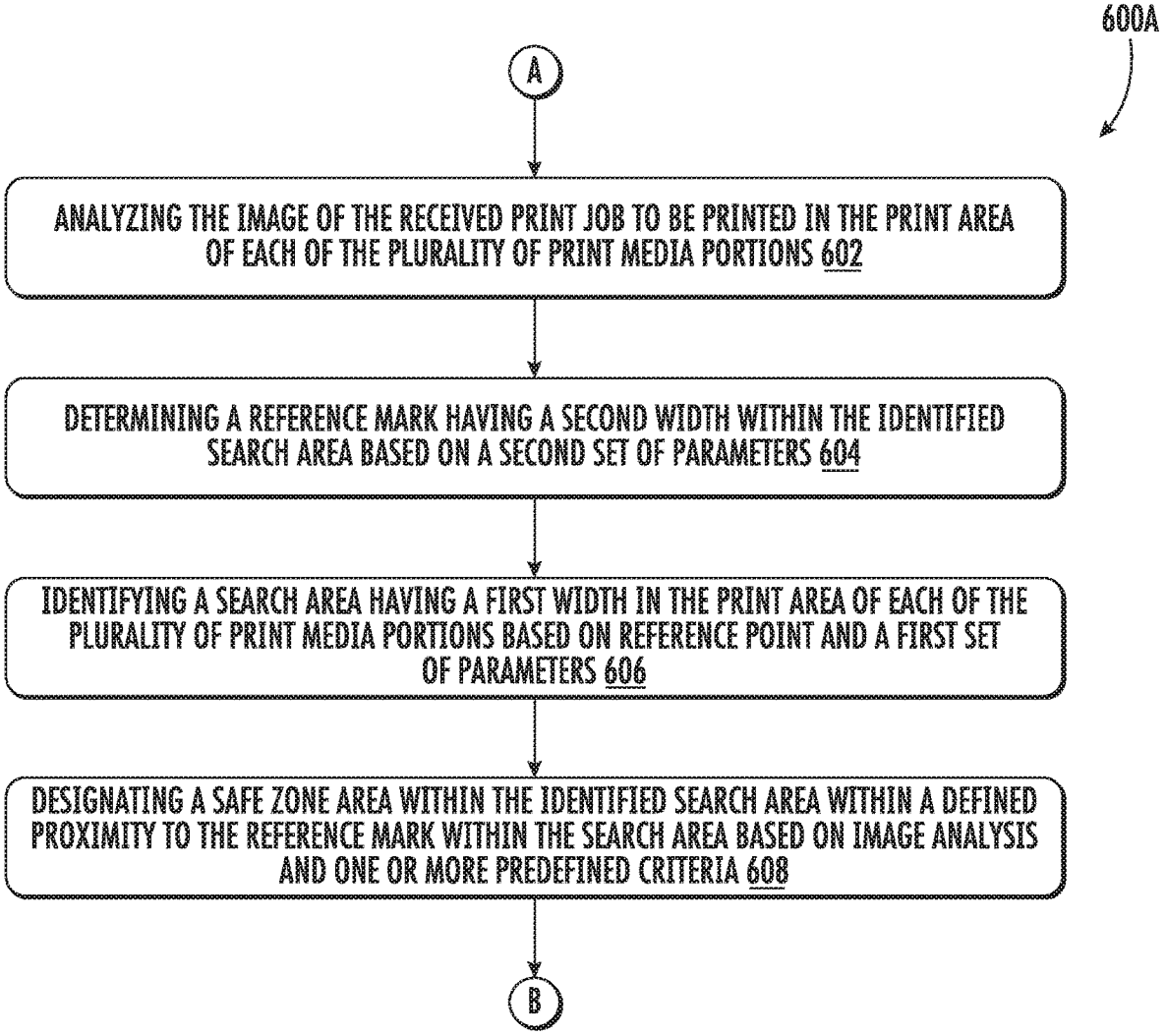
FIG. 6A illustrates a flowchart depicting a method for operating the printer in calibration mode, according to one or more embodiments of the present disclosure described herein.

In some embodiments, the direct thermal printer 300 is operated in a calibration mode, as described in FIG. 6A. In the calibration mode, the control system 208 in the direct thermal printer 300 may be configured to analyze an image of a received print job to be printed in a print area of each of the plurality of print media portions of the print media 114. Thereafter, the control system 208 may be configured to determine a reference mark and identify a search area having a first length in the print area of each of the plurality of print media portions based on the determined reference mark, and a set of parameters. The reference mark may be a mark in a print media portion when a cut point corresponding to a previous print media portion is under the cutter blade 128 of the cutter assembly 124 in the direct thermal printer 300. Finally, the control system 208 may designate a safe zone within the identified search area within a defined proximity to the reference mark within the search area based on one or more predefined criteria. Various instances of the set of parameters and the one or more predefined criteria are described in detail in FIG. 6A.

Once calibrated, the direct thermal printer 300 initiates a print job for a plurality of print media portions. The control system 208 may be configured to operate the direct thermal printer 300 in a first printing mode in an instance in which the designated safe zone is detected or in a second printing mode in an instance in which the designated safe zone is not detected.

In an example embodiment, in which the direct thermal printer 300 operates in the first printing mode, the control system 208 may be configured to cause a traversal of a print media portion in a downstream direction with respect to the print head 110 in the direct thermal printer 300 to perform a print operation. The control system 208 may be configured to cause the traversal of the current print media portion in the downstream direction with respect to the print head 110 to perform the print operation, while the previous printed print media portion traverses in the downstream direction with respect to the cutter blade 128, until the designated safe zone on the current print media portion is detected under the print head 110. Once the designated safe zone on the current print media portion is detected, the control system 208 may be configured to suspend the printing operation at a suspension point on the current print media portion and traverses further until the traversal of the second print media portion halts at a second point in the downstream direction.

The control system 208 causes a first movement of the print media 114 in one of the downstream direction or an upstream direction, based on a position of the designated safe zone with respect to the reference mark, until the cut point of the previous print media portion is detected under the cutter blade 128. The cutting operation is performed on the cut point of the previous print media portion using the cutter blade 128. The control system 208 may be configured to cause a second movement of the print media 114 in one of the downstream direction or the upstream direction, based on the position of the designated safe zone with respect to the reference mark, until the second point in the current print media portion is detected under the print head 110. The control system 208 may be configured to resume the printing operation from the second point on the current print media portion. Other embodiments are described in detail in FIGS. 7A and 7G.

Referring to FIG. 3B, the direct thermal printer 300 further includes the media sensor 202 and the control system 208. For the purpose of ongoing description, the various embodiments of the present disclosure have been described in view of the printer 100. However, the embodiments described herein are also applicable of the direct thermal printer 300, without departing from the scope of the disclosure.

Figure 4:
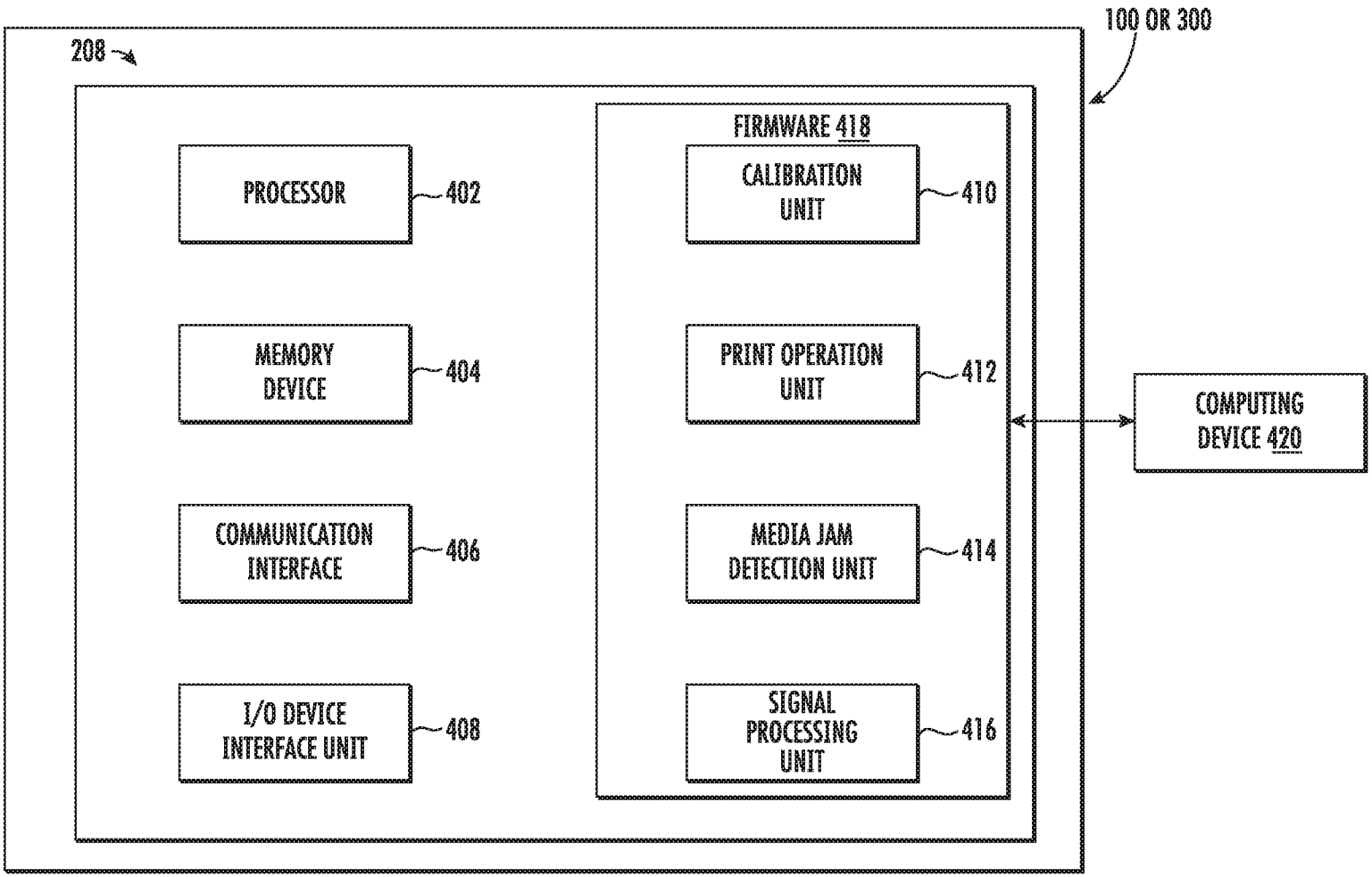
FIG. 4 illustrates a block diagram of a control system, according to one or more embodiments described herein.

FIG. 4. illustrates a block diagram of the control system 208, according to one or more embodiments described herein. In an example embodiment, the control system 208 includes a processor 402, a memory device 404, a communication interface 406, an input/output (I/O) device interface unit 408, a calibration unit 410, a print operation unit 412, a media jam detection unit 414, and a signal processing unit 416. In an example embodiment, the processor 402 may be communicatively coupled to each of the memory device 404, the communication interface 406, the I/O device interface unit 408, the calibration unit 410, the print operation unit 412, the media jam detection unit 414, and the signal processing unit 416.

The processor 402 may be embodied as a means including one or more microprocessors with accompanying digital signal processor(s), one or more processor(s) without an accompanying digital signal processor, one or more coprocessors, one or more multi-core processors, one or more controllers, processing circuitry, one or more computers, various other processing elements including integrated circuits such as, for example, an application specific integrated circuit (ASIC) or field programmable gate array (FPGA), or some combination thereof. Accordingly, although illustrated in FIG. 4 as a single processor, in an example embodiment, the processor 402 may include a plurality of processors and signal processing modules. The plurality of processors may be embodied on a single electronic device or may be distributed across a plurality of electronic devices collectively configured to function as the circuitry of the control system 208. The plurality of processors may be in operative communication with each other and may be collectively configured to perform one or more functionalities of the circuitry of the control system 208, as described herein. In an example embodiment, the processor 402 may be configured to execute instructions stored in the memory device 404 or otherwise accessible to the processor 402. These instructions, when executed by the processor 402, may cause the circuitry of the control system 208 to perform one or more of the functionalities, as described herein.

Whether configured by hardware, firmware/software methods, or by a combination thereof, the processor 402 may include an entity capable of performing operations according to embodiments of the present disclosure while configured accordingly. Thus, for example, when the processor 402 is embodied as an ASIC, FPGA or the like, the processor 402 may include specifically configured hardware for conducting one or more operations described herein. Alternatively, as another example, when the processor 402 is embodied as an executor of instructions, such as may be stored in the memory device 404, the instructions may specifically configure the processor 402 to perform one or more algorithms and operations described herein.

Thus, the processor 402 used herein may refer to a programmable microprocessor, microcomputer or multiple processor chip or chips that can be configured by software instructions (applications) to perform a variety of functions, including the functions of the various embodiments described above. In some devices, multiple processors may be provided dedicated to wireless communication functions and one processor dedicated to running other applications. Software applications may be stored in the internal memory before they are accessed and loaded into the processors. The processors may include internal memory sufficient to store the application software instructions. In many devices, the internal memory may be a volatile or nonvolatile memory, such as flash memory, or a mixture of both. The memory can also be located internal to another computing resource (e.g., enabling computer readable instructions to be downloaded over the Internet or another wired or wireless connection).

The memory device 404 may include suitable logic, circuitry, and/or interfaces that are adapted to store a set of instructions that is executable by the processor 402 to perform predetermined operations. Some of the commonly known memory implementations include, but are not limited to, a hard disk, random access memory, cache memory, read only memory (ROM), erasable programmable read-only memory (EPROM) & electrically erasable programmable read-only memory (EEPROM), flash memory, magnetic cassettes, magnetic tape, magnetic disk storage or other magnetic storage devices, a compact disc read only memory (CD-ROM), digital versatile disc read only memory (DVD-ROM), an optical disc, circuitry configured to store information, or some combination thereof. In an example embodiment, the memory device 404 may be integrated with the processor 402 on a single chip, without departing from the scope of the disclosure.

The communication interface 406 may correspond to a communication interface that may facilitate transmission and reception of messages and data to and from various devices. For example, the communication interface 406 is communicatively coupled with a computing device 420. Examples of the communication interface 406 may include, but are not limited to, an antenna, an Ethernet port, a USB port, a serial port, or any other port that can be adapted to receive and transmit data (e.g., via at least one wired and/or wireless protocol). The communication interface 406 transmits and receives data and/or messages in accordance with the various communication protocols, such as, I2C, TCP/IP, UDP, and 4G, 4G, or 4G communication protocols.

The I/O device interface unit 408 may include suitable logic and/or circuitry that may be configured to communicate with the one or more components of the printer 100, in accordance with one or more device communication protocols such as, but not limited to, I2C communication protocol, Serial Peripheral Interface (SPI) communication protocol, Serial communication protocol, Control Area Network (CAN) communication protocol, and 1-Wire® communication protocol. In an example embodiment, the I/O device interface unit 408 may communicate with the media sensor 202 and the electrical drives associated with the media hub 102, the ribbon drive assembly 106, and the ribbon take-up hub 108. For example, the I/O device interface unit 408 may receive the input signal from the media sensor 202. Further, for example, the I/O device interface unit 408 may actuate the first electrical drive associated with the media hub 102 to cause the print media 114 to traverse along the media path 116. Some examples of the I/O device interface unit 408 may include, but not limited to, a Data Acquisition (DAQ) card, an electrical drives driver circuit, and/or the like.

The calibration unit 410 may include suitable logic and/or circuitry for calibrating the printer 100, as is further described in conjunction with FIG. 6A. In an example embodiment, the calibration unit 410 may be configured to determine various parameters and criteria for the printer 100 based on data retrieved from the memory device 404. In an example embodiment, the calibration unit 410 may be configured to determine the set of parameters, that may include, but not limited to, at least a start parameter and a stop parameter for the print head 110 of the printer 100. The start parameter and the stop parameter may be based on at least one of a printing speed of the printer 100, a length of each of the plurality of print media portions (e.g., distance between the first cut point and the second cut point), a distance between a trailing edge of the first print media portion and a leading edge of the second print media portion, a type of print media 114, or print margins of each of the plurality of print media portions.

In some embodiments, the one or more predefined criteria correspond to one of an automatic selection or manual selection of an area within the identified search area. The automatic selection or the manual selection of the area may be based on a maximum empty space, one or more non-critical objects, or minimum count of one or more critical objects. In an example embodiment, the manual selection of the area may be based on a set of object preferences provided by an operator, wherein the set of object preferences are associated with the one or more non-critical objects and/or the one or more critical objects. Such selection may be performed automatically by the processor or manually by an operator such that printing defect in the safe zone is of least visual impact on print quality of the printing operation.

In an example embodiment, the one or more characteristics of the input signal may include a measure of an amplitude of the input signal and/or a measure of a frequency of the input signal. Further, the calibration unit 410 may be configured to store the one or more characteristics of the input signal, the first transmissivity/reflectivity threshold value and the second transmissivity/reflectivity threshold value in the memory device 404. The calibration unit 410 may be implemented using one or more technologies, such as, but not limited to, FPGA, ASIC, and the like.

Figure 7A:
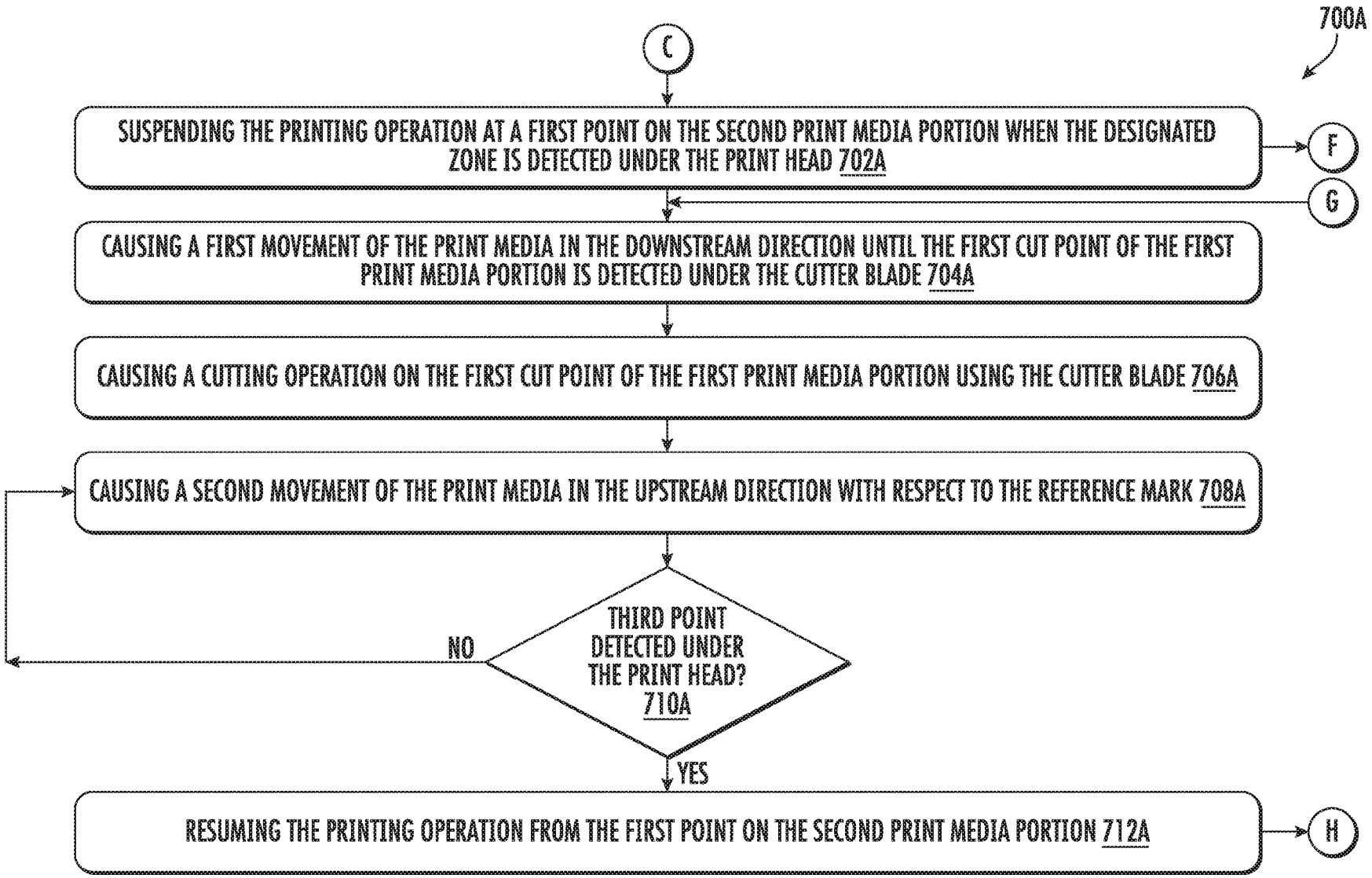
FIG. 7A, in conjunction with FIGS. 7B and 7C, illustrates a flowchart depicting a method for operating the printer in the first printing mode in an instance when a safe zone is detected before a reference mark, according to one or more embodiments of the present disclosure described herein.
Figure 7B:
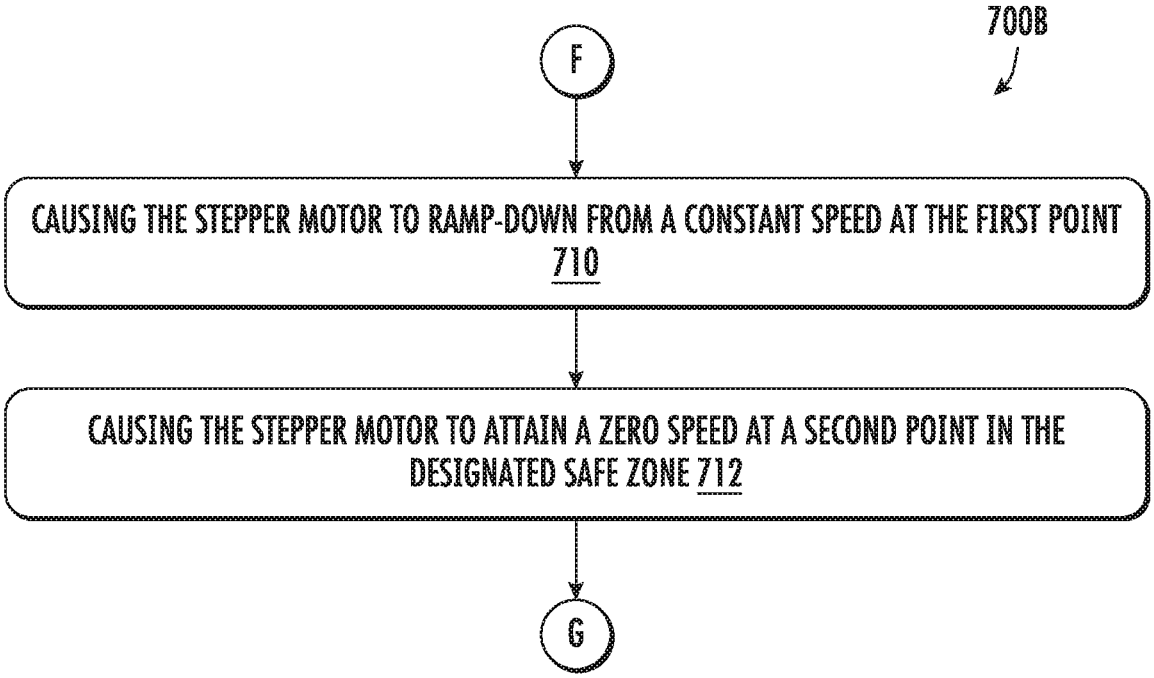
FIG. 7B illustrates a flowchart depicting a method for suspending a printing operation, according to one or more embodiments of the present disclosure described herein.
Figure 7C:
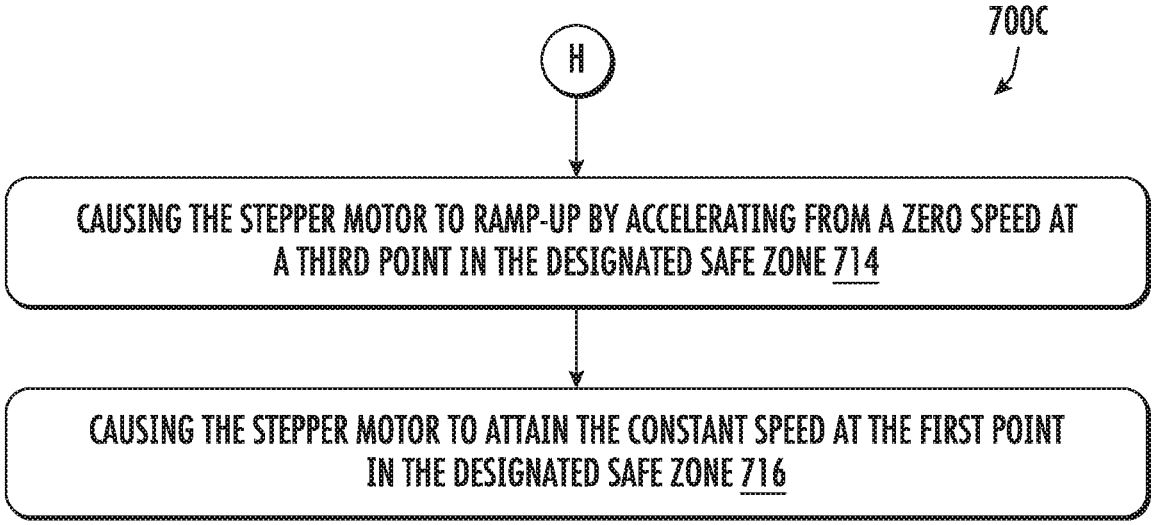
FIG. 7C illustrates a flowchart depicting a method for resuming a printing operation, according to one or more embodiments of the present disclosure described herein.
Figure 7D:
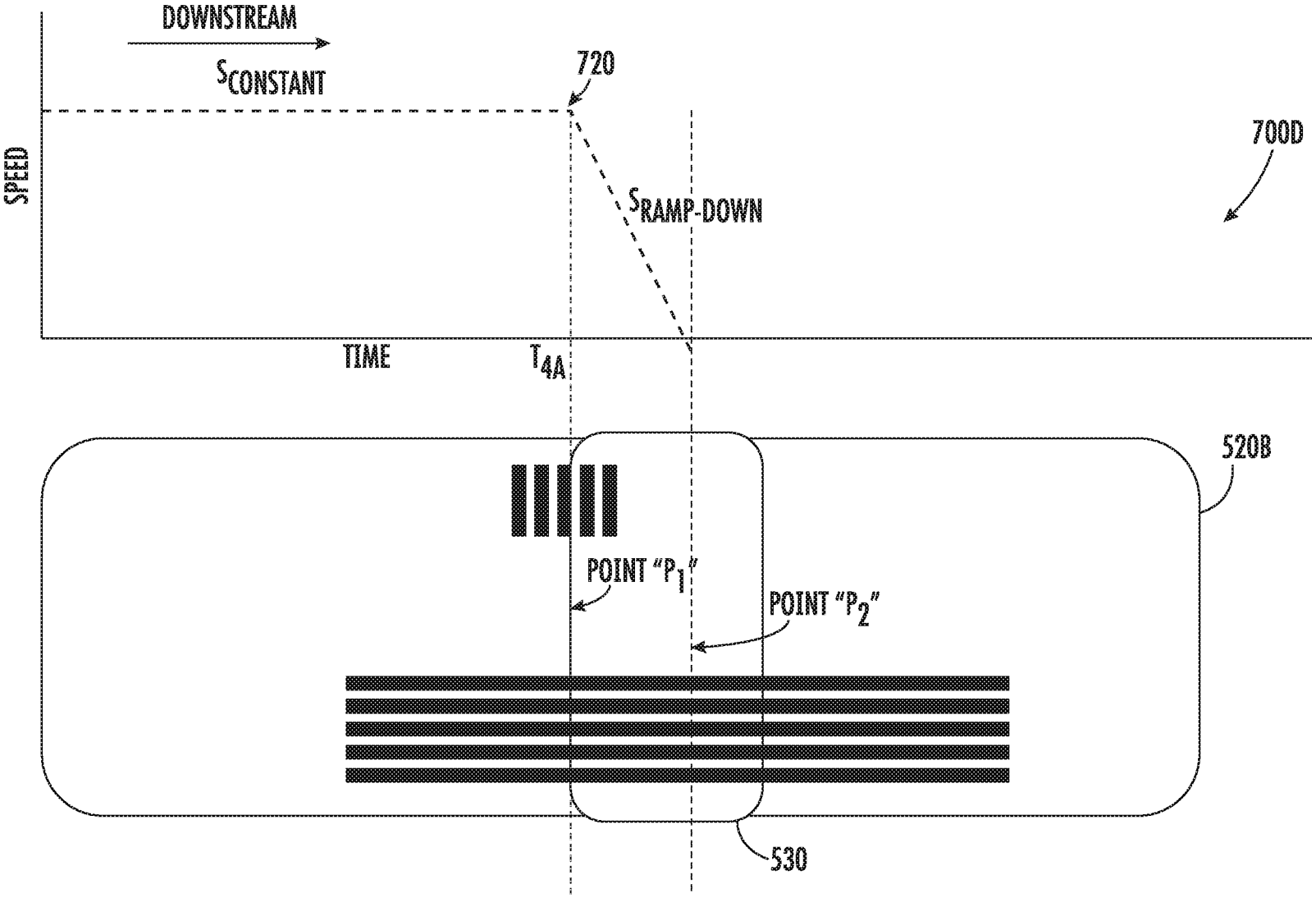
FIG. 7D illustrates a timing diagram of the printer suspending the printing operation, according to one or more embodiments of the present disclosure described herein.
Figure 7E:
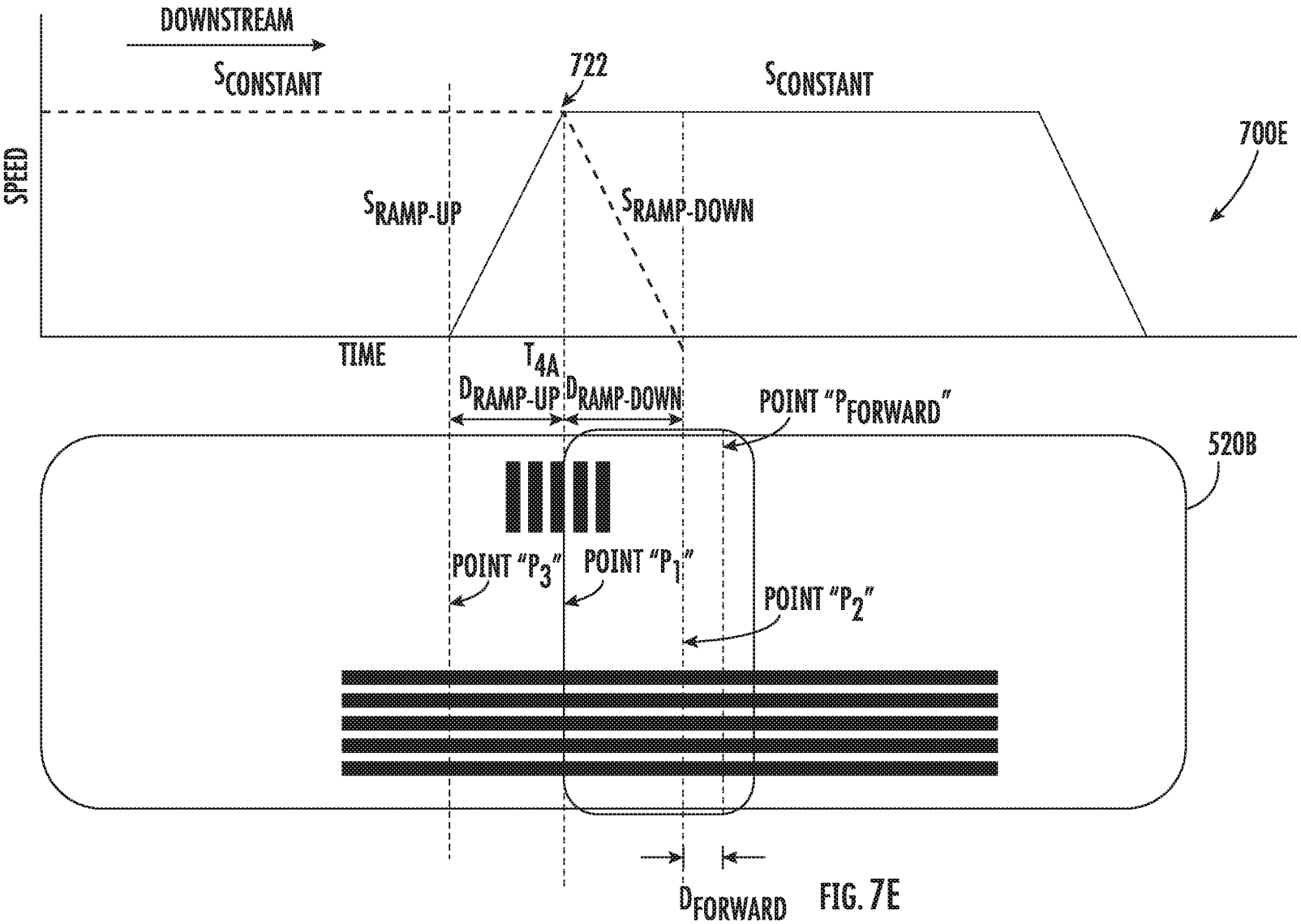
FIG. 7E, in conjunction with FIGS. 7A-7C, illustrates a timing diagram depicting an example printing operation in the first printing mode in an instance when the safe zone is detected before the reference mark and includes critical objects, according to one or more embodiments of the present disclosure described herein.
Figure 7E:
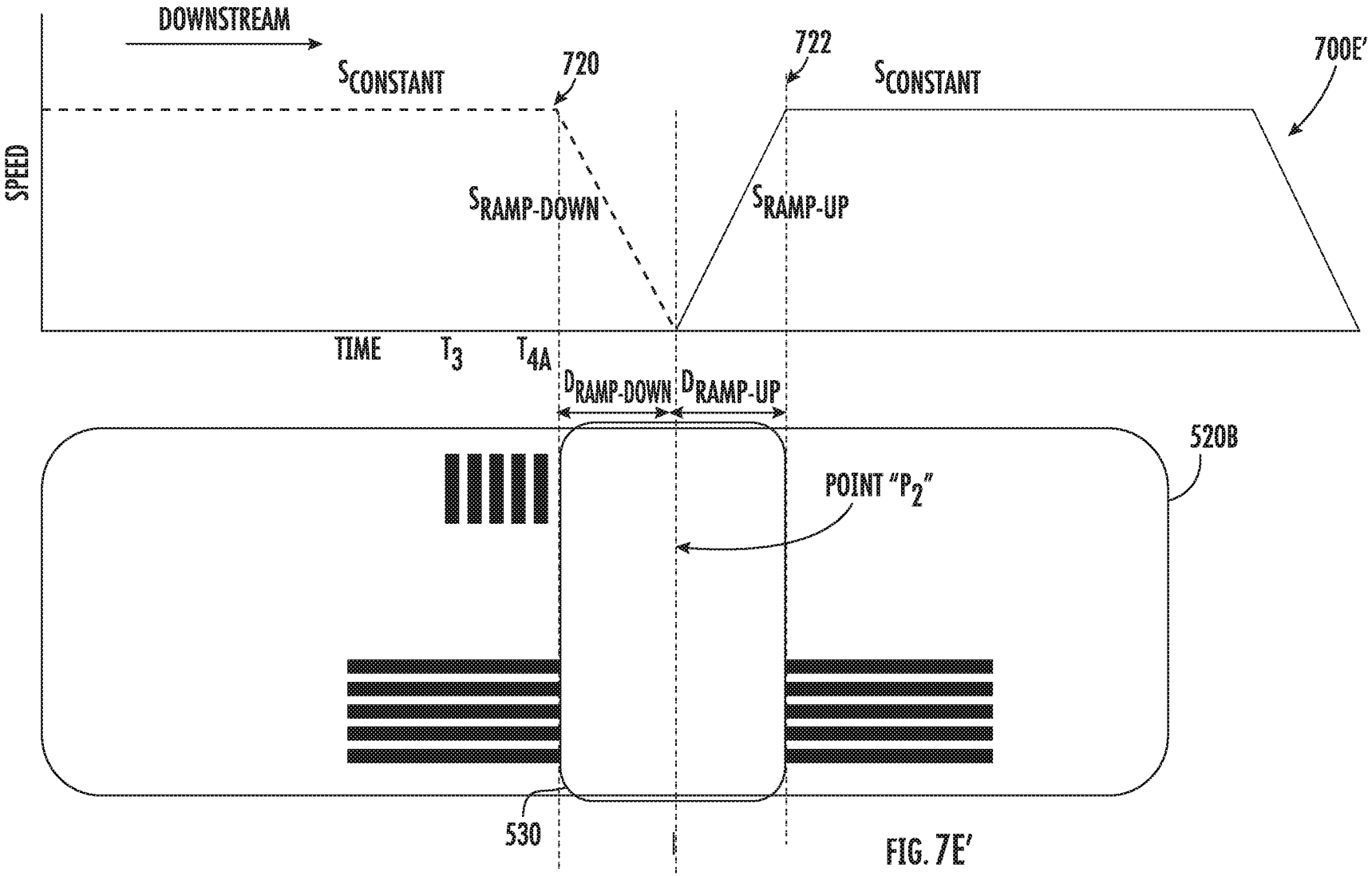
Figure 7F:
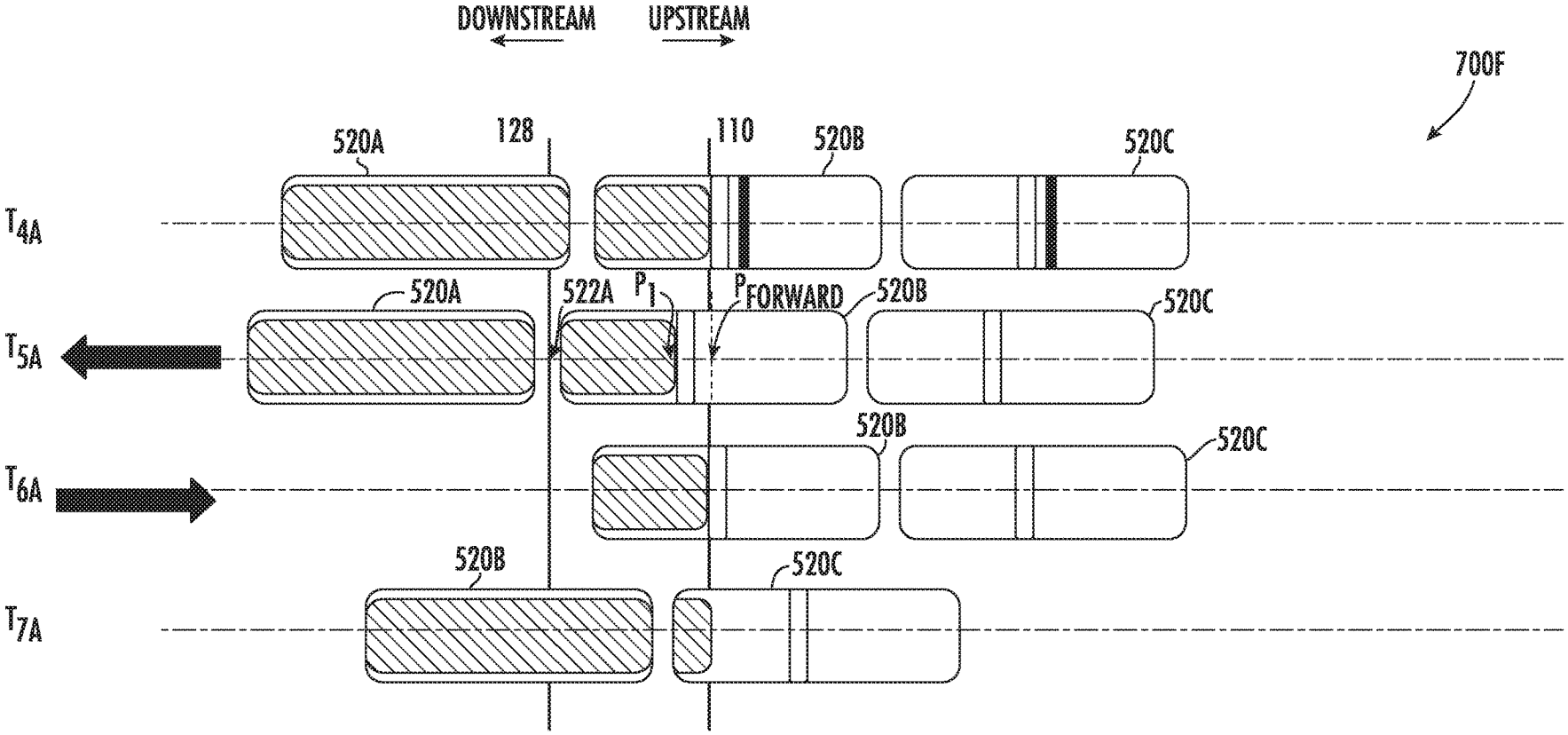
FIG. 7F, in conjunction with FIG. 5C, illustrates a state diagram depicting an example printing operation in the first printing mode in an instance when the safe zone is detected before the reference mark, according to one or more embodiments of the present disclosure described herein.
Figure 7G:
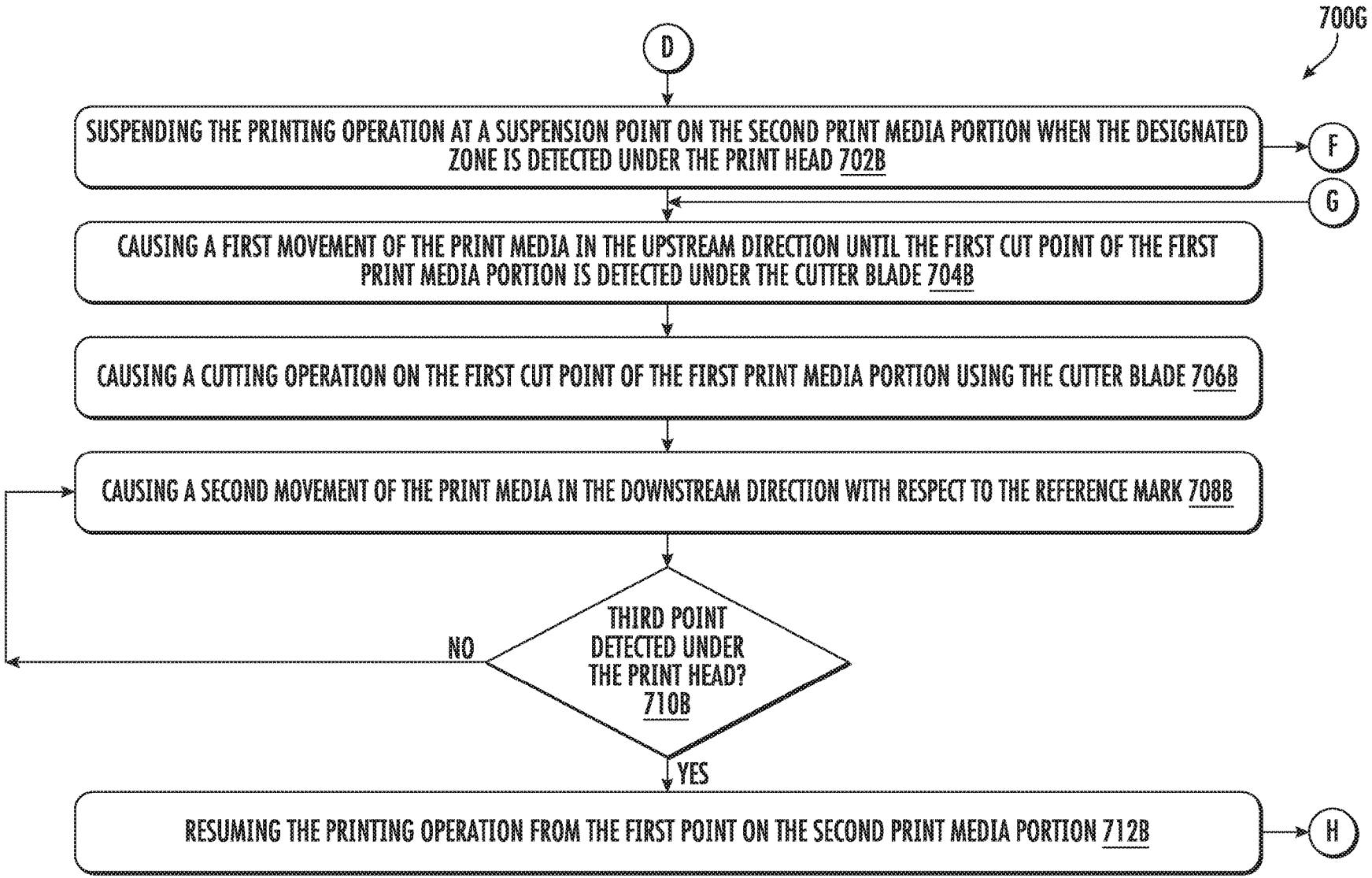
FIG. 7G, in conjunction with FIGS. 7A-7C, illustrates a flowchart depicting a method for operating the printer in the first printing mode in an instance when the safe zone is detected after the reference mark, according to one or more embodiments of the present disclosure described herein.

The print operation unit 412 may include suitable logic and/or circuitry that may cause the printer 100 to perform a print operation, as is further described in conjunction with FIGS. 7A and 7G. In an example embodiment, the print operation unit 412 may be configured to receive a print job from a computing device 420. Thereafter, the print operation unit 412 may be configured to perform the print operation based on the print job. For instance, during the print operation, the print operation unit 412 may be configured to instruct the I/O device interface unit 408 to actuate the electrical drives associated with the media hub 102, the ribbon drive assembly 106, and ribbon take-up hub 108, and the stepper motor 130 to cause the traversal of the print media 114 and the ribbon 120 along the media path 116 and the ribbon path 122, respectively. Further, the print operation unit 412 may be configured to control the operation of the print head 110 (for example energization of the one or more heating elements and the vertical translation of the print head 110) to perform the print operation. The print operation unit 412 may be implemented using one or more technologies, such as, but not limited to, FPGA, ASIC, and the like.

The media jam detection unit 414 may include suitable logic and/or circuitry for detecting a media jam condition. In an example embodiment, the media jam condition may correspond to a condition in which the print media 114 fails to traverse along the media path 116. In an example embodiment, the media jam detection unit 414 may be configured to detect the media jam condition based on the one or more characteristics of the input signal. The media jam detection unit 414 may be implemented using one or more technologies, such as, but not limited to, FPGA, ASIC, and the like.

The signal processing unit 416 may include suitable logic and/or circuitry for analyzing the input signal received from the media sensor 202. In an example embodiment, the signal processing unit 416 may include a digital signal processor that may be configured to analyze the input signal to determine the one or more characteristics of the input signal. Further, the signal processing unit 416 may utilize one or more signal processing techniques such as, but not limited to, Fast Fourier Transform (FFT), Discrete Fourier Transform (DFT), Discrete Time Fourier Transform (DTFT) to analyze the input signal. The media jam detection unit 414 may be implemented using one or more technologies, such as, but not limited to, FPGA, ASIC, and the like.

The firmware 418 may include suitable logic and/or source code that may be programmed to perform one or more tasks, such as calibration, printing instructions, media jam detection, and processing of signals. In some embodiments, as illustrated in FIG. 4, the firmware 418 may include the calibration unit 410, the print operation unit 412, the media jam detection unit 414, and the signal processing unit 416. The firmware 418 may be updated via an external device, such as a computing device 420, that is in wired or wireless communication with the firmware 418 within the printer 100 or the direct thermal printer 300 (e.g., via the communications interface 406). In some embodiments, the firmware 418 may be programmed to controls the energy profile for each thermal element in the print head 110 of the printer 100 or the direct thermal printer 300. Thus, the firmware 418 may assure that none of the thermal elements get too hot during the printing operation.

FIGS. 5A, 6A, 7A-7C, 7G, and 8A-8D illustrate example flowcharts of the operations performed by an apparatus, such as the printer 100 of FIGS. 1A-1E or the direct thermal printer 300 of FIGS. 3A-3C in accordance with example embodiments of the present invention. It will be understood that each block of the flowcharts, and combinations of blocks in the flowcharts, may be implemented by various means, such as hardware, firmware, one or more processors, circuitry and/or other devices associated with execution of software including one or more computer program instructions. For example, one or more of the procedures described above may be embodied by computer program instructions. In this regard, the computer program instructions which embody the procedures described above may be stored by a memory of an apparatus employing an embodiment of the present invention and executed by a processor in the apparatus. As will be appreciated, any such computer program instructions may be loaded onto a computer or other programmable apparatus (e.g., hardware) to produce a machine, such that the resulting computer or other programmable apparatus provides for implementation of the functions specified in the flowcharts' block(s). These computer program instructions may also be stored in a non-transitory computer-readable storage memory that may direct a computer or other programmable apparatus to function in a particular manner, such that the instructions stored in the computer-readable storage memory produce an article of manufacture, the execution of which implements the function specified in the flowcharts' block(s). The computer program instructions may also be loaded onto a computer or other programmable apparatus to cause a series of operations to be performed on the computer or other programmable apparatus to produce a computer-implemented process such that the instructions which execute on the computer or other programmable apparatus provide operations for implementing the functions specified in the flowcharts' block(s). As such, the operations of FIGS. 5A, 6A, 7A-7C, 7G, and 8A-8B, when executed, convert a computer or processing circuitry into a particular machine configured to perform an example embodiment of the present invention. Accordingly, the operations of FIGS. 5A, 6A, 7A-7C, 7G, and 8A-8B define an algorithm for configuring a computer or processor, to perform an example embodiment. In some cases, a general-purpose computer may be provided with an instance of the processor which performs the algorithm of FIGS. 5A, 6A, 7A-7C, 7G, and 8A-8B to transform the general-purpose computer into a particular machine configured to perform an example embodiment.

Accordingly, blocks of the flowchart support combinations of means for performing the specified functions and combinations of operations for performing the specified functions. It will also be understood that one or more blocks of the flowcharts', and combinations of blocks in the flowchart, can be implemented by special purpose hardware-based computer systems which perform the specified functions, or combinations of special purpose hardware and computer instructions.

Figure 5A:
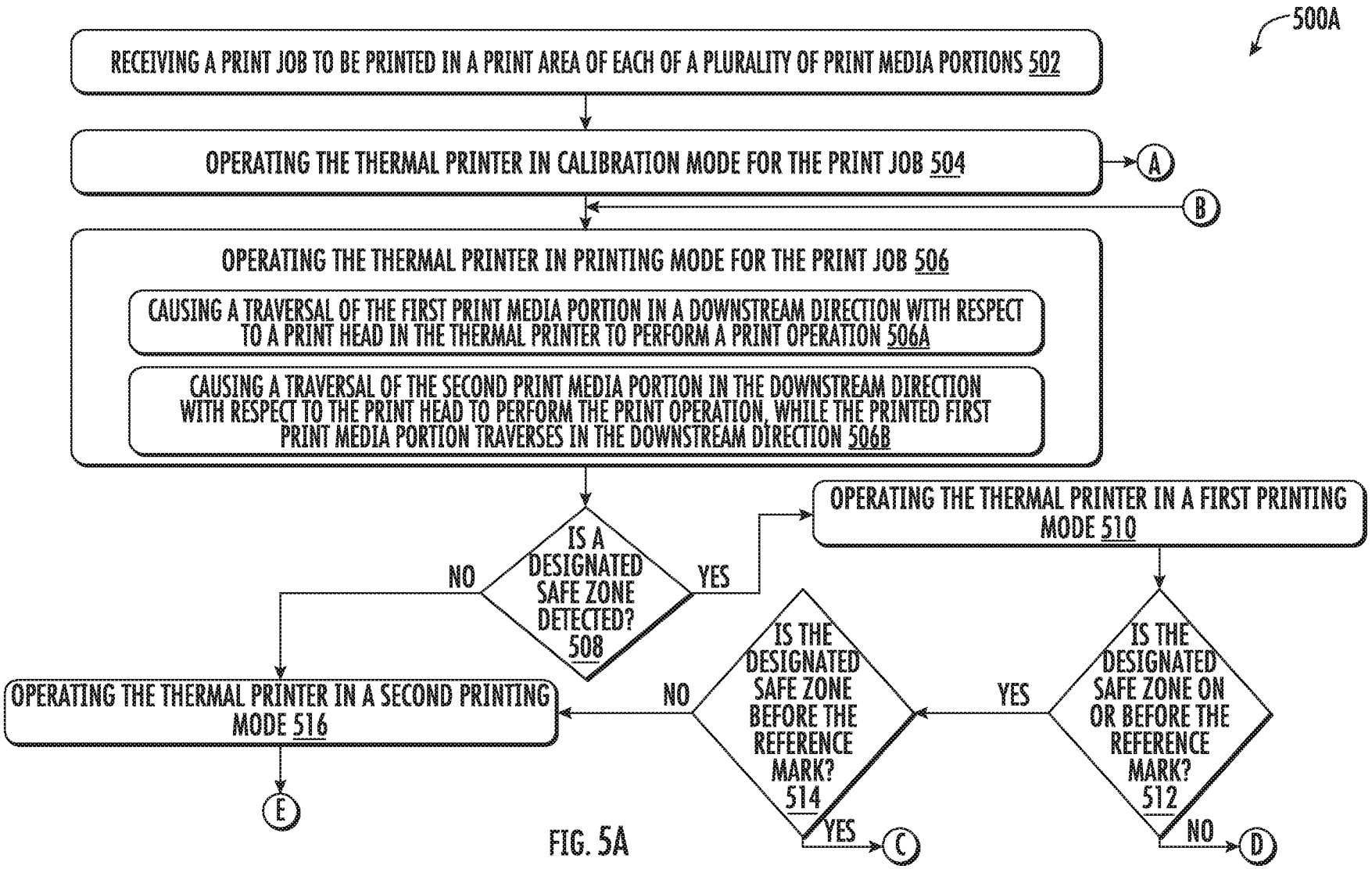
FIG. 5A illustrates a flowchart describing a schematic of various operational modes and printing modes of a printer, according to one or more embodiments of the present disclosure described herein.

FIG. 5A illustrates a flowchart 500A describing a schematic of various operational modes of a printer, according to one or more embodiments of the present disclosure described herein. FIG. 5A is described in conjunction with FIGS. 5B and 5C. In this regard, in an example embodiment, various operations illustrated in reference to FIG. 5A may be performed by, with the assistance of, and/or under the control of the circuitry (e.g., control system 208) of the printer 100 or the direct thermal printer 300. Further, FIG. 5A is described in conjunction with FIGS. 6B and 6C that illustrate various instances of an example print area portion that is calibrated in accordance with the method depicted in the flowchart of FIG. 6A, according to one or more embodiments of the present disclosure described herein.

Further FIG. 5A is described in conjunction with FIGS. 7A-7I. Briefly, FIG. 7A, in conjunction with FIGS. 7B and 7C, illustrates a flowchart depicting a method for operating the printer in the first printing mode in an instance when a safe zone is detected before a reference mark, FIG. 7B illustrates a flowchart depicting a method for suspending a printing operation, FIG. 7C illustrates a flowchart depicting a method for resuming a printing operation, FIG. 7D illustrates a timing diagram of the printer suspending the printing operation, FIG. 7E, in conjunction with FIGS. 7A-7C, illustrates a timing diagram depicting an example printing operation in the first printing mode in an instance when the safe zone is detected before the reference mark and includes critical objects, FIG. 7E', in conjunction with FIGS. 7A-7C, illustrates a timing diagram depicting an example printing operation in the first printing mode in an instance when the safe zone is either empty or includes non-critical objects, FIG. 7F, in conjunction with FIG. 5C, illustrates a state diagram depicting an example printing operation in the first printing mode in an instance when the safe zone is detected before the reference mark, FIG. 7G, in conjunction with FIGS. 7A-7C, illustrates a flowchart depicting a method for operating the printer in the first printing mode in an instance when the safe zone is detected after the reference mark, and FIG. 7I, in conjunction with FIG. 5C, illustrates a state diagram depicting an example printing operation in the first printing mode in an instance when the safe zone is detected after the reference mark, according to one or more embodiments of the present disclosure described herein.

The foregoing method descriptions and operations described in the flowchart 500A illustrated in FIG. 5A is provided merely as illustrative example and is not intended to require or imply that the steps of the various embodiments must be performed in the order presented. As will be appreciated by one of skill in the art, the order of steps in these embodiments may be performed in different orders.

Turning to operation 502, the printer 100 or the direct thermal printer 300 may include means, such as the I/O device interface unit 408, for receiving a print job to be printed in a print area of each of a plurality of print media portions. In some embodiments, the I/O device interface unit 408 of the printer 100 or the direct thermal printer 300 may be configured to receive the print job from an external device, via a wired or a wireless communication interface 406, in accordance with one or more device communication protocols such as, but not limited to, I2C communication protocol, Serial Peripheral Interface (SPI) communication protocol, Serial communication protocol, Control Area Network (CAN) communication protocol, and 1-Wire® communication protocol.

Turning to operation 504, the printer 100 or the direct thermal printer 300 may include means, such as the processor 402 and the calibration unit 410 in the firmware 418, for operating the thermal printer in calibration mode for the received print job, which is further described with respect to FIG. 6A. In some embodiments, the operator of the printer 100 or the direct thermal printer 300 provides an input (for operating the printer 100 or the direct thermal printer 300 in the calibration mode) by pressing a button (not shown) provided on the printer 100 or the direct thermal printer 300 in a predetermined pattern. In an example embodiment, the predetermined pattern may correspond to pressing the button in a predetermined sequence or for a predetermined time duration. For example, if the operator keeps the button pressed for 10 seconds, the processor 402 may determine that the printer 100 is to be operated in the calibration mode. In an example embodiment, the predetermined pattern is pre-configured during manufacturing of the printer 100. In another example embodiment, the predetermined pattern may be configured by the operator through one or more commands applicable for the type of the printer 100 or the direct thermal printer 300.

In an example embodiment, the received print job may correspond to an image to be printed on the print media 114. The print media 114 that may correspond to media that may be loaded in the printer 100 or the direct thermal printer 300 in form of the media roll 112. The print media 114 may be divided into a plurality of print media portions, such as labels or tickets, through perforations defined along a width of the print media 114. Alternatively, the print media 114 may be divided into a plurality of portions through one or more marks (e.g., limiting marks or cut points) that are defined at a predetermined distance from each other, along the length of the print media 114. In some example embodiments, a contiguous stretch of the print media 114, between two consecutive marks or two consecutive perforations, corresponds to a portion of the print media 114. Thus, according to one or more embodiments of the present disclosure described herein, the same image (print job) and/or approximately the same image may be required to be printed on each of the plurality of print media portions. In an example embodiment, the images may be approximately the same in that the images contain the same content in the same layout, but a detail of the content may be different. For example, if the image is an airline ticket, the image may be approximately the same, but two different tickets may have different passenger names, different seat assignments, etc. However, the images are approximately the same as the content and layout of the content of each ticket is the same, even though the details of the airline ticket may be different.

Figure 5B:
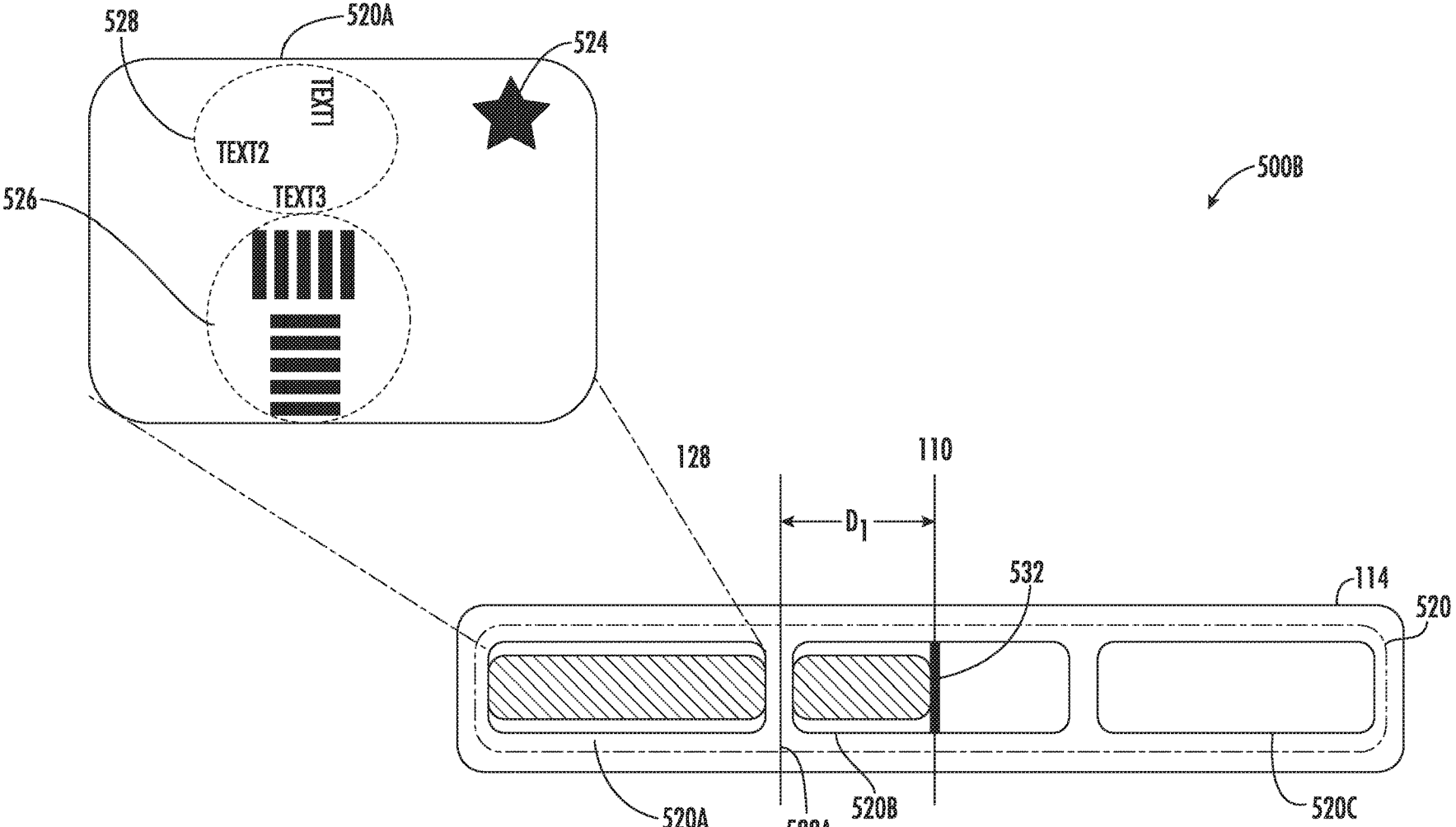
FIG. 5B illustrates an example print area portion of a print media, according to one or more embodiments of the present disclosure described herein.
Figure 5C:
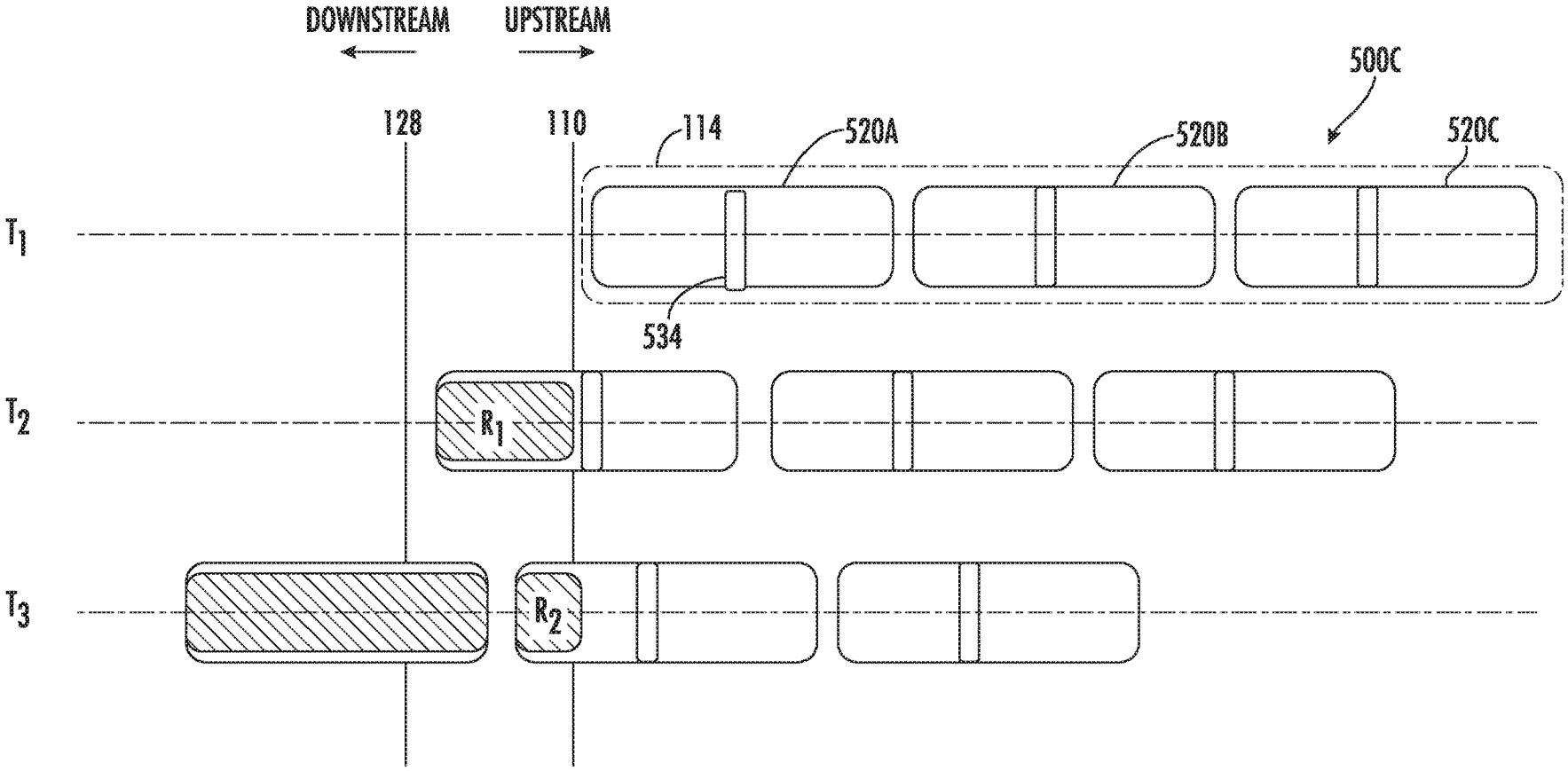
FIG. 5C illustrates a state diagram of the printer operating in a first printing mode, according to one or more embodiments of the present disclosure described herein.

In an example embodiment, FIG. 5B illustrates an example print media portion and the image to be printed thereon, according to one or more embodiments of the present disclosure described herein. FIG. 5B illustrates an instance of a print media portion, such as the first print media portion 520A, of a plurality of print media portions 520 on which an image including a plurality of objects may be printed. The plurality of objects may include, but not limited to, legends/images/icons 524, barcodes 526, text portions 528, and/or the like. Amongst the plurality of objects, some objects may be critical objects, such as the horizontal barcodes (e.g., the barcode extends at least partially across the length of the print media portion), and other objects may be non-critical objects, such as vertical barcodes (e.g., the barcode extends at least partially across the width of the print media portion) or the legends/images/icons 524. In an example embodiment, the processor 402 may be configured to automatically identify the critical objects for the calibration. In another example embodiment, the operator may select the critical objects for the calibration. Critical objects may be such objects for which the print quality is utmost significant parameter. Any defect in the printing quality of such critical objects may result in loss of information. On the other hand, non-critical objects may be such objects for which the print quality is not such a significant parameter. Any defect in the printing quality may not result in loss of information. A visual defect in such non-critical objects may be acceptable. The identification of such critical and non-critical objects is described in detail in FIG. 6A.

Turning to FIG. 6A that illustrates a flowchart 600A depicting a method for operating the printer in calibration mode, according to one or more embodiments of the present disclosure described herein. In this regard, in an example embodiment, various operations illustrated in reference to FIG. 5A may be performed by, with the assistance of, and/or under the control of the circuitry of the printer 100 or the direct thermal printer 300. The foregoing method descriptions and operations described in the flowchart 600A illustrated in FIG. 6A is provided merely as an illustrative example and is not intended to require or imply that the steps of the various embodiments must be performed in the order presented. As will be appreciated by one of skill in the art, the order of steps in these embodiments may be performed in different orders.

Turning to operation 602 in the flowchart 600A, the printer 100 or the direct thermal printer 300 may include means, such as the processor 402 and the calibration unit 410 in the firmware 418, for analyzing the image of the received print job to be printed in the print area of each of the plurality of print media portions 520, as shown in FIG. 5B. The analysis may include identifying various objects in the image based on one or more image recognition techniques in order to categorize the identified objects, such as, but not limited to, legends/images/icons 524, barcodes 526, and text portions 528, under various groups, such as, but not limited to, graphics/icons/images, indicia, and text. In an example embodiment, the criticality levels for each of such objects may be pre-stored in the memory device 404. In other embodiment, the criticality level of each object may be determined automatically by the processor 402 based on various characteristics associated with the objects. For example, a horizontal barcode object may be a more critical object than a vertical barcode. Or an image may be a more critical object than a textual content. The processor 402 may associate a criticality level with each identified object beforehand and thus determine the objects with the highest criticality level upon the analysis of the image. In alternate embodiment, the operator may select critical objects by means of, such as the I/O device interface unit 408. Such a selection of one or more critical objects may override the one or more critical objects identified by the processor 402.

Turning to operation 604, the printer 100 or the direct thermal printer 300 may include means, such as the processor 402 and the calibration unit 410 in the firmware 418, for determining a reference mark 532 based on, for example, but not limited to, at least one of the defined distance between the cutter blade 128 of the cutter assembly 124 and the print head 110 of a print head assembly. For example, the calibration unit 410 may determine the reference mark 532 in the print media portion, i.e. the second print media portion 520B, when a first cut point 522A corresponding to the previous print media portion, i.e. the first print media portion 520A, is under the cutter blade 128 of the cutter assembly 124 in the printer 100 or the direct thermal printer 300. In an example embodiment, as shown in FIG. 5B, the relative distance of the print head 110 with respect to the cutter blade 128 is a pre-defined distance "$D_1$".

Turning to operation 606, the printer 100 or the direct thermal printer 300 may include means, such as the processor 402 and the calibration unit 410 in the firmware 418, for identifying a search area 530 having a first length "$L_1$" in the print area of each of the plurality of print media portions 520 based on the determined reference mark 532 and a set of parameters. For example, in an example embodiment, based on the determined reference mark 532, the calibration unit 410 in the firmware 418 may be configured to determine the search area 530 such that the determined reference mark 532 is at the center of the search area 530. Further, the identification of the search area 530 may be based on the set of parameters. In various embodiments, the set of parameters, may include, but not limited to, at least a start parameter and a stop parameter for the print head 110 of the printer 100. The start and stop parameters may be retrieved from the memory device 404. The start parameter and the stop parameter may be further based on at least one of a printing speed of the printer 100, a length of each of the plurality of print media portions 520 (e.g., distance between a first cutting point and the second cutting point), a distance between a trailing edge of a first print media portion and a leading edge of a second print media portion (e.g., length of a gap between the first print media portion and the second print media portion), a type of the print media 114, or print margins of each of the plurality of print media portions 520. The first length "$L_1$" of the identified search area 530 may be determined by the processor 402 and/or the calibration unit 410 based on the set of parameters, as described above. For example, the printer 100 with a print speed, such as "$S_1$", may have a different length of the search area 530 as compared to another printer with a lesser print speed, such as "$S_2$". Or the printer 100 with a first type of print media, such as labels, may have a different length of the search area 530 as compared to another type of print media, such as tickets.

Turning to operation 608, the printer 100 or the direct thermal printer 300 may include means, such as the processor 402 and the calibration unit 410 in the firmware 418, for designating a safe zone 534 having a second length "$L_2$" within the identified search area 530 based on the image analysis and one or more predefined criteria. In an example embodiment, the second length "$L_2$" may correspond to a size of at least a ramp-up distance and ramp-down distance of the stepper motor 130 of the printer 100 or the direct thermal printer 300. In an example embodiment, the second length "$L_2$" of the safe zone 534 may be based on the image analysis of the print job. For example, an area within the search area 530 having either no objects or only non-critical objects, based on the information including criticality level of each object, may be a potential candidate for the safe zone 534. In another embodiment, the second length "$L_2$" of the safe zone 534 may be based on the predefined criteria.

In an example embodiment, the one or more predefined criteria may correspond to one of an automatic selection or manual selection of the safe zone 534 within the identified search area 530. The automatic selection or the manual selection of the safe zone 534 may be based on a maximum empty space, one or more non-critical objects, or minimum count of one or more critical objects. The manual selection of the safe zone 534 may be further based on a set of object preferences provided by the operator. The set of object preferences may be associated with the one or more non-critical objects and/or the one or more critical objects. For example, the operator may prefer a vertical barcode over a horizontal barcode to be included in the safe zone 534. Such preference may be against the automatic selection of a non-critical object. In such cases, the preference of the operator may override the automatic selection for designating the safe zone 534.

In an example embodiment, the safe zone 534 may be within a defined proximity to the reference mark 532 within the search area 530.

Figure 6B:
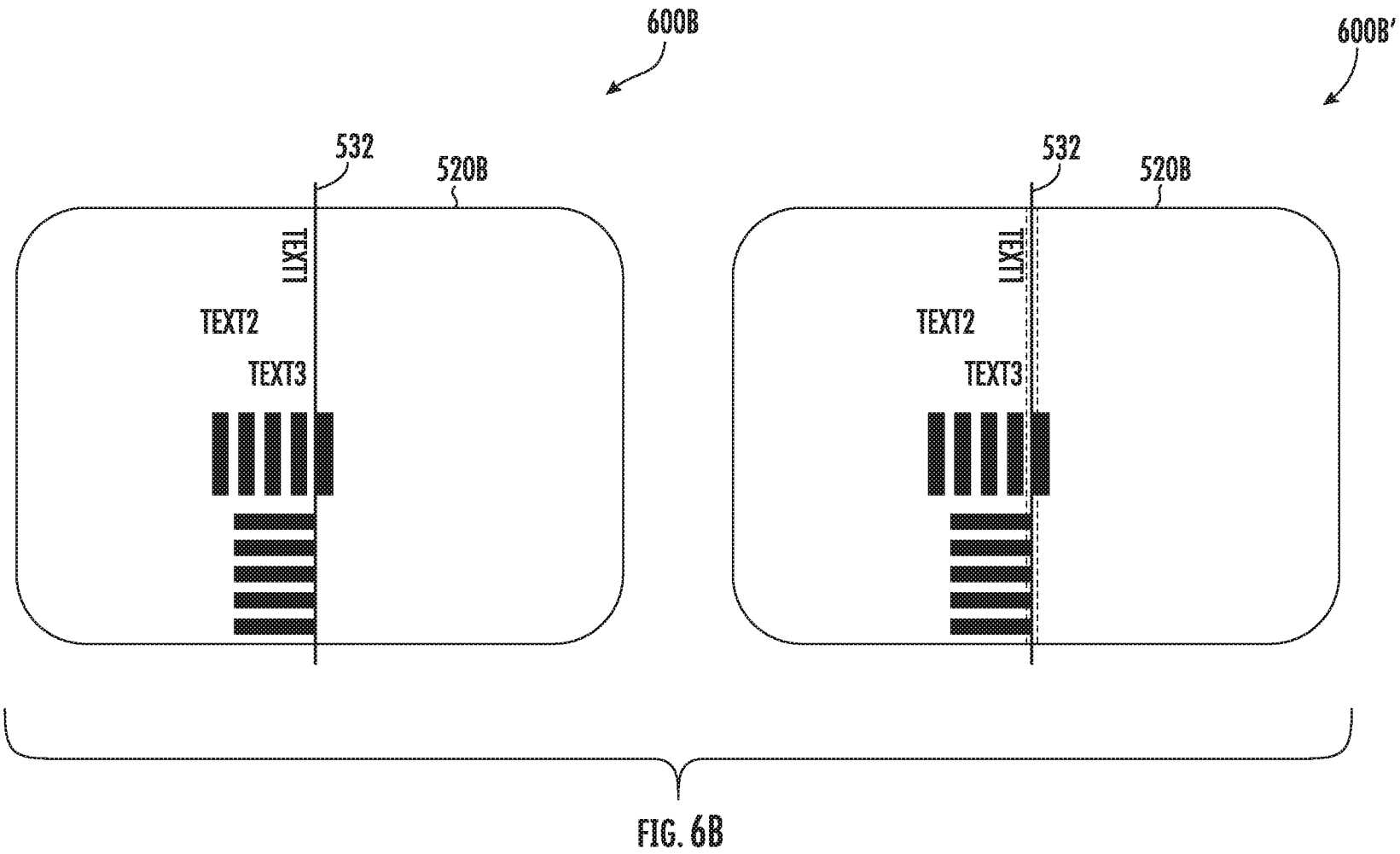
FIGS. 6B and 6C illustrate various instances of an example print area portion of the print media that is calibrated, in accordance with the method depicted in the flowchart of FIG. 6A, according to one or more embodiments of the present disclosure described herein.

In an example embodiment, as shown in illustration 600B in FIG. 6B, the processor 402 and the calibration unit 410 may only determine the reference mark 532. In another example embodiment, as shown in illustration 600B' in FIG. 6B, the processor 402 and the calibration unit 410 may determine that the safe zone 534 is at the reference mark 532, illustrated as a dotted area. In another example embodiment, as shown in illustration 600C in FIG. 6C, the processor 402 and the calibration unit 410 may determine that the safe zone 534 is positioned before the reference mark 532 in the search area 530. In yet another example embodiment, as shown in illustration 600C' in FIG. 6C, the processor 402 and the calibration unit 410 may determine that the safe zone 534 is positioned after the reference mark 532 in the search area 530.

Figure 6C:
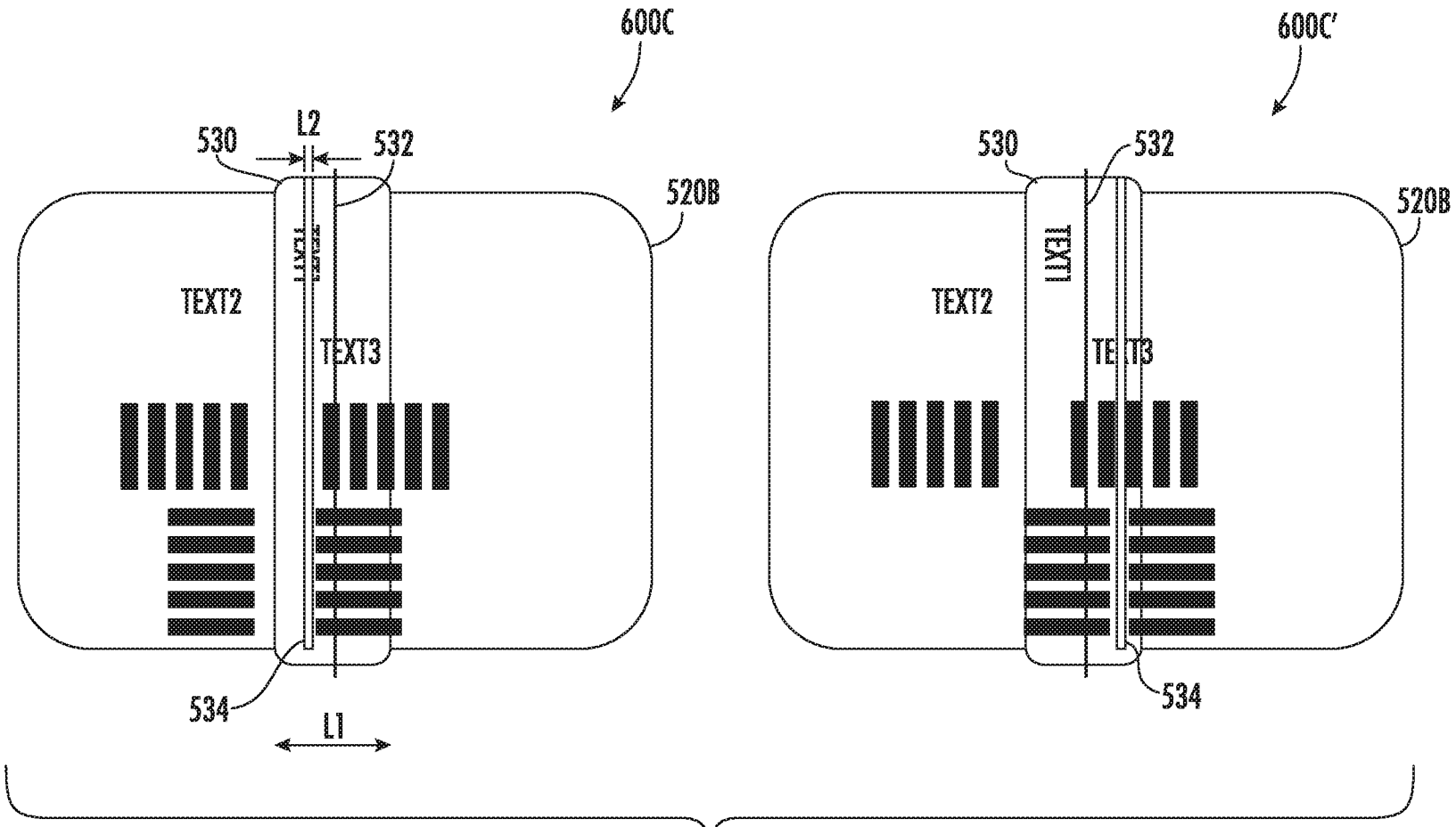

Once the search area 530 with first length "$L_1$", the reference mark 532, and the designated safe zone 534 with second length "$L_2$" are identified, as shown in FIGS. 6B and 6C, the printer 100 or the direct thermal printer 300 may be declared as calibrated. In an example embodiment, the calibration unit 410 may be configured to store calibration information, such as the search area 530, the reference mark 532, and the designated safe zone 534 in the memory device 404. Control returns from operation 608 in FIG. 6A to operation 506 of the flowchart 500A in FIG. 5A.

Turning back to operation 506 in FIG. 5A, the printer 100 or the direct thermal printer 300 may include means, such as the processor 402 and the print operation unit 412 in the firmware 418, to initiate operating the printer 100 or the direct thermal printer 300 in the printing mode for the received print job. The processor 402 may be configured to determine whether a print command (to perform the print operation) is received. Upon receiving the print command to execute the print job, the processor and the print operation unit 412, in conjunction with the memory device 404 storing the various quantities stored by the calibration unit 410, may be configured to initiate the operation of the printer in the printing mode.

The processor 402 and the print operation unit 412 may be configured to cause the traversal of the print media 114 along the media path 116 to provide the print media 114 to the print head 110. In an example embodiment, to cause the print media 114 to traverse along the media path 116, the processor 402 and the print operation unit 412 in the printer 100 may cause the stepper motor 130 to start which in turn actuates the first electrical drive (associated with the media hub 102) through the I/O device interface unit 408. On actuation, the first electrical drive causes the media hub 102 to rotate, which in turn causes the media roll 112 to supply the print media 114 on the media path 116. The processor 402 and the print operation unit 412 may further cause the second electrical drive (associated with the ribbon drive assembly 106) to actuate through the I/O device interface unit 408. On actuation, the second electrical drive causes the ribbon drive assembly 106 to rotate, which in turn causes the ribbon roll to rotate that causes the ribbon roll 118 to supply the ribbon 120 along the ribbon path 122. Along the ribbon path 122, the ribbon 120 traverses from the ribbon roll 118 to the print head 110 and further to the ribbon take-up hub 108. The processor 402 and the print operation unit 412 may further cause the third electrical drive to actuate that may be configured to further actuate the ribbon take-up hub 108. On actuation, the ribbon take-up hub 108 pulls the ribbon 120 from the ribbon roll 118. In such embodiment, the second electrical drive and the third electrical drive may operate in synchronization such that an amount of the ribbon 120 released by the ribbon roll 118 (due to actuation of the second electrical drive) is equal to the amount of the ribbon 120 received by the ribbon take-up hub 108. In an alternate embodiment, the processor 402 and the print operation unit 412 may also actuate the media drive 312 (FIG. 3C) in the direct thermal printer 300, thereby controlling the traversal of the print media 114 in the downstream or upstream direction.

Turning to operation 506A, the printer 100 or the direct thermal printer 300 may include means, such as the processor 402 and the print operation unit 412 in the firmware 418, for causing a traversal of the first print media portion 520A in a downstream direction with respect to the print head 110 in the printer 100 or the direct thermal printer 300 to perform the print operation. The processor 402 and the print operation unit 412 may cause the first, second, third electrical drives, and/or the media drive 312 to actuate the corresponding assemblies for the traversal of the print media 114. As the print media 114 traverses in the downstream direction, the print operation unit 412 performs the print operation (e.g., via print head 110) on the first print media portion 520A of the plurality of the print media portions 520. Once the print operation unit 412 completes the print operation on the first print media portion 520A, the traversal of the print media 114 continues, and the first print media portion 520A continues traversing past the print head 110 towards the cutter blade 128.

For example, referring to the state diagram 500C in FIG. 5C, at timestamp "$T_1$", the traversal of the print media 114 including the plurality of print media portions 502 starts. Each of the plurality of print media portions 502 are calibrated to indicate at least the corresponding safe zone 534. The print operation unit 412 may cause the burn line in the print head 110 to start performing the print operation on the first print media portion 520A.

At timestamp "$T_2$", the burn line in the print head 110 may complete the printing operation of a region "$R_1$" of the first print media portion 520A, indicated by the shaded region, and the first print media portion 520A continues traversing in the downstream direction.

It may be noted that for the first print media portion 520A, the processor 402 and the print operation unit 412 may not detect the designated safe zone 534 as an exception. In other words, the burn line in the print head 110 may normally print the first print media portion 520A without any suspension or resumption of the printing operation. Once the printing operation on the first print media portion 520A is completed, the print media 114 continues traversing, and the printing operation is initiated on the second print media portion 520B. Now the processor 402 may communicate a signal to the media sensor 202 or other such means, based on which the media sensor 202 is enabled and may be configured to detect the designated safe zone 534 in the forthcoming print media portions.

Turning to operation 506B, the printer 100 or the direct thermal printer 300 may include means, such as the processor 402 and the print operation unit 412 in the firmware 418, for causing a traversal of the second print media portion 520B in the downstream direction with respect to the print head 110 that performs the print operation, while the printed first print media portion 520A traverses in the downstream direction with respect to the cutter blade 128 positioned next to the print head 110 within a defined distance "$D_1$" in the printer 100 or the direct thermal printer 300.

For example, referring to the state diagram 500C in FIG. 5C, at timestamp "$T_3$", the burn line in the print head 110 has completed the printing operation of the first print media portion 520A. The first print media portion 520A continues to traversal in the downstream direction and starts moving past the cutter blade 128. Meanwhile, the print head 110 may start the printing operation of the second print media portion 520B, as indicated by the region "$R_2$" at timestamp "$T_3$".

Turning to operation 508, the printer 100 or the direct thermal printer 300 may include means, such as the processor 402 and the media sensor 202 in the firmware 418, for determining whether the designated safe zone 534 is detected, based on the calibration information retrieved from the memory device 404. The calibration information may provide the position of the safe zone 534 designated by the calibration unit 410. Accordingly, the media sensor 202 may detect the designated safe zone 534 in the second print media portion 520B.

In some embodiments, the position of the designated safe zone 534 in the second print media portion 520B may not be detected by media sensor 202. For example, as shown in illustration 600B in FIG. 6B, the example second print media portion 520B is associated with only reference mark 532 and no designated safe zone 534. In such embodiments, in which the designated safe zone 534 in the second print media portion 520B may not be detected by the processor 402 and the media sensor 202, the control turns to operation 516.

In some embodiments, the position of the designated safe zone 534 in the second print media portion 520B may be detected by media sensor 202, however the designated safe zone 534 overlaps with the reference mark 532, as shown in illustration 600B' in FIG. 6B. Further, referring to illustration 600C in FIG. 6C, the position of the designated safe zone 534 in the second print media portion 520B may be before the reference mark 532. Furthermore, referring to illustration 600C' in FIG. 6C, the position of the designated safe zone 534 in the second print media portion 520B may be after the reference mark 532. In such embodiments, in which the designated safe zone 534 is detected by the processor 402 and the media sensor 202 in the second print media portion 520B, the control turns to operation 510.

Turning to operation 510, the printer 100 or the direct thermal printer 300 may include means, such as the processor 402 and the print operation unit 412 in the firmware 418, for operating the printer 100 or the direct thermal printer 300 in the first printing mode. In the first printing mode, the designated safe zone 534 in the second print media portion 520B is detected. The media sensor 202, based on the calibration information retrieved from the memory device 404, may determine the position of the designated safe zone 534 with respect to the reference mark 532.

As discussed supra, in certain embodiments, the second length "$L_2$" of the designated safe zone 534 may be based on the criticality level of the one or more objects enclosed therein. For example, in some instances in which the designated safe zone 534 doesn't include any object, the second length "$L_2$" of the designated safe zone 534 may be determined based on at least a summation of a ramp-up distance and a ramp-down distance traversed by the stepper motor 130. However, in other instances in which the designated safe zone 534 includes one or more objects and the criticality levels of the enclosed objects are more than a threshold value, the second length "$L_2$" of the designated safe zone 534 may be determined further based on one or more of the set of parameters described above.

Turning to operation 512, the printer 100 or the direct thermal printer 300 may include means, such as the processor 402 and the print operation unit 412 in the firmware 418, for determining whether the designated safe zone 534 is positioned on or before the reference mark 532. In an example embodiment, the media sensor 202, based on the calibration information retrieved from the memory device 404, may determine that the designated safe zone 534 is positioned on or before the reference mark 532, for example as shown in illustrations 600B' and 600C depicting the example second print media portion 520B in FIGS. 6B and 6C, respectively. In such a case, the control turns to operation 514 in the flowchart 500A of FIG. 5A. In alternate embodiment, it may be determined that the designated safe zone 534 is positioned after the reference mark 532, consequently the control turns to operation 702B in flowchart 700G of FIG. 7G.

Turning to operation 514, the printer 100 or the direct thermal printer 300 may include means, such as the processor 402 and the print operation unit 412 in the firmware 418, for determining whether the designated safe zone 534 is positioned before the reference mark 532. In an example embodiment, the media sensor 202, based on the calibration information retrieved from the memory device 404, may determine that the designated safe zone 534 is positioned before the reference mark 532, for example as shown in illustration 600C depicting the example second print media portion 520B in FIG. 6C. In such a case, the control turns to operation 702A in flowchart 700A of FIG. 7A. In an alternate embodiment, the media sensor 202, based on the calibration information retrieved from the memory device 404, may determine that the designated safe zone 534 is positioned on the reference mark 532, for example as shown in both the illustration 600B' depicting the example second print media portion 520B in FIG. 6B. Or only the reference mark 532 is detected, as shown in illustration 600B depicting the example second print media portion 520B in FIG. 6B. In such a case, the control turns to operation 516 in flowchart 500A of FIG. 5A.

Turning to operation 516, the printer 100 or the direct thermal printer 300 may include means, such as the processor 402 and the print operation unit 412 in the firmware 418, for operating the printer 100 or the direct thermal printer 300 in the second printing mode. In the second printing mode, in an example embodiment, the designated safe zone 534 in the second print media portion 520B is not detected, and in another embodiment, the designated safe zone 534 in the second print media portion 520B is detected to be overlapping with the reference mark 532. The media sensor 202, based on the calibration information retrieved from the memory device 404, may determine the position of the reference mark 532. For example, shown in illustration 600B is the example second print media portion 520B in FIG. 6B having calibrated only the reference mark 532. Further, shown in illustration 600B' is the example second print media portion 520B in FIG. 6B having calibrated the designated safe zone 534 in the second print media portion 520B overlapping with the reference mark 532. In such a case, the control turns to operation 802 in flowchart 800A of FIG. 8A.

FIG. 7A, in conjunction with FIGS. 7B and 7C, illustrates the flowchart 700A depicting a method for operating the printer in a first printing mode in an instance when the safe zone 534 is detected before the reference mark 532, according to one or more embodiments of the present disclosure described herein. In this regard, in an example embodiment, various operations illustrated in reference to FIG. 7A may be performed by, with the assistance of, and/or under the control of the circuitry of the printer 100 or the direct thermal printer 300. FIG. 7B illustrates a flowchart 700B depicting a method for suspending a printing operation, according to one or more embodiments of the present disclosure described herein. FIG. 7C illustrates a flowchart 700C depicting a method for resuming a printing operation, according to one or more embodiments of the present disclosure described herein. FIG. 7A, further in conjunction with FIGS. 7D-7F and 7I, describes various illustrations, according to one or more embodiments of the present disclosure described herein. For example, FIG. 7D illustrates a timing diagram 700D of the printer suspending the printing operation, according to one or more embodiments of the present disclosure described herein, FIGS. 7E and 7E' illustrates timing diagrams 700E and 700E' of the printer resuming the printing operation, according to one or more embodiments of the present disclosure described herein, and FIG. 7F illustrates a state diagram 700F depicting an example printing operation in the first printing mode in an instance when the safe zone is detected before the reference mark, according to one or more embodiments of the present disclosure described herein, and FIG. 7I illustrates a state diagram 700I depicting an example printing operation in the first printing mode in an instance when the safe zone is detected after the reference mark, according to one or more embodiments of the present disclosure described herein.

The foregoing method descriptions and operations described in the flowcharts 700A-700C illustrated in FIGS. 7A-7C are provided merely as illustrative examples and are not intended to require or imply that the steps of the various embodiments must be performed in the order presented. As will be appreciated by one of skill in the art, the order of steps in these embodiments may be performed in different orders.

Turning to operation 702A, the printer 100 or the direct thermal printer 300 may include means, such as the processor 402 and the print operation unit 412 in the firmware 418, for suspending the printing operation at a suspension point 720 (FIG. 7D) when the processor 402 and the print operation unit 412 detects that the designated safe zone 534 on the second print media portion 520B is under the print head 110. In an example embodiment, the media sensor 202 may be configured to detect the designated safe zone 534 to be under the print head 110 and is positioned before the reference mark 532.

As shown in FIG. 7D, the suspension point 720 may correspond to a first point "$P_1$" along the length of the second print media portion 520B when the designated safe zone 534 is detected by the media sensor 202 and the print operation unit 412 stops the printing operation on the second print media portion 520B.

Further, as shown in the state diagram 700F of FIG. 7F, upon detecting and/or determining that the designated safe zone 534 is under the print head 110, the print operation unit 412 suspends the printing operation at the first point "$P_1$" on the second print media portion 520B at the timestamp "$T_{4A}$". The control proceeds from the operation 702A in FIG. 7A to operation 710 in FIG. 7B that describes the suspension of the printing operation in detail.

Turning to operation 710 in FIG. 7B, the printer 100 or the direct thermal printer 300 may include means, such as the processor 402, the I/O device interface unit 408, and one or more components in the firmware 418, for causing the stepper motor 130 in the printer 100 or the direct thermal printer 300 to ramp-down from a constant speed "$S_{Constant}$" (till the suspension point 720) and decelerate at the ramp-down rate "$S_{Ramp\text{-}down}$" (after the suspension point 720). For example, the stepper motor 130 may cause the print media 114 to move past the print head 110 at a constant speed "$S_{Constant}$". Once the suspension point 720 reaches the print head 110, the stepper motor 130 causes the movement of the print media 114 to decelerate and/or ramp-down. For example, in illustrations 700D and 700F of FIGS. 7D and 7E, it is depicted that the print operation unit 412 performs the printing operation on the second print media portion 520B at the constant speed "$S_{Constant}$" till the print head 110 reaches the suspension point 720, which is the starting point of the designated safe zone 534 including one or more critical objects. At the suspension point 720, the print operation unit 412 stops the printing operation on the second print media portion 520B, and a ramp-down distance "$D_{Ramp\text{-}down}$" is traversed by the stepper motor 130 in the downstream direction. Consequently, the print media 114 also traverses the ramp-down distance "$D_{Ramp\text{-}down}$" without any printing operation.

In an alternate embodiment, when the designated safe zone 534 doesn't include any object or the criticality levels of objects enclosed within the safe zone are less than a threshold value, the second length "$L_2$" of the designated safe zone 534 may correspond to at least the summation of a ramp-up distance "$D_{Ramp\text{-}up}$" and a ramp-down distance "$D_{Ramp\text{-}down}$" traversed by the stepper motor 130. In such embodiment, also, the print operation unit 412 may stop the printing operation at the suspension point 720, and the processor 402 may causes the stepper motor 130 to decelerate from the constant printing speed "$S_{Constant}$" at a ramp-down rate "$S_{Ramp\text{-}down}$", as shown in illustration 700E' of FIG. 7E'.

Turning to operation 712 in FIG. 7C, the printer 100 or the direct thermal printer 300 may include means, such as the processor 402, the I/O device interface unit 408, and one or more components in the firmware 418, for causing the stepper motor 130 in the printer 100 or the direct thermal printer 300 to attain a zero speed at a second point "$P_2$" in the designated safe zone 534 on the second print media portion 520B. The second point "$P_2$" in the designated safe zone 534 is shown in FIGS. 7D, 7E, and 7F. The control returns to operation 704A in FIG. 7A.

Turning to operation 704A in FIG. 7A, the printer 100 or the direct thermal printer 300 may include means, such as the processor 402, the I/O device interface unit 408, and one or more components in the firmware 418, for causing the stepper motor 130 to perform a first movement in the downstream direction until the first cut point 522A of the first print media portion 520A is detected under the cutter blade 128. The I/O device interface unit 408, upon receiving a forward signal (in the downstream direction) from the processor 402, may be configured to cause the stepper motor 130 to move forward in the downstream direction, which in turn, actuates the first, second, and/or third electrical drives and/or the media drive 312. Such actuation may cause the print media 114 to traverse along the media path 116 in the downstream direction without any print operation. The print media 114 may continue to traverse (without any print operation) along the media path 116 in the downstream direction until the media sensor 202 detects the reference mark 532 in the designated safe zone 534 (that includes one or more critical objects) on the second print media portion 520B. In accordance with the calibration information, at this point, the first cut point 522A is under the cutter blade 128.

As shown in the state diagram 700F of FIG. 7F, at timestamp "$T_{5A}$", the first movement of the print media 114 in the downstream direction may be performed, until the point "$P_{Forward}$" on the second print media portion 520B is detected under the print head 110. This is the point when the first cut point 522A of the first print media portion 520A is under the cutter blade 128. For the first movement, the distance traversed by the print media 114 in the downstream direction may be "$D_{FirstMovement}$" till the point "$P_{Forward}$", as shown in FIG. 7E.

In the alternate embodiment, when the designated safe zone 534 doesn't include any object or the criticality levels of enclosed objects are less than a threshold value, the processor 402 may cause the stepper motor 130 to remain stationary at the second point "$P_2$" on the second print media portion 520B under the print head 110 and does not cause the first movement of the print media 114, as shown in FIG. 7E'.

Turning to operation 706A, the printer 100 or the direct thermal printer 300 may include means, such as the processor 402, the I/O device interface unit 408, and one or more components in the firmware 418, for causing a cutting operation on the first cut point 522A of the first print media portion 520A by actuating the cutter blade 128. The processor 402 may transmit a "CUT" signal to the cutter assembly 124 based on which the cutter assembly 124 actuates the cutter blade 128 based on "CUT" signal. For example, the "CUT" signal may be provided when the second point "$P_2$" of the second print media portion 520B is located at and/or under the print head 110. Preferably, the cutter blade 128 is used to cut non-adhesive paper strip or to cut through the liner between self-adhesive labels to prevent any damage to the cutter blade 128. Once the cutting operation is performed, the cutter blade 128 returns to its original position in the cutter assembly 124. There may be various standard errors associated with the cutter blade 128 in the cutter assembly 124 before, during, or after the cutting operation is performed. Corresponding messages and error codes may be displayed via the I/O device interface unit 408 by use of a display screen. For example, "37" for "Cutter device not found", "1701" for "Cutter not back in position after cut", "1702" for "Cutter has not reached upper position: unsuccessful cut", "1703" for "Cutter not back in position after unsuccessful cut", and "1704" for "Cutter open". The built-in error-handler of the direct protocol of the printer 100 or the direct thermal printer 300 may handle the aforesaid standard errors (display message inside brackets) accordingly.

In the alternate embodiment, when the designated safe zone 534 doesn't include any object or the criticality levels of enclosed objects are less than a threshold value, the processor 402 has cancelled the first movement of the stepper motor 130 and the print head 110 is at the second point "$P_2$" of the second print media portion 520B. In an instance the second point "$P_2$" in such embodiment overlaps with the reference mark 532 and the printer 100 or the direct thermal printer 300 may include means, such as the processor 402, the I/O device interface unit 408, and one or more components in the firmware 418, for causing a cutting operation on the first cut point 522A of the first print media portion 520A by actuating the cutter blade 128.

Turning to operation 708A, the printer 100 or the direct thermal printer 300 may include means, such as the processor 402, the I/O device interface unit 408, and one or more components in the firmware 418, for causing a second movement of the stepper motor 130 in the upstream direction opposite to the downstream direction. The I/O device interface unit 408, upon receiving a backward signal (in the upstream direction) from the processor 402, may be configured to cause the stepper motor 130 to move backward, which in turn, actuates the first, second, and/or third electrical drives and/or the media drive 312. Such actuation may cause the print media 114 to traverse along the media path 116 in the upstream direction. As shown in the state diagram 700F of FIG. 7F, at timestamp "$T_{6A}$", the second movement of the print media 114 in the upstream direction may be performed.

In the alternate embodiment, when the designated safe zone 534 doesn't include any object or the criticality levels of enclosed objects are less than a threshold value, the processor 402 may cause the stepper motor 130 to remain at the second point "$P_2$", with no second movement, as shown in FIG. 7E'.

Turning to operation 710A, the printer 100 or the direct thermal printer 300 may include means, such as the processor 402 and the print operation unit 412 in the firmware 418, for detecting and/or determining that a third point "$P_3$" is under the print head 110 during the second movement. As discussed supra, the I/O device interface unit 408, may be configured to cause the stepper motor 130 to move backward in the upstream direction until the media sensor 202 detects the third point "$P_3$" on the second print media portion 520B to be under the print head 110. As shown in the state diagram 700F of FIG. 7F, at the end of timestamp "$T_{6A}$", the second movement of the print media 114 in the upstream direction may be performed until the third point "$P_3$" is detected by the media sensor 202 to be under the print head 110.

Referring to FIG. 7E, the processor 402 may be configured to determine the third point "$P_3$" based on the distance covered during the first movement "$D_{Forward}$" (which will be traversed back in the upstream direction), the ramp-up distance "$D_{Ramp\text{-}up}$", and the ramp-down distance "$D_{Ramp\text{-}down}$" of the stepper motor 130. Thus, at the end of the operation 710A, the print head 110 may move past the first point "$P_1$" in the upstream direction, and be positioned at the third point "$P_3$" on the second print media portion 520B. Effectively, the distance traversed by the print media 114 during the second movement from the point "$P_{Forward}$" till the third point "$P_3$" in the upstream direction may be represented as:

$$D_{SecondMovement}=D_{Forward}+D_{Ramp\text{-}up}+D_{Ramp\text{-}down}$$

In the alternate embodiment, when the designated safe zone 534 doesn't include any object or the criticality levels of enclosed objects are less than a threshold value, the processor 402 may cause the stepper motor 130 to remain at the second point "$P_2$" only, as shown in FIG. 7E'.

Turning to operation 712A, the printer 100 or the direct thermal printer 300 may include means, such as the processor 402, the I/O device interface unit 408, and the print operation unit 412 in the firmware 418, for resuming the printing operation from the first point "$P_1$" on the second print media portion 520B. Specifically, the processor 402 and the I/O device interface unit 408, may cause the stepper motor 130 to move forward in the downstream direction starting from the third point "$P_3$" on the second print media portion 520B. The control proceeds from the operation 712A in FIG. 7A to operation 714 in FIG. 7C that describes the resuming of the printing operation in detail.

Turning to operation 714 in FIG. 7C, the printer 100 or the direct thermal printer 300 may include means, such as the processor 402, the I/O device interface unit 408, and the print operation unit 412 in the firmware 418, for causing the stepper motor 130 to ramp-up from a zero speed at the third point "$P_3$" and accelerate at a ramp-up rate "$S_{Ramp\text{-}up}$". As a result, the traversal of the print media 114 starts from the third point "$P_3$" in the downstream direction reaching the first point "$P_1$" on the second print media portion 520B. The stepper motor 130 starts from the zero speed (at the third point "$P_3$") and accelerates at a ramp-up rate "$S_{Ramp\text{-}up}$" to cover the ramp-up distance "$D_{Ramp\text{-}up}$" till the resume point 722 (that is the first point "$P_1$").

Turning to operation 716, the printer 100 or the direct thermal printer 300 may include means, such as the processor 402, the I/O device interface unit 408, and the print operation unit 412 in the firmware 418, for causing the stepper motor 130 to attain the constant speed "$S_{Constant}$" from the resume point 722 onwards, as shown in FIG. 7E. From the resume point 722, the print operation unit 412 may be configured to resume the printing operation on the second print media portion 520B. The print operation unit 412 completes the printing operation on the second print media portion 520B and the starts the printing operation on the third print media portion 520C, as shown at timestamp "$T_{7A}$" in FIG. 7F, in the similar manner as explained above for the second print media portion 520B.

In the alternate embodiment, when the designated safe zone 534 doesn't include any object or the criticality levels of enclosed objects are less than a threshold value, the I/O device interface unit 408, may be configured to cause the stepper motor 130 to accelerate from the second point "$P_2$" with the ramp-up rate of "$S_{Ramp\text{-}up}$" to a constant printing speed "$S_{Constant}$" at the resume point 722 after traversing the ramp-up distance "$D_{Ramp\text{-}up}$" from the second point "$P_2$" on the second print media portion 520B, as shown in FIG. 7E'. The print operation unit 412 resumes the printing operation on the second print media portion 520B from the resume point 722, and after completing the printing operation on the second print media portion 520B, starts the printing operation on the third print media portion 520C, as shown at timestamp "$T_{7A}$" in FIG. 7F, in the similar manner as explained above for the second print media portion 520B.

Thus, as clear from FIG. 7E, the first and the second movement of the second print media portion 520B may be performed when the designated safe zone 534 includes one or more critical objects. Due to the first movement, the second print media portion 520B traverses downstream for the cutting of the first print media portion 520A and due to the second movement, the second print media portion 520B traverses upstream for the adjusting the second print media portion 520B for resuming the print operation. Thus, the print quality in the designated safe zone 534 is above a threshold quality level.

In the alternate embodiment, the first and the second movement of the second print media portion 520B may not be performed when the designated safe zone 534 either includes no object or includes one or more non-critical objects. This may result in saving, for example, two inches of extra motion between print media portions which may be anywhere from "0.5 s" to "1 s" between the print media portions if the cutter blade is one inch in front of the burn line of the print head 110.

FIG. 7G, in conjunction with FIGS. 7B and 7C, illustrates a flowchart 700G depicting a method for operating the printer in the first printing mode in an instance when the safe zone is detected after the reference mark, according to one or more embodiments of the present disclosure described herein. In this regard, in an example embodiment, various operations illustrated in reference to FIG. 7G may be performed by, with the assistance of, and/or under the control of the circuitry of the printer 100 or the direct thermal printer 300. The foregoing method descriptions and operations described in the flowchart 700G illustrated in FIG. 7G are provided merely as illustrative examples and are not intended to require or imply that the steps of the various embodiments must be performed in the order presented. As will be appreciated by one of skill in the art, the order of steps in these embodiments may be performed in different orders.

Turning to operation 702B, the printer 100 or the direct thermal printer 300 may include means, such as the processor 402 and the print operation unit 412 in the firmware 418, for suspending the printing operation at a suspension point 720' on the second print media portion 520B' when it is detected that the designated safe zone 534' on the second print media portion 520B' is under the print head 110. In an example embodiment, the media sensor 202 may be configured to detect the designated safe zone 534' to be under the print head 110 and after the reference mark 532'. This implies that the first cut point 522A' of the first print media portion 520A' has already traversed past the cutter blade 128 without being cut.

Figure 7H:
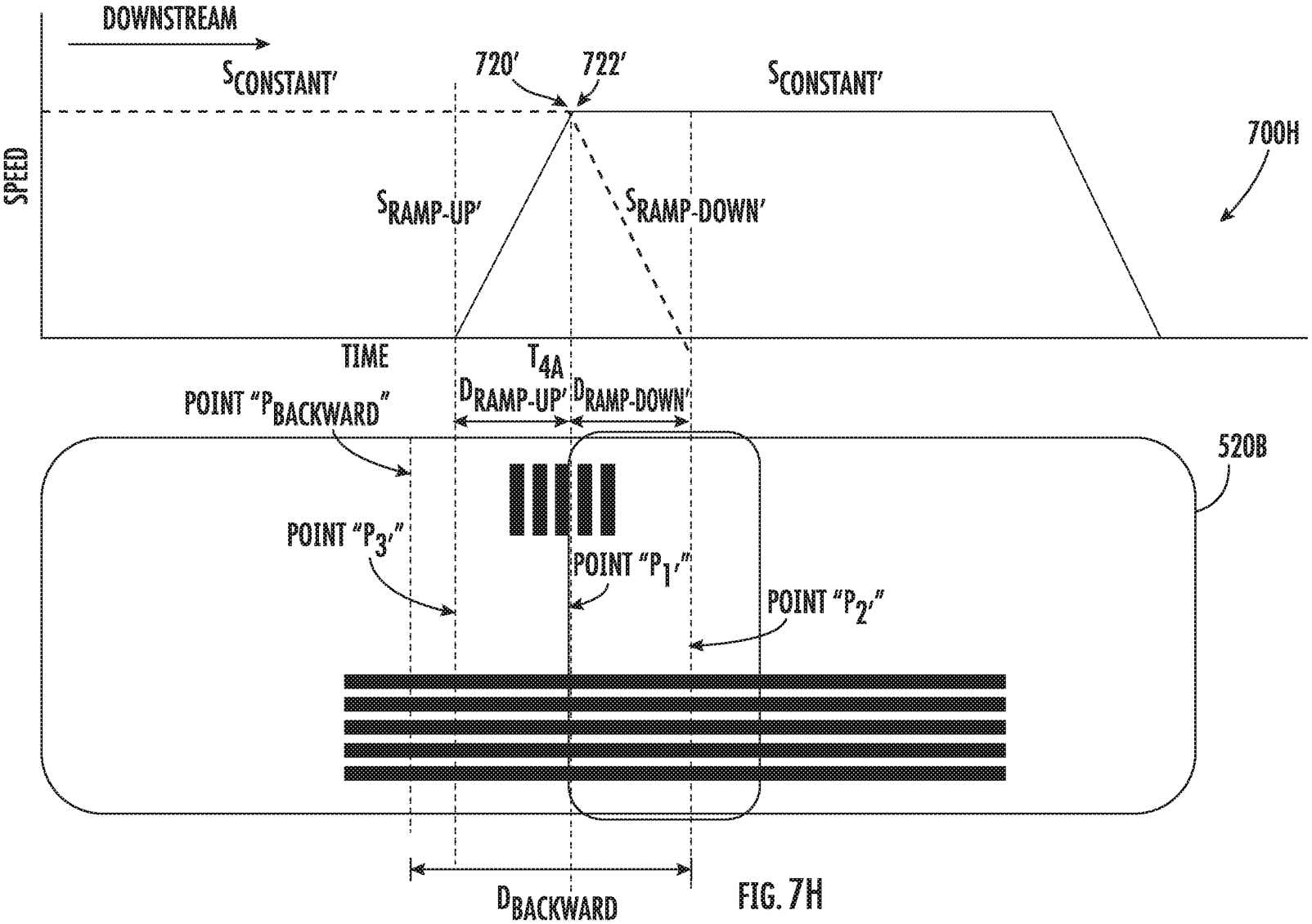
FIG. 7H, in conjunction with FIG. 7G, illustrates a timing diagram depicting an example printing operation in the first printing mode in an instance when the safe zone is detected after the reference mark and includes critical objects, according to one or more embodiments of the present disclosure described herein.
Figure 7I:
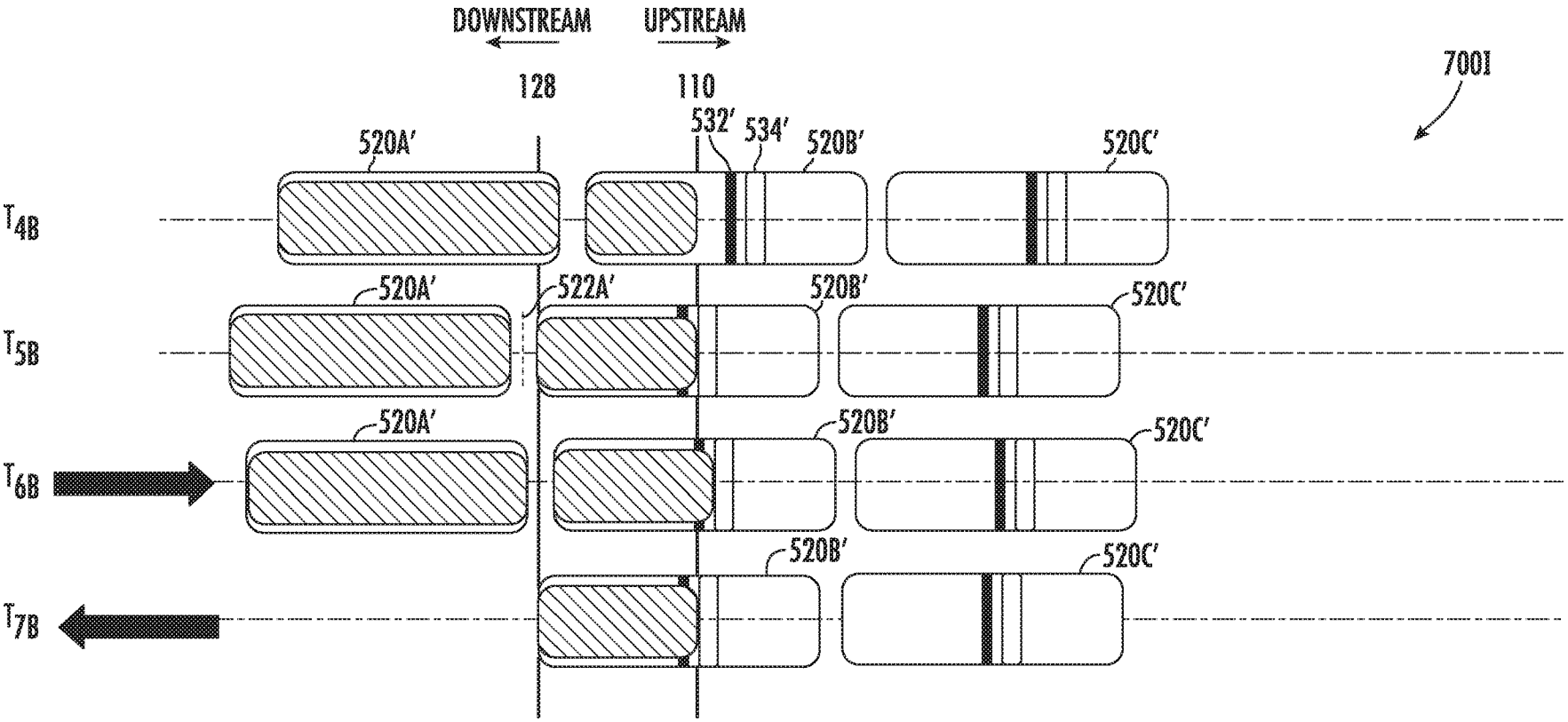
FIG. 7I, in conjunction with FIG. 5C, illustrates a state diagram depicting an example printing operation in the first printing mode in an instance when the safe zone is detected after the reference mark, according to one or more embodiments of the present disclosure described herein.

As shown in FIG. 7H, the suspension point 720' may correspond to a first point "$P_1$," on the second print media portion 520B' when the designated safe zone 534' is detected by the media sensor 202 and the print operation unit 412 stops the printing operation on the second print media portion 520B'.

Further, as shown in the state diagram 700I of FIG. 7I, upon detecting and/or determining that the designated safe zone 534' is under the print head 110, the printing operation is suspended at the first point "$P_{1'}$" on the second print media portion 520B' at the timestamp "$T_{5B}$". The control proceeds from the operation 702B in FIG. 7G to operation 710 in FIG. 7B that describes the suspension of the printing operation in detail in the similar manner, as described supra in conjunction with FIG. 7A.

Turning to operation 704B in FIG. 7G, the printer 100 or the direct thermal printer 300 may include means, such as the processor 402, the I/O device interface unit 408, and one or more components in the firmware 418, for causing the stepper motor 130 to perform a first movement in the upstream direction until the first cut point 522A' of the first print media portion 520A' is detected under the cutter blade 128. The I/O device interface unit 408, upon receiving a backward signal (in the downstream direction) from the processor 402, may be configured to cause the stepper motor 130 to move backward in the upstream direction, which in turn, actuates the first, second, and/or third electrical drives and/or the media drive 312. Such actuation may cause the print media 114 to traverse along the media path 116 in the upstream direction without any print operation occurring. The print media 114 may continue to traverse (without any print operation) along the media path 116 in the upstream direction until the media sensor 202 detects the reference mark 532' in the designated safe zone 534' (that may include one or more critical objects) on the second print media portion 520B'. In accordance with the calibration information, at this point, the first cut point 522A' is under the cutter blade 128.

As shown in the state diagram 700I of FIG. 7I, at timestamp "$T_{6B}$", the first movement of the print media 114 in the upstream direction may be performed, until the point "$P_{Backward}$" on the second print media portion 520B' is detected. This is the point when the first cut point 522A of the first print media portion 520A is under the cutter blade 128. For the first movement, the distance traversed by the print media 114 in the upstream direction may be "$D_{Backward}$" till the point "$P_{Backward}$", as shown in FIG. 7H.

Turning to operation 706B, the printer 100 or the direct thermal printer 300 may include means, such as the processor 402, the I/O device interface unit 408, and one or more components in the firmware 418, for causing a cutting operation on the first cut point 522A' of the first print media portion 520A' by actuating the cutter blade 128. The processor 402 may transmit a "CUT" signal to the cutter assembly 124 based on which the cutter assembly 124 actuates the cutter blade 128 based on "CUT" signal. Preferably, the cutter blade 128 is used to cut non-adhesive paper strip or to cut through the liner between self-adhesive labels to prevent any damage to the cutter blade 128. Once the cutting operation is performed, the cutter blade 128 returns to its original position in the cutter assembly 124. There may be various standard errors associated with the cutter blade 128 in the cutter assembly 124 before, during, or after the cutting operation is performed. Corresponding messages and error codes may be displayed via the I/O device interface unit 408 by use of a display screen. For example, "37" for "Cutter device not found", "1701" for "Cutter not back in position after cut", "1702" for "Cutter has not reached upper position: unsuccessful cut", "1703" for "Cutter not back in position after unsuccessful cut", and "1704" for "Cutter open". The built-in error-handler of the direct protocol of the printer 100 or the direct thermal printer 300 may handle the aforesaid standard errors (display message inside brackets) accordingly.

Turning to operation 708B, the printer 100 or the direct thermal printer 300 may include means, such as the processor 402, the I/O device interface unit 408, and one or more components in the firmware 418, for causing a second movement of the stepper motor 130 in the downstream direction opposite to the upstream direction. The I/O device interface unit 408, upon receiving a forward signal (in the downstream direction) from the processor 402, may be configured to cause the stepper motor 130 to move forward (without any print operation), which in turn, actuates the first, second, and/or third electrical drives and/or the media drive 312. Such actuation may cause the print media 114 to traverse along the media path 116 from the point "$P_{Backward}$" in the downstream direction. As shown in the state diagram 700I of FIG. 7I, at timestamp "$T_{7B}$", the second movement of the print media 114 in the downstream direction may be performed.

Turning to operation 710B, the printer 100 or the direct thermal printer 300 may include means, such as the processor 402 and the print operation unit 412 in the firmware 418, for detecting and/or determining that third point "$P_{3'}$" is under the print head 110 during the second movement. As discussed supra, the I/O device interface unit 408, may be configured to cause the stepper motor 130 to move forward in the downstream direction until the media sensor 202 detects the third point "$P_{3'}$" on the second print media portion 520B' to be under the print head 110. As shown in the state diagram 700I of FIG. 7I, the second movement of the print media 114 in the downstream direction at timestamp "$T_{7B}$" may be performed until the third point "$P_3$" is detected by the media sensor 202 to be under the print head 110.

Referring to FIG. 7H, the processor 402 may be configured to determine the third point "$P_{3'}$" based on the distance covered during the first movement "$D_{Backward}$", which will be traversed in the downstream direction from the second point "$P_{2'}$". Further, the third point "$P_{3'}$" may be determined based on the ramp-up distance "$D_{Ramp\text{-}up'}$" and the ramp-down distance "$D_{Ramp\text{-}down'}$" of the stepper motor 130. Effectively, the distance traversed by the print media 114 during the second movement from the point "$P_{Backward}$" to the third point "$P_{3'}$" in the downstream direction may be represented as, with respect to the second point "$P_{2'}$":

$$D_{SecondMovement}=D_{Backward}-(D_{Ramp\text{-}up}+D_{Ramp\text{-}down})$$

Turning to operation 712B, the printer 100 or the direct thermal printer 300 may include means, such as the processor 402, the I/O device interface unit 408, and the print operation unit 412 in the firmware 418, for resuming the printing operation from the first point "$P_1$" on the second print media portion 520B'. Specifically, the I/O device interface unit 408, may be configured to cause the stepper motor 130 to move forward in the downstream direction starting from the third point "$P_{3'}$" on the second print media portion 520B'. The control proceeds from the operation 712B in FIG. 7G to operation 714 in FIG. 7C that describes the resuming of the printing operation in detail.

Turning to operation 714 in FIG. 7C, the printer 100 or the direct thermal printer 300 may include means, such as the processor 402, the I/O device interface unit 408, and the print operation unit 412 in the firmware 418, for causing the stepper motor 130 to ramp-up and accelerate from a zero speed at the third point "$P_{3'}$", as a result of which the traversal of the print media 114 starts from the third point "$P_{3'}$" in the downstream direction reaching the first point "$P_{1'}$" on the second print media portion 520B'. Thus, the stepper motor 130 starts from zero speed (at the third point "$P_{3'}$"), accelerates at a ramp-up rate "$S_{Ramp\text{-}up'}$" to cover the ramp-up distance "$D_{Ramp\text{-}up'}$" till the resume point 722' (that is the first point "$P_{1'}$").

Turning to operation 716, the printer 100 or the direct thermal printer 300 may include means, such as the processor 402, the I/O device interface unit 408, and the print operation unit 412 in the firmware 418, for causing the stepper motor 130 to attain the constant speed "$S_{Constant'}$" from the resume point 722' onwards, as shown in FIG. 7H. From the resume point 722', the print operation unit 412 may be configured to resume the printing operation on the second print media portion 520B'. The print operation unit 412 completes the printing operation on the second print media portion 520B' and the starts the printing operation on the third print media portion 520C', as shown at timestamp "$T_{7B}$" in FIG. 7I, in the similar manner as explained above for the second print media portion 520B.

Figure 8A:
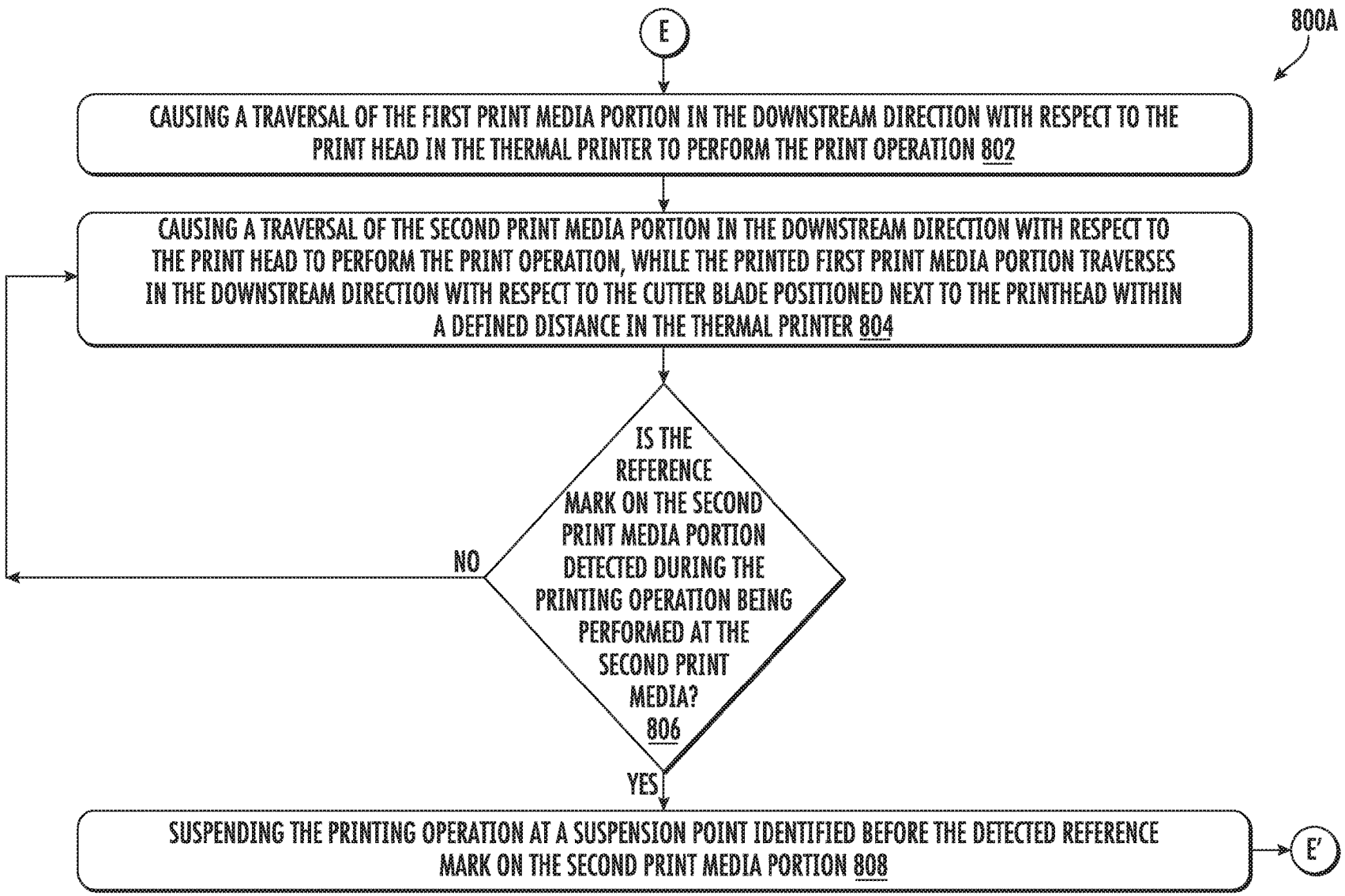
FIGS. 8A and 8B illustrate flowcharts depicting a method for operating the printer in a printing mode in a second printing mode in an instance when the safe zone is not detected, according to one or more embodiments of the present disclosure described herein.
Figure 8B:
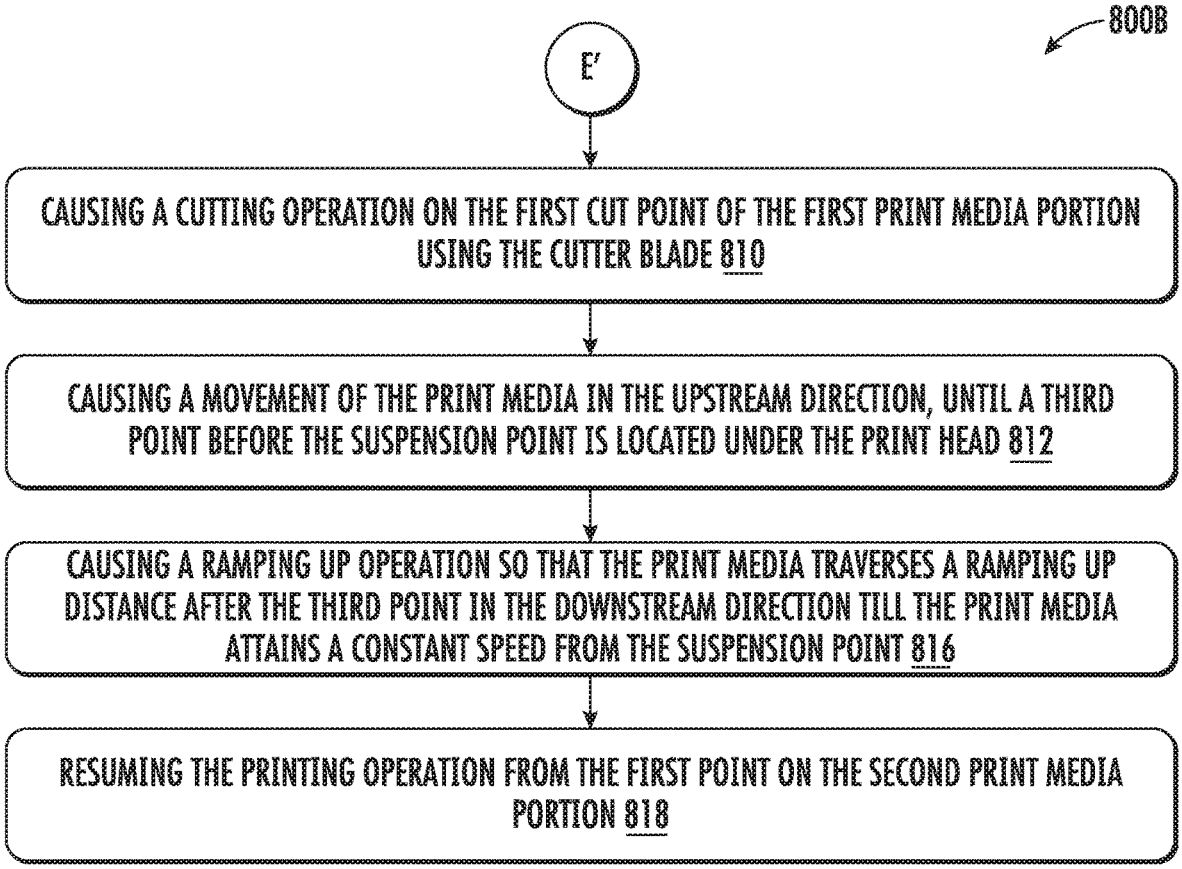
Figure 8C:
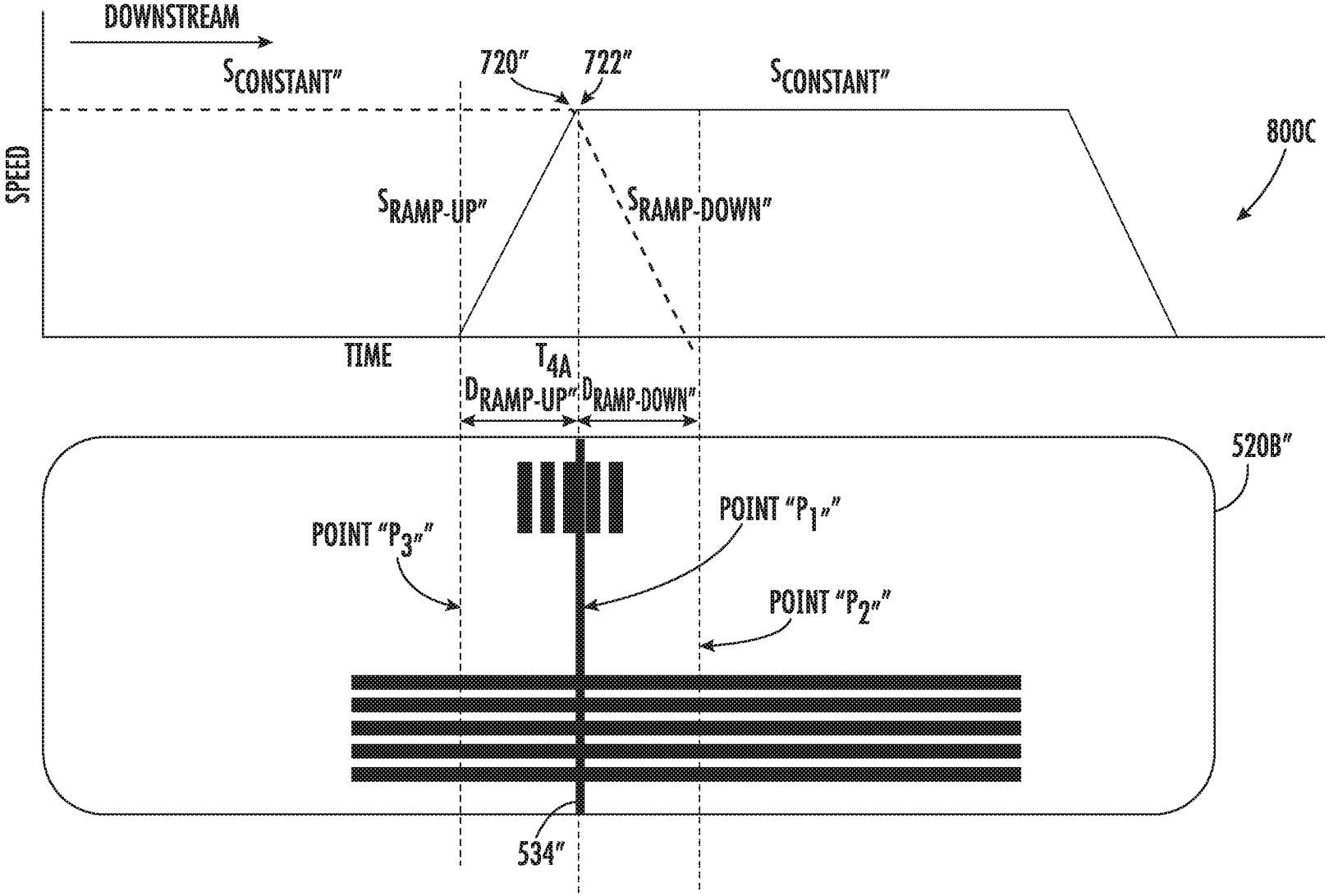
FIG. 8C, in conjunction with FIGS. 8A and 8B, illustrates a timing diagram depicting an example printing operation in the first printing mode in an instance when the safe zone is detected after the reference mark and includes critical objects, according to one or more embodiments of the present disclosure described herein.
Figure 8D:
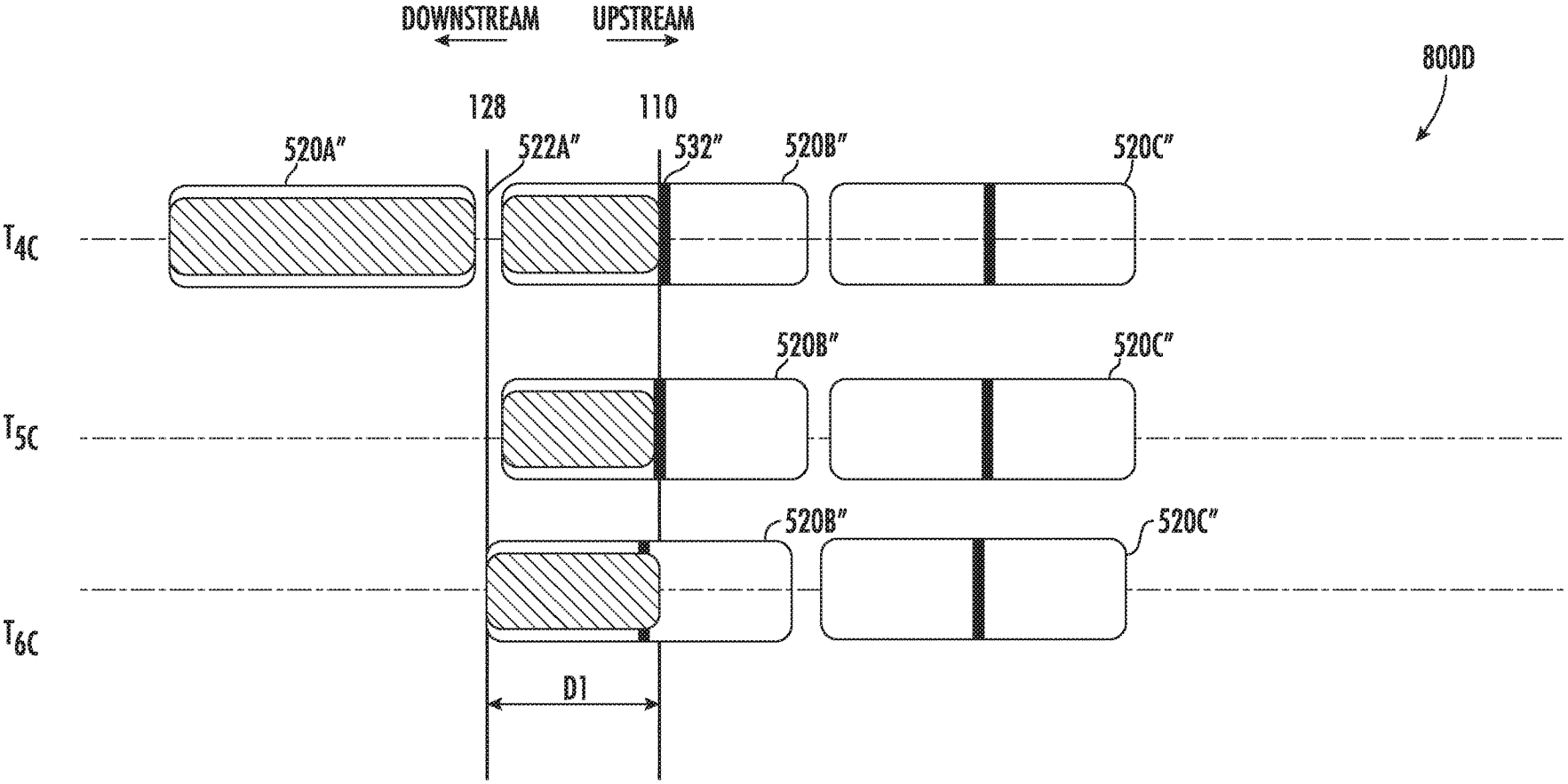
FIG. 8D, in conjunction with FIGS. 8A and 8B, illustrates a state diagram depicting an example printing operation in the second printing mode in an instance when the safe zone is not detected, according to one or more embodiments of the present disclosure described herein.

FIGS. 8A and 8B illustrate flowcharts depicting a method for operating the printer in a printing mode in a second printing mode in an instance when the safe zone is not detected, according to one or more embodiments of the present disclosure described herein. In this regard, in an example embodiment, various operations illustrated in reference to FIGS. 8A and 8B may be performed by, with the assistance of, and/or under the control of the circuitry (e.g., control system 208) of the printer 100 or the direct thermal printer 300. The foregoing method descriptions and operations described in the flowcharts 800A and 800B illustrated in FIGS. 8A and 8B are provided merely as illustrative examples and are not intended to require or imply that the steps of the various embodiments must be performed in the order presented. As will be appreciated by one of skill in the art, the order of steps in these embodiments may be performed in different orders. FIGS. 8C and 8D, in conjunction with FIGS. 8A and 8B, illustrate timing diagram and state diagram, respectively, depicting an example printing operation in the second printing mode in an instance when the safe zone is not detected, according to one or more embodiments of the present disclosure described herein.

Turning to operation 802, the printer 100 or the direct thermal printer 300 may include means, such as the processor 402 and the print operation unit 412 in the firmware 418, for causing a traversal of the first print media portion 520A" in a downstream direction with respect to the print head 110 in the printer 100 or the direct thermal printer 300 to perform the print operation. The processor 402 may cause the first, second, and/or third electrical drives, and/or the media drive 312 to actuate the corresponding assemblies for the traversal of the print media 114. As the print media 114 traverses in the downstream direction, the print operation unit 412 performs the print operation (e.g., via the print head 110) on the first print media portion 520A" of the plurality of the print media portions 520. Once the print operation unit 412 completes the print operation on the first print media portion 520A", the traversal of the print media 114 continues, and the first print media portion 520A" continues traversing past the print head 110 towards the cutter blade 128.

For example, referring to the state diagram 500C in FIG. 5C, at timestamp "$T_1$", the traversal of the print media 114 including the plurality of print media portions 502 starts. Each of the plurality of print media portions 502 are calibrated to indicate at least the reference mark 532, shown as the reference mark 532" in FIG. 8C.

The print operation unit 412 may cause the burn line in the print head 110 to start performing the print operation on the first print media portion 520A". For example, referring to the state diagram 500C in FIG. 5C, at timestamp "$T_2$", the burn line in the print head 110 may complete the printing operation of a region "$R_1$" of the first print media portion 520A, indicated by the shaded region.

It may be noted that for the first print media portion 520A", the processor 402 and the print operation unit 412 may not detect the reference mark 532" as an exception. In other words, the burn line in the print head 110 may normally print the first print media portion 520A" without any suspension or resumption of the printing operation. Once the printing operation on the first print media portion 520A" is over, the print media 114 continues traversing and the printing operation is initiated on the second print media portion 520B", and now the processor 402 may communicate a signal to the media sensor 202 or other such means, and the media sensor 202, based on the calibration information retrieved from the memory device 404, is enabled to detect the reference mark 532" in the forthcoming print media portions.

Turning to operation 804, the printer 100 or the direct thermal printer 300 may include means, such as the processor 402 and the print operation unit 412 in the firmware 418, for causing a traversal of the second print media portion 520B" in the downstream direction with respect to the print head 110 to perform the print operation, while the printed first print media portion 520A traverses in the downstream direction with respect to the cutter blade 128 positioned next to the print head 110 within a defined distance "$D_1$" in the printer 100 or the direct thermal printer 300.

For example, referring to the state diagram 500C in FIG. 5C, at timestamp "$T_3$", the burn line in the print head 110 may complete the printing operation of the first print media portion 520A. As the traversal of the print media 114 continues, the first print media portion 520A also continues the traversal in the downstream direction and starts moving past the cutter blade 128. Meanwhile, the print head 110 may start the printing operation of the second print media portion 520B, indicated by the region "$R_2$" at timestamp "$T_3$".

Turning to operation 806, the printer 100 or the direct thermal printer 300 may include means, such as the media sensor 202 in conjunction with the calibration information retrieved form the memory device 404, for determining whether the reference mark 532" is detected. The calibration information may provide the position of the reference mark 532" designated by the calibration unit 410. Accordingly, the media sensor 202 may detect the reference mark 532" in the second print media portion 520B and the control proceeds to operation 808. Else the control moves back to operation 804.

Turning to operation 808, the printer 100 or the direct thermal printer 300 may include means, such as the processor 402 and the print operation unit 412 in the firmware 418, for suspending the printing operation at a suspension point 720" on the second print media portion 520B" when it is detected that the reference mark 532" on the second print media portion 520B" is under the print head 110. In an example embodiment, the media sensor 202 may be configured to detect the reference mark 532" to be under the print head 110.

As shown in FIG. 8C, the suspension point 720" may correspond to a first point "$P_{1''}$" on the second print media portion 520B" when the reference mark 532" is detected by the media sensor 202 and the print operation unit 412 stops the printing operation on the second print media portion 520B".

Further, as shown in the state diagram 800D of FIG. 8D, upon detecting and/or determining that the reference mark 532" is under the print head 110, the printing operation is suspended at the first point "$P_{1''}$" on the second print media portion 520B" at the timestamp "$T_{4C}$".

Turning to operation 810, the printer 100 or the direct thermal printer 300 may include means, such as the processor 402, the I/O device interface unit 408, and one or more components in the firmware 418, for causing the stepper motor 130 in the printer 100 or the direct thermal printer 300 to ramp-down from a constant speed "$S_{Constant}$" (at the suspension point 720") and decelerate at the ramp-down rate "$S_{Ramp\text{-}down}$". For example, in illustrations 800C of FIG. 8C, it is depicted that the print operation unit 412 performs the printing operation on the second print media portion 520B" at the constant speed "$S_{Constant}$" till the print head 110 reaches the suspension point 720", which is the starting point of the reference mark 532". At the suspension point 720", the print operation unit 412 stops the printing operation on the second print media portion 520B", and a ramp-down distance "$D_{Ramp\text{-}down}$" is traversed by the stepper motor 130 in the downstream direction. Consequently, the print media 114 also traverses the ramp-down distance "$D_{Ramp\text{-}down}$" without any printing operation. As shown in FIG. 8C, the suspension point 720" corresponds to the first point "$P_{1''}$" on the second print media portion 520B".

Further, the printer 100 or the direct thermal printer 300 may include means, such as the processor 402, the I/O device interface unit 408, and one or more components in the firmware 418, for causing the stepper motor 130 in the printer 100 or the direct thermal printer 300 to attain a zero speed at a second point "$P_{2''}$" on the second print media portion 520B", as shown in FIG. 8C. When at the zero speed at a second point "$P_{2''}$" on the second print media portion 520B", the print media 114 is stationary, the second point "$P_{2''}$" is under the print head 110 and the first cut point 522A" of the first print media portion 520A" is under the cutter blade 128.

Turning to operation 810, the printer 100 or the direct thermal printer 300 may include means, such as the processor 402, the I/O device interface unit 408, and one or more components in the firmware 418, for causing a cutting operation on the first cut point 522A" of the first print media portion 520A" by actuating the cutter blade 128. The processor 402 may transmit a "CUT" signal to the cutter assembly 124 based on which the cutter assembly 124 actuates the cutter blade 128 based on "CUT" signal. Preferably, the cutter blade 128 is used to cut non-adhesive paper strip or to cut through the liner between self-adhesive labels to prevent any damage to the cutter blade 128. Once the cutting operation is performed, the cutter blade 128 returns to its original position in the cutter assembly 124. There may be various standard errors associated with the cutter blade 128 in the cutter assembly 124 before, during, or after the cutting operation is performed. Corresponding messages and error codes may be displayed via the I/O device interface unit 408 by use of a display screen. For example, "37" for "Cutter device not found", "1701" for "Cutter not back in position after cut", "1702" for "Cutter has not reached upper position: unsuccessful cut", "1703" for "Cutter not back in position after unsuccessful cut", and "1704" for "Cutter open". The built-in error-handler of the direct protocol of the printer 100 or the direct thermal printer 300 may handle the aforesaid standard errors (display message inside brackets) accordingly.

Turning to operation 812, the printer 100 or the direct thermal printer 300 may include means, such as the processor 402, the I/O device interface unit 408, and one or more components in the firmware 418, for causing a movement of the stepper motor 130 in the upstream direction opposite to the downstream direction. The I/O device interface unit 408, upon receiving a backward signal (in the upstream direction) from the processor 402, may be configured to cause the stepper motor 130 to move backward, which in turn, actuates the first, second, and/or third electrical drives and/or the media drive 312. Such actuation may cause the print media 114 to traverse along the media path 116 in the upstream direction and reach a third point "$P_3$" on the second print media portion 520B. The processor 402 may be configured to determine the third point "$P_{3''}$" based on the ramp-up distance "$D_{Ramp\text{-}up}$" of the stepper motor 130 in the upstream direction from the first point "$P_{1''}$" or a summation of the ramp-up distance "$D_{Ramp\text{-}up}$" and the ramp-down distance "$D_{Ramp\text{-}down}$" of the stepper motor 130 in the upstream direction from the second point "$P_{2''}$".

Turning to operation 816, the printer 100 or the direct thermal printer 300 may include means, such as the processor 402, the I/O device interface unit 408, and the print operation unit 412 in the firmware 418, for causing a ramping up operation so that the print media 114 traverses a ramp-up distance "$D_{Ramp\text{-}up}$" after the third point "$P_{3''}$" in the downstream direction till the print media attains a constant speed by and/or at the first point "$P_{1''}$".

In an example embodiment, the stepper motor 130 starts again when the print head 110 is at the third point "$P_{3''}$", as a result of which the traversal of the print media 114 starts from the third point "$P_{3''}$" in the downstream direction reaching the first point "$P_{1''}$" on the second print media portion 520B. The stepper motor 130 starts from zero speed (at the third point "$P_{3''}$"), accelerates at a ramp-up rate "$S_{Ramp\text{-}up}$" to cover the ramp-up distance "$D_{Ramp\text{-}up}$" till the resume point 722" (that is the first point "$P_{1''}$").

Turning to operation 818, the printer 100 or the direct thermal printer 300 may include means, such as the processor 402, the I/O device interface unit 408, and the print operation unit 412 in the firmware 418, for resuming the printing operation from the first point "$P_{1''}$" on the second print media portion 520B". The traversal of the print media 114 starts from the third point "$P_{3''}$" in the downstream direction on the second print media portion 520B" and reaching the first point "$P_{1''}$". The stepper motor 130 starts from zero speed (at the third point "$P_{3''}$"), accelerates at a ramp-up rate "$S_{Ramp\text{-}up}$" to cover the ramp-up distance "$D_{Ramp\text{-}up}$", and reach the resume point 722" (that is the first point "$P_{1''}$"). By and/or at the resume point 722", the stepper motor 130 attains the constant speed "$S_{Constant}$" onwards, as shown in FIG. 8C. From the resume point 722", the print operation unit 412 may be configured to resume the printing operation on the second print media portion 520B". The print operation unit 412 completes the printing operation on the second print media portion 520B" and the starts the printing operation on the third print media portion 520C", in the similar manner as explained above for the second print media portion 520B".

In some example embodiments, certain ones of the operations herein may be modified or further amplified as described below. Moreover, in some embodiments additional optional operations may also be included. It should be appreciated that each of the modifications, optional additions or amplifications described herein may be included with the operations herein either alone or in combination with any others among the features described herein.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The hardware used to implement the various illustrative logics, logical blocks, modules, and circuits described in connection with the aspects disclosed herein may include a general purpose processor, a digital signal processor (DSP), a special-purpose processor such as an application specific integrated circuit (ASIC) or a field programmable gate array (FPGA), a programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. Alternatively or in additionally, some steps or methods may be performed by circuitry that is specific to a given function.

In one or more example embodiments, the functions described herein may be implemented by special-purpose hardware or a combination of hardware programmed by firmware or other software. In implementations relying on firmware or other software, the functions may be performed as a result of execution of one or more instructions stored on one or more non-transitory computer-readable media and/or one or more non-transitory processor-readable media. These instructions may be embodied by one or more processor-executable software modules that reside on the one or more non-transitory computer-readable or processor-readable storage media. Non-transitory computer-readable or processor-readable storage media may in this regard comprise any storage media that may be accessed by a computer or a processor. By way of example but not limitation, such non-transitory computer-readable or processor-readable media may include RAM, ROM, EEPROM, FLASH memory, disk storage, magnetic storage devices, or the like. Disk storage, as used herein, includes compact disc (CD), laser disc, optical disc, digital versatile disc (DVD), floppy disk, and Blu-ray Disc™, or other storage devices that store data magnetically or optically with lasers. Combinations of the above types of media are also included within the scope of the terms non-transitory computer-readable and processor-readable media. Additionally, any combination of instructions stored on the one or more non-transitory processor-readable or computer-readable media may be referred to herein as a computer program product.

Many modifications and other embodiments of the inventions set forth herein will come to mind to one skilled in the art to which these inventions pertain having the benefit of teachings presented in the foregoing descriptions and the associated drawings. Although the figures only show certain components of the apparatus and systems described herein, it is understood that various other components may be used in conjunction with the supply management system. Therefore, it is to be understood that the inventions are not to be limited to the specific embodiments disclosed and that modifications and other embodiments are intended to be included within the scope of the appended claims. Moreover, the steps in the method described above may not necessarily occur in the order depicted in the accompanying diagrams, and in some cases one or more of the steps depicted may occur substantially simultaneously, or additional steps may be involved. Although specific terms are employed herein, they are used in a generic and descriptive sense only and not for purposes of limitation.

The invention claimed is:

1. A method for enhancing throughput of a thermal printer cutter, the method comprising:

receiving, by a processor, a print job for a plurality of print media portions in a print media, wherein the plurality of print media portions comprises at least a first print media portion and a second print media portion;

operating, by a print operation unit, a thermal printer in a first printing mode in an instance in which a designated safe zone is detected by a calibration unit, wherein the operating of the thermal printer in the first printing mode comprises:

causing, by the print operation unit, a traversal of the first print media portion in a downstream direction with respect to a print head in the thermal printer to perform a print operation;

causing, by the print operation unit, a traversal of the second print media portion in the downstream direction with respect to the print head to perform the print operation, while the first print media portion traverses in the downstream direction with respect to a cutter blade positioned next to a print head within a defined distance in the thermal printer, until the designated safe zone on the second print media portion is detected under the print head;

suspending, by the print operation unit, the printing operation at a first point on the second print media portion until the traversal of the second print media portion in the downstream direction halts at a second point;

causing, by the print operation unit, a first movement of the print media in one of the downstream direction or an upstream direction, based on a position of the designated safe zone with respect to a reference mark, until a first cut point of the first print media portion is detected under the cutter blade;

causing, by the print operation unit, a cutting operation on the first cut point of the first print media portion using the cutter blade;

causing, by the print operation unit, a second movement of the print media in one of the downstream direction or the upstream direction, based on the position of the designated safe zone with respect to the reference mark, until a third point is detected under the print head; and resuming, by the print operation unit, the printing operation from the first point on the second print media portion.

2. The method according to claim 1, further comprising operating, by the calibration unit, the thermal printer in a calibration mode, wherein the operating of the thermal printer in the calibration mode comprises:

analyzing, by the calibration unit, an image of the received print job to be printed in a print area of each of the plurality of print media portions;

determining, by the calibration unit, a reference mark, wherein the reference mark is a mark in the second print media portion when the first cut point corresponding to the first print media portion is under the cutter blade of a cutter assembly in the thermal printer; and identifying, by the calibration unit, a search area having a first length in the print area of each of the plurality of print media portions based on the determined reference mark and a set of parameters, wherein the search area includes the reference mark; and designating, by the calibration unit, a safe zone having a second length within the identified search area within a defined proximity to the reference mark within the identified search area based on one or more predefined criteria.

3. The method according to claim 2, wherein the set of parameters comprises at least a start parameter and a stop parameter, wherein the start parameter and the stop parameter are based on at least one of (a) a printing speed of the thermal printer, (b) a length of each of the plurality of print media portions, (c) a distance between a trailing edge of the first print media portion and a leading edge of the second print media portion, or (d) print margins of each of the plurality of print media portions.

4. The method according to claim 2, wherein the one or more predefined criteria correspond to one of an automatic selection or manual selection of an area within the identified search area, wherein the automatic selection or the manual selection of the area is based on a maximum empty space, one or more non-critical objects, or minimum count of one or more critical objects, wherein the manual selection of the area is further based on a set of object preferences provided by an operator, wherein the set of object preferences are associated with the one or more non-critical objects and/or the one or more critical objects.

5. The method according to claim 2, wherein the designated safe zone is without an object or includes one or more non-critical objects, wherein the designated safe zone is within a predefined distance from the reference mark, wherein, in an instance when the designated safe zone is without an object or includes one or more non-critical objects, the second length of the designated reference zone is at least equal to a combination of a ramp-up distance and a ramp-down distance traversed by the print media.

6. The method according to claim 2, wherein the designated safe zone comprises one or more objects selected by an operator.

7. The method according to claim 1, wherein the first print media portion is separated from the second print media portion by the first cut point defined at a predetermined distance from a second cut point along length of the print media, wherein the first cut point corresponds to the first print media portion and the second cut point corresponds to the second print media portion.

8. The method according to claim 1, wherein the downstream direction corresponds to a forward direction along web direction of the print media, wherein the upstream direction corresponds to a backward direction opposite to web direction of the print media.

9. The method according to claim 1, further comprising:

causing, by the print operation unit, a ramping down of a stepper motor in the thermal printer from a constant speed at the first point and attaining a zero speed at the second point in the designated safe zone, wherein the first point corresponds to a point of deceleration of the stepper motor from the constant speed, wherein a distance traversed during the ramping down of the stepper motor corresponds to a ramp-down distance.

10. The method according to claim 9, further comprising:

causing, by the print operation unit, a ramping up of the stepper motor in the thermal printer accelerating from a zero speed at the third point in the designated safe zone and attaining the constant speed at the first point in the designated safe zone, wherein the first point corresponds to a point when the stepper motor attains the constant speed, wherein a distance traversed during the ramping up of the stepper motor corresponds to a ramp-up distance, wherein the third point is located towards the downstream direction before the first point at a distance that corresponds to summation of ramp-down distance and ramp-up distance from the second point.

11. The method according to claim 10, wherein the third point is determined by the processor based on a ramp-up distance traversed by the print media once the printing operation is resumed.

12. The method according to claim 1, further comprising operating, by the print operation unit, the thermal printer in a second printing mode in an instance in which the designated safe zone is not detected, wherein operating the thermal printer in the second printing mode comprises:

causing, by the print operation unit, a traversal of the first print media portion in the downstream direction with respect to the print head in the thermal printer to perform the print operation;

causing, by the print operation unit, a traversal of the second print media portion in the downstream direction with respect to the print head to perform the print operation, while the printed first print media portion traverses in the downstream direction with respect to the cutter blade positioned next to the print head within a defined distance in the thermal printer;

detecting, by the print operation unit, the reference mark on the second print media portion during the printing operation being performed at the second print media;

suspending, by the print operation unit, the printing operation at the first point identified before the detected reference mark on the second print media portion;

causing, by the print operation unit, a ramping down operation so that the print media traverses a ramp-down distance after the first point in the downstream direction till the print media is stationary at the second point and the detected reference mark is under the cutter blade;

causing, by the print operation unit, a cutting operation on the first cut point of the first print media portion using the cutter blade;

causing, by the print operation unit, a movement of the print media in the upstream direction, until the third point before the first point is located under the print head;

causing, by the print operation unit, a ramping up operation so that the print media traverses a ramp-up distance after the third point in the downstream direction till the print media attains a constant speed from the first point; and resuming, by the print operation unit, the printing operation from the first point on the second print media portion.

13. A system for enhancing throughput of a thermal printer cutter, the system comprising:

a processor configured to receive a print job for a plurality of print media portions of a print media, wherein the plurality of print media portions comprises at least a first print media portion and a second print media portion; and a print operation unit configured to operate a thermal printer in a first printing mode in an instance in which a designated safe zone is detected, wherein the print operation unit operating the thermal printer in the first printing mode is further configured to:

cause a traversal of the first print media portion in a downstream direction with respect to a print head in the thermal printer to perform a print operation;

cause a traversal of the second print media portion in the downstream direction with respect to the print head to perform the print operation, while the printed first print media portion traverses in the downstream direction with respect to a cutter blade positioned next to a print head within a defined distance in the thermal printer, until the designated safe zone on the second print media portion is detected under the print head;

suspend the printing operation at a first point on the second print media portion until the traversal of the second print media portion halts at a second point in the downstream direction;

cause a first movement of the print media in one of the downstream direction or an upstream direction, based on a position of the designated safe zone with respect to a reference mark, until a first cut point of the first print media portion is detected under the cutter blade;

cause a cutting operation on the first cut point of the first print media portion using the cutter blade;

cause a second movement of the print media in one of the downstream direction or the upstream direction, based on the position of the designated safe zone with respect to the reference mark, until a third point is detected under the print head; and resume the printing operation from the first point on the second print media portion.

14. The system according to claim 13, further comprising a calibration unit configured to operate the thermal printer in a calibration mode, wherein the calibration unit operating the thermal printer in the calibration mode is further configured to:

analyze an image of the received print job to be printed in a print area of each of the plurality of print media portions;

determine a reference mark, wherein the reference mark is a mark in the second print media portion when the first cut point corresponding to the first print media portion is under the cutter blade of a cutter assembly in the thermal printer;

identify a search area having a first length in the print area of each of the plurality of print media portions based on the determined reference mark, and a set of parameters; and designate a safe zone having a second length within the identified search area within a defined proximity to the reference mark within the search area based on one or more predefined criteria.

15. The system according to claim 14, wherein a set of parameters comprises at least a start parameter and a stop parameter, wherein the start parameter and the stop parameter are based on at least one of (a) a printing speed of the thermal printer, (b) a length of each of the plurality of print media portions, (c) a distance between a trailing edge of the first print media portion and a leading edge of the second print media portion, or (d) print margins of each of the plurality of print media portions.

16. The system according to claim 13, wherein the print operation unit is further configured to:

cause a ramping down of a stepper motor in the thermal printer from a constant speed at the first point and attaining a zero speed at the second point in the designated safe zone, wherein the first point corresponds to a point of deceleration of the stepper motor from the constant speed, wherein a distance traversed during the ramping down of the stepper motor corresponds to a ramp-down distance.

17. The system according to claim 16, wherein the print operation unit is further configured to:

cause, a ramping up of the stepper motor in the thermal printer accelerating from the zero speed at the third point in the designated safe zone and attaining the constant speed at the first point in the designated safe zone, wherein the first point corresponds to a point when the stepper motor attains the constant speed, wherein a distance traversed during the ramping up of the stepper motor corresponds to a ramp-up distance, wherein the third point is located towards the downstream direction before the first point at a distance that corresponds to summation of the ramp-down distance and the ramp-up distance from the second point.

18. The system according to claim 13, wherein the first print media portion is separated from the second print media portion by the first cut point defined at a predetermined distance from a second cut point along length of the print media, wherein the first cut point corresponds to the first print media portion and the second cut point corresponds to the second print media portion.

19. The system according to claim 13, wherein the third point is determined by the processor based on a ramp-up distance traversed by the print media before the printing operation is resumed.

20. A method for enhancing throughput of a thermal printer cutter, the method comprising:

receiving, by a processor, a print job for a plurality of print media portions of a print media, wherein the plurality of print media portions comprises at least a first print media portion and a second print media portion;

operating, by a calibration unit, a thermal printer in a calibration mode, wherein the operating of the thermal printer in the calibration mode comprises:

analyzing, by the calibration unit, an image of the received print job to be printed in a print area of each of the plurality of print media portions;

determining, by the calibration unit, a reference mark, wherein the reference mark is a mark in the second print media portion when a first cut point corresponding to the first print media portion is under a cutter blade of a cutter assembly in the thermal printer;

identifying, by the calibration unit, a search area having a first length in the print area of each of the plurality of print media portions based on the determined reference mark, and a set of parameters; and designating, by the calibration unit, a safe zone having a second length within the identified search area within a defined proximity to the reference mark within the search area based on one or more predefined criteria; and operating, by a print operation unit, the thermal printer in a first printing mode in an instance in which a designated safe zone is detected, wherein the operating of the thermal printer in the first printing mode comprises:

causing, by the print operation unit, a traversal of the first print media portion in a downstream direction with respect to a print head in the thermal printer to perform a print operation;

causing, by the print operation unit, a traversal of the second print media portion in the downstream direction with respect to the print head to perform the print operation, while the printed first print media portion traverses in the downstream direction with respect to the cutter blade positioned next to the print head within a defined distance in the thermal printer, until the designated safe zone on the second print media portion is detected under the print head;

suspending, by the print operation unit, the printing operation at a first point on the second print media portion until the traversal of the second print media portion halts at a second point in the downstream direction;

causing, by the print operation unit, a first movement of the print media in one of the downstream direction or an upstream direction, based on a position of the designated safe zone with respect to a reference mark, until the first cut point of the first print media portion is detected under the cutter blade;

causing, by the print operation unit, a cutting operation on the first cut point of the first print media portion using the cutter blade;

causing, by the print operation unit, a second movement of the print media in one of the downstream direction or the upstream direction, based on the position of the designated safe zone with respect to the reference mark, until a third point is detected under the print head; and resuming, by the print operation unit, the printing operation from the first point on the second print media portion.

* * * * *